US011826010B2

(12) United States Patent
Schultheis et al.

(10) Patent No.: US 11,826,010 B2
(45) Date of Patent: Nov. 28, 2023

(54) ROBOTIC VACUUM CLEANING APPARATUS WITH CLEANING ELEMENT

(71) Applicants: Thomas K. Schultheis, Santa Barbara, CA (US); Toni L. Schultheis, Santa Barbara, CA (US); Jethro Bennett, Liverpool (GB)

(72) Inventors: Thomas K. Schultheis, Santa Barbara, CA (US); Toni L. Schultheis, Santa Barbara, CA (US); Jethro Bennett, Liverpool (GB)

( * ) Notice: Subject to any disclaimer, the term of this patent is extended or adjusted under 35 U.S.C. 154(b) by 479 days.

(21) Appl. No.: 16/131,049

(22) Filed: Sep. 14, 2018

(65) Prior Publication Data

US 2019/0053680 A1 Feb. 21, 2019

Related U.S. Application Data

(63) Continuation-in-part of application No. 14/172,828, filed on Feb. 4, 2014, now Pat. No. 10,111,564, which is a continuation-in-part of application No. 13/567,441, filed on Aug. 6, 2012, now Pat. No. 8,826,484, application No. 16/131,049 is a continuation-in-part of application No. 14/220,978, filed on Mar. 20, 2014, now Pat. No. 10,117,555, which is a continuation-in-part of application No. 14/172,828, filed on Feb. 4, 2014, now Pat. No. 10,111,564.

(30) Foreign Application Priority Data

Mar. 21, 2013 (GB) ..... 1305155

(51) Int. Cl.
*A47L 9/06* (2006.01)
*A47L 11/40* (2006.01)

(52) U.S. Cl.
CPC ..... *A47L 9/0673* (2013.01); *A47L 11/4036* (2013.01); *A47L 11/4094* (2013.01); *A47L 2201/00* (2013.01)

(58) Field of Classification Search
CPC ..... A47L 9/06; A47L 9/0673; A47L 11/40; A47L 11/4036; A47L 11/4094; A47L 2201/00
See application file for complete search history.

(56) References Cited

U.S. PATENT DOCUMENTS 4,686,728 A * 8/1987 Rawlins ..... E04H 4/1654 210/167.16
4,797,968 A * 1/1989 Wenzlick ..... A47L 9/02 15/246
4,837,886 A * 6/1989 Rawlins ..... E04H 4/1654 15/1.7
6,459,955 B1 * 10/2002 Bartsch ..... G05D 1/0253 700/245
6,481,515 B1 * 11/2002 Kirkpatrick ..... A47L 11/03 180/65.1
2013/0096717 A1 * 4/2013 Yoon ..... A47L 9/0488 700/245
2014/0352086 A1 * 12/2014 Scholten ..... A47L 11/4038 15/21.1
2015/0342431 A1 * 12/2015 Zydek ..... A47L 9/0477 15/366

* cited by examiner

*Primary Examiner* — Randall E Chin

(57) ABSTRACT

A robotic vacuum cleaning apparatus comprises: a head; a suction element to facilitate suction cleaning of a ground surface via the head; and a cleaning element.

91 Claims, 37 Drawing Sheets

Fig. 10
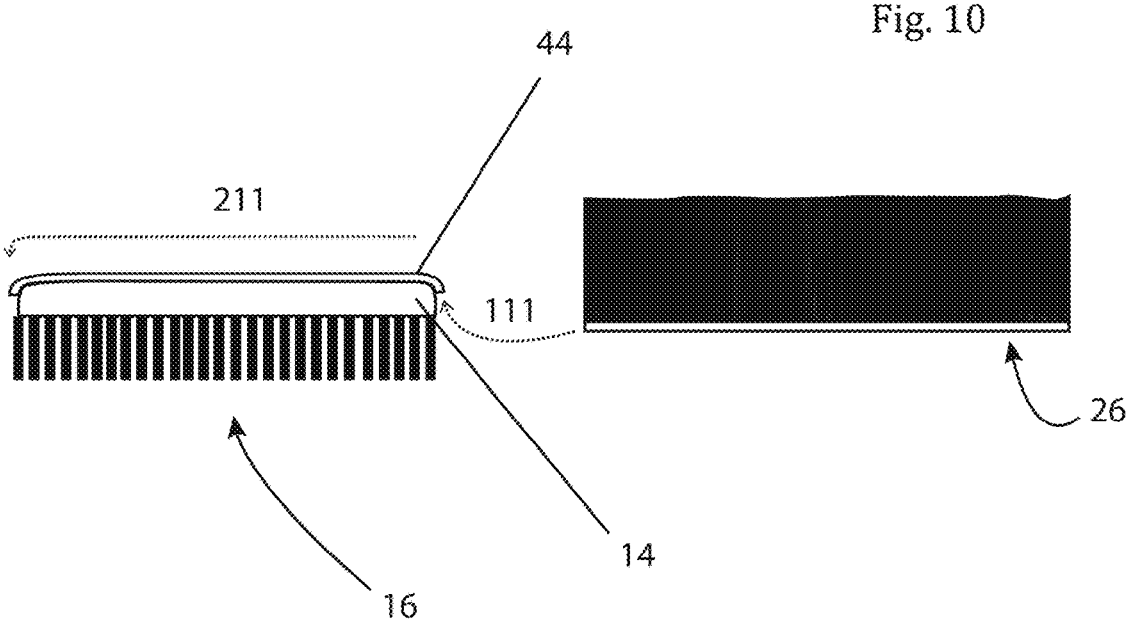
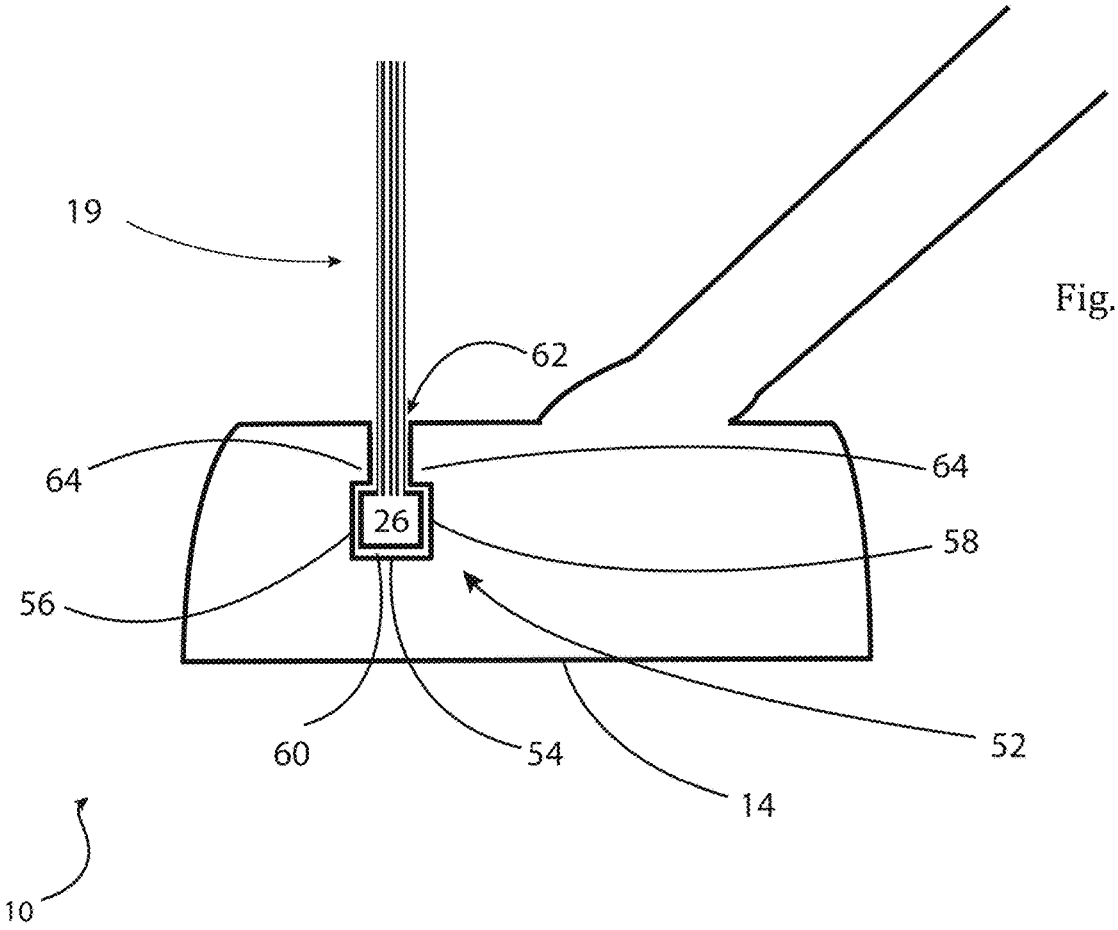
Fig. 11

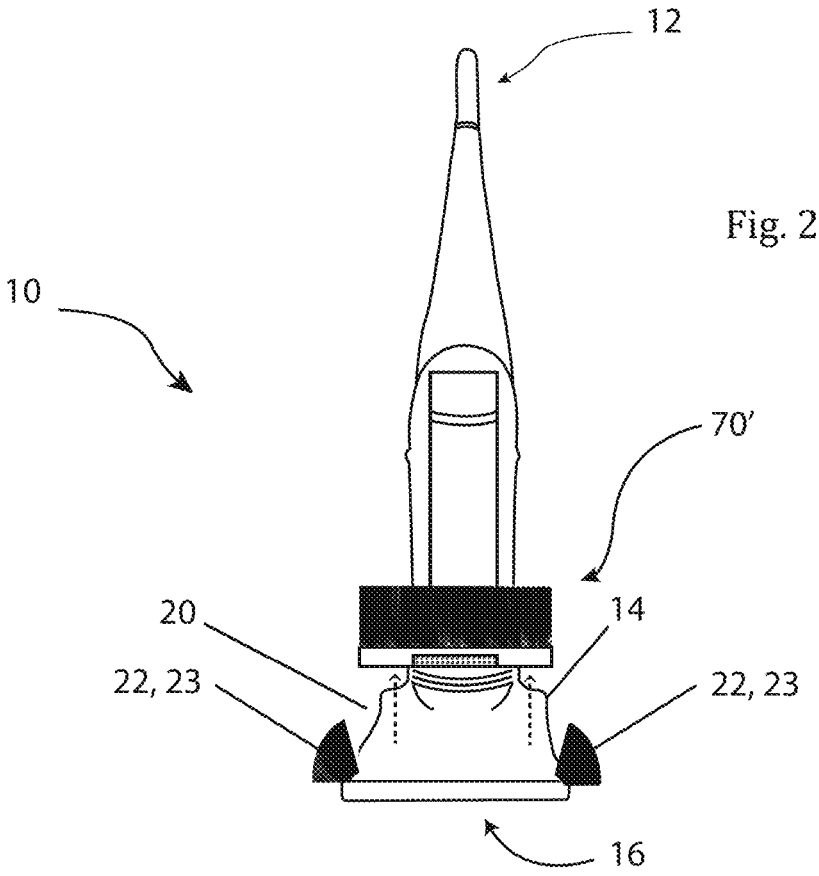
Fig. 29
Fig. 30
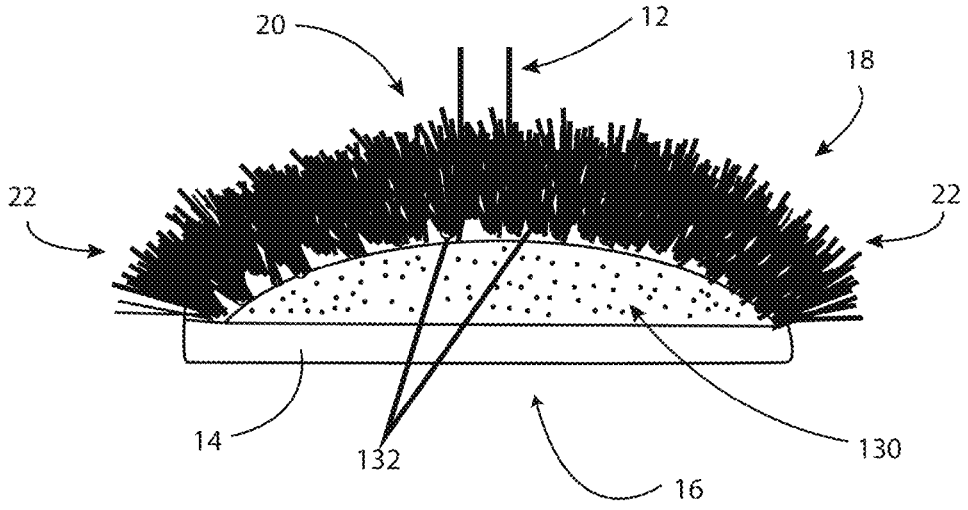

Fig. 35
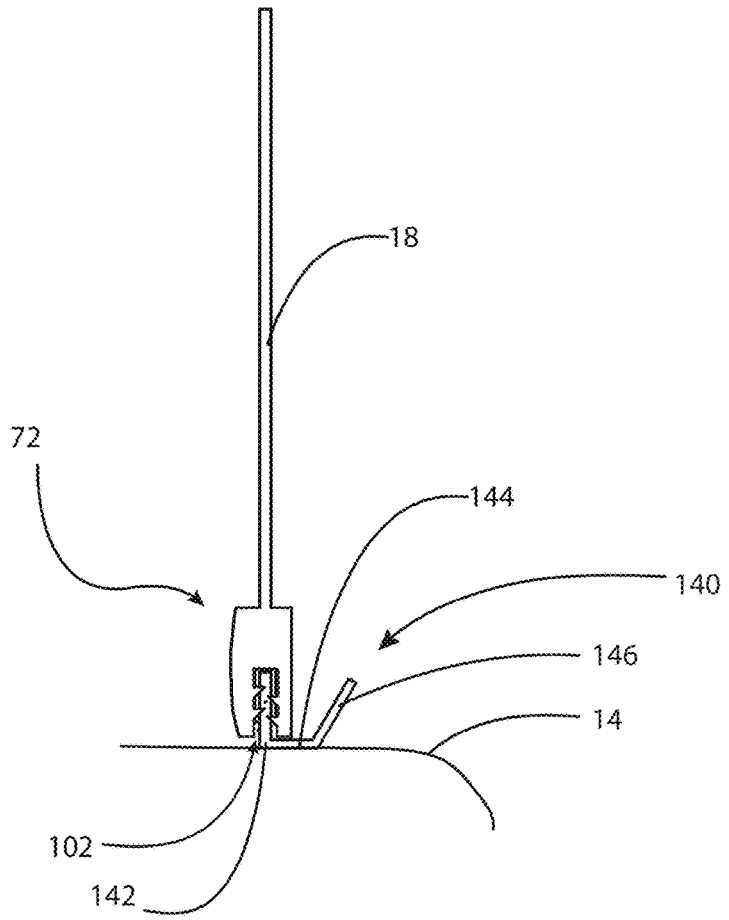
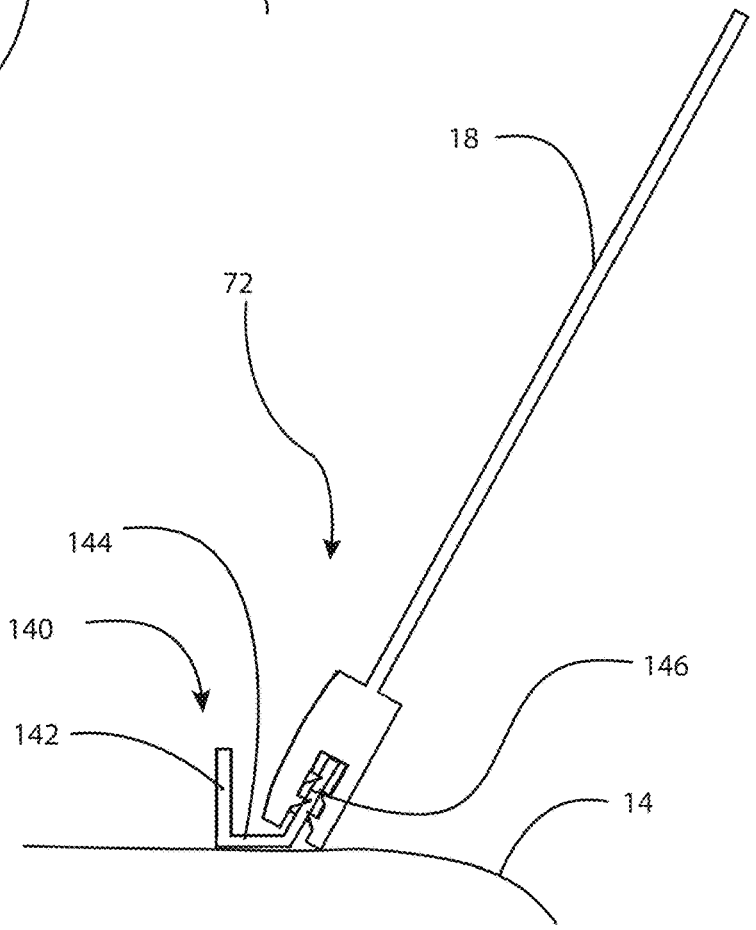
Fig. 36

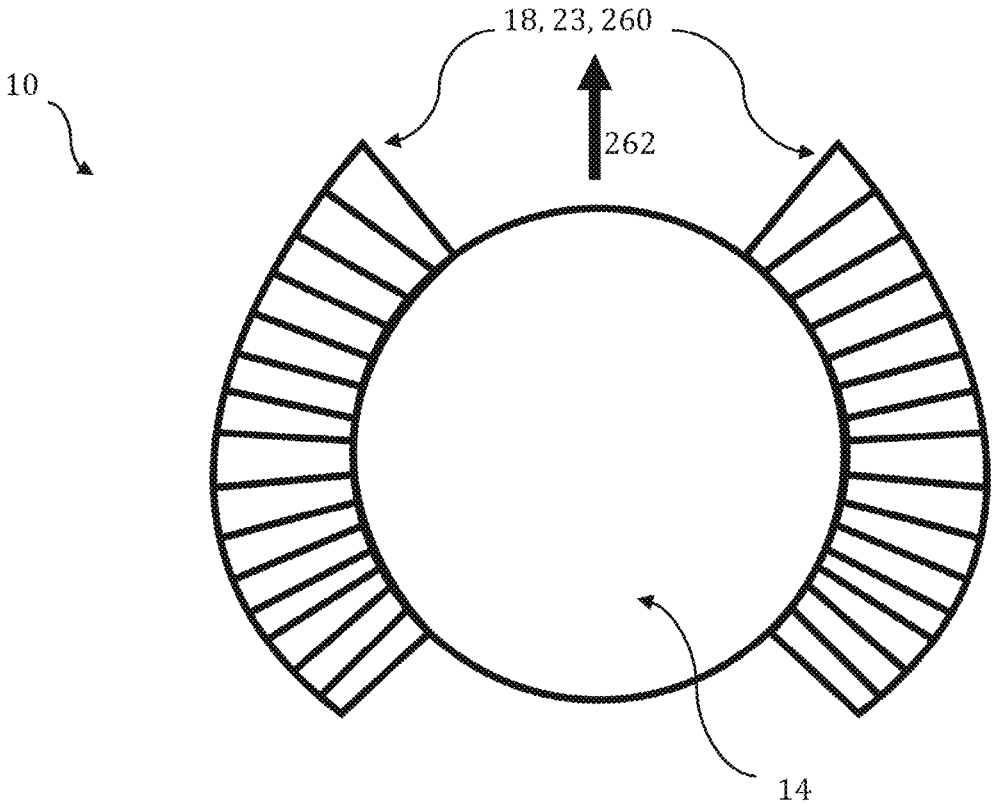
Fig. 68
Fig. 69
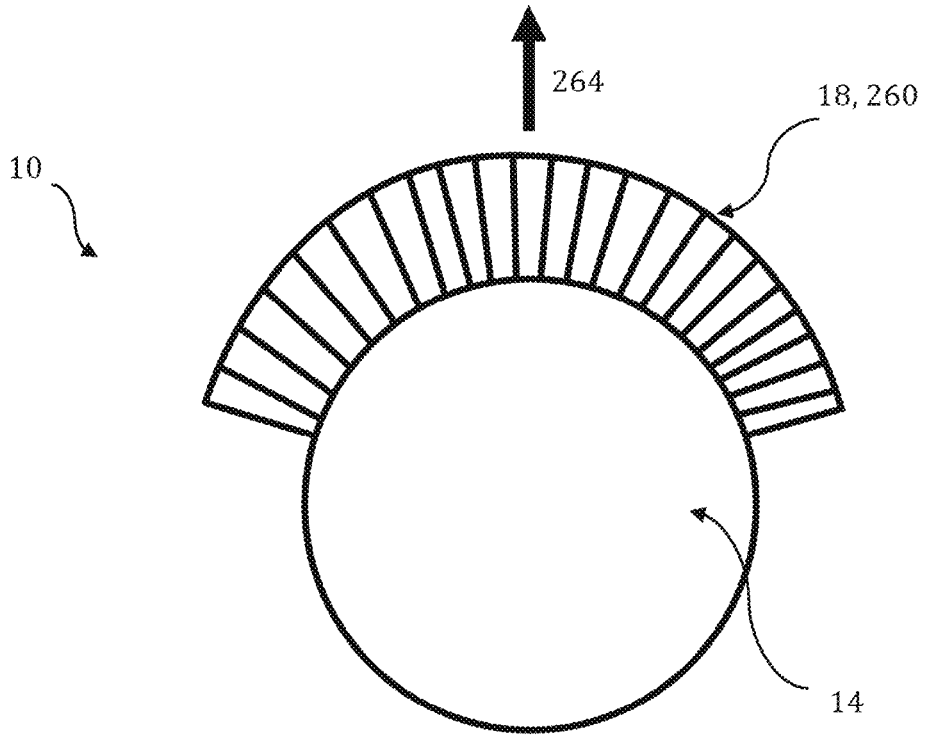

ROBOTIC VACUUM CLEANING APPARATUS WITH CLEANING ELEMENT

REFERENCES TO RELATED APPLICATIONS

This application is a continuation-in-part of application Ser. No. 14/172,828 filed on Feb. 4, 2014, (now U.S. Pat. No. 10,111,564), which is in turn a continuation-in-part of application Ser. No. 13/567,441 filed on Aug. 6, 2012, (now U.S. Pat. No. 8,826,484). This application is also a continuation-in-part of application Ser. No. 14/220,978 filed on Mar. 20, 2014, (now U.S. Pat. No. 10,117,555), which is in turn a continuation-in-part of application Ser. No. 14/172,828 filed on Feb. 4, 2014, (now U.S. Pat. No. 10,111,564). Both application Ser. No. 14/172,828, (now U.S. Pat. No. 10,111,564), and application Ser. No. 14/220,978, (now U.S. Pat. No. 10,117,555), claim priority of British Patent Application [GB] number 1305155.2 filed on Mar. 21, 2013. The disclosures of all of the aforementioned referenced applications are incorporated herein by reference.

BACKGROUND

Field

This invention relates generally to the field of cleaning attachments for floor cleaning devices and more particularly to a floor cleaning apparatus (and still more particularly to a robotic vacuum cleaning apparatus) with cleaning element.

Description of the Related Art

Vacuum cleaners and other floor cleaning appliances including push brooms and similar devices are adapted for cleaning the floor surface which may include carpeting, wood or composite substrates. In most homes and businesses, furniture such as sofas, couches and lounging chairs as well as straight back chairs or other wooden furniture having support cross pieces or rungs are present on the floor and toe-kicks or other indentations at the floor level are present in cabinetry or built-in wall units of various forms. Cob webs, dust and other detritus, commonly referred to as "dust bunnies", may be adhered to the undersurface of such furniture and fixtures. Floor cleaning appliances typically do not provide a means for cleaning the underside of furniture or fixtures to properly extricate the dust bunnies. Such cleaning usually requires additional cleaning elements or hand cleaning effort.

There is a significant problem with present floor cleaning apparatuses, such as brooms, vacuum cleaners, and the like. They are extremely limited in their cleaning capacity and are not configured for significant effective upward and radial cleaning.

A plethora of applications for canister type vacuum cleaners with wand head attachments disclose upward facing brush elements; U.S. Pat. No. 2,975,456 has upward facing bristles, U.S. Pat. No. 3,380,103 has upward facing bristles, U.S. Pat. No. 5,060,342 has extremely small upward facing bristles, U.S. D312,904 has upward facing bristles. U.S. Pat. No. 7,636,979 and US20040016072 even show mops that have a movable or rotatable set of bristles that can be engaged with the floor.

However, these are not bristles configured for upward and radial cleaning; these are bristles configured for downward cleaning on wand heads that are rotatable about a downward facing suction element. Thus the bristles face upwards when the wand head is used on carpet type floors. The head is then rotated about the suction element and the said bristles are used downwardly for cleaning hard and flat floors. They are thus often characterized as being small, tough bristles, and are of little or no use for upward and radial cleaning, and may in fact add dirt to any surface they touch as they have previously contacted a floor. If a surface is engaged by the bristles accidentally, such is the hardness of the bristles, they may block access to an area for the wand head, failing to flexibly bend on impact. Thus they cannot be used for upward and radial cleaning, which requires a cleaning element that is dramatically flexible and does not engage the floor at all, so that floor dirt is not dispersed onto upward and radial surfaces, which is unhygienic and may dirty surfaces, rather than clean them. It is extremely undesirable for an upward and radial cleaning element for a floor cleaning apparatus to at any point be in contact with the floor. As will be shown, specialized adaptation is required for upward and radial cleaning elements.

Furthermore, such rotatable bristle heads tend to not have radial cleaning portions since this is not required for downward cleaning, which is what, in fact, they are configured for. Pat. DE 10,241,492A1 discloses a sideways skirting brush. However, it has no upward or radial function—it is not fit for purpose for the present invention.

U.S. Pat. No. 3,382,525 has 'flayed' upward facing bristles (which again are configured for downward facing cleaning of a floor), and are best seen in FIG. 3 of the noted application, where it can clearly be seen that the bristles, (which are again rotatable), flay outwardly at their lateral ends. However, as will be shown, flayed brush elements are ineffective for the present purpose of radial cleaning—a cleaning element that extends radially, not in a flayed manner, is required to radially engage a surface in order to effectively and targetedly clean it; specialized adaptations are required. The intent of invention U.S. Pat. No. 3,382,525 is shown in Paragraph 1, where the invention is defined as relating to a 'dual purpose tool which is useful for cleaning both floors (hardwood, tile, linoleum) and rugs and carpets.' Thus it can be seen again that the upward facing bristles are configured for downward facing cleaning. It is thus clear why such applications lack the significant adaptations required for upward and radial cleaning, whilst simultaneously downward cleaning a surface of a floor with a downward facing cleaning element. They are not designed for such a purpose.

US20110000039 discloses an invention which has brush parts circumnavigating the head of the apparatus. However, there is no distinct upward and radial cleaning element. This is extremely unhygienic. It would not be hygienic for a brush element that has been used to clean a floor, or a base of a basin, for example, to contact a surface that might be touched by a human hand, or that should be left pristine. Thus it is preferable that an upward and radial cleaning element is separately distinct from the downward facing cleaning element that cleans a floor. Furthermore, the brush element of US20110000039 does not significantly extend. Clearly an upward and radial cleaning element must extend significantly. Furthermore, the cleaning element is not fan-shaped so as to contact and engage as many surfaces as possible.

Effective upward and radial cleaning requires specialized adaptation, and a cleaning element that is configured specifically for the said use. Furthermore, all the inventions as mentioned have a further problem. They do not have a specialized and distinct upward and radial cleaning element that is removably attachable. Upward and radial cleaning elements may get damaged, and certainly dirty. Upward and radial cleaning may provoke engaging of the cleaning element with pristine surfaces. Thus it would be desirable if a damaged or dirty cleaning element could be removed, and a new, pristine cleaning element attached. Furthermore, none of the prior art defines an upward and radial floor cleaning apparatus whereby the cleaning element is incorporated onto a removably attachable utility tool, which can then be removed from the apparatus and used independently by a user as a separate handheld cleaning tool, so that the apparatus is configured to clean a still greater amount of surfaces.

Thus it can be seen that present floor cleaning apparatuses are extremely limited in their cleaning capacity, and that specialized adaptation is required to evolve a floor cleaning apparatus into an effective multi-purpose cleaner that may also clean upward, and radially.

Meanwhile, a huge amount of dust and dirt remains uncleaned and present in a vast majority of worldwide households, including dirt on skirting boards, cobwebs under sofas and in other areas, and dirt and grime accumulating in areas such as toe kicks. Chair struts and the like are left unengaged and thus uncleaned as wand head and vacuum cleaners clean adjacently to them, and underneath them. Cleanable surfaces are often left to gather dust. Many of these surfaces could be cleaned simultaneously to a user cleaning the ground with the downward facing cleaning element of a floor cleaning apparatus, in a same movement, with little or no added effort, if the apparatus had specialized adaptation for such a use. Furthermore, back injuries caused by bending down to clean such underlying surfaces, and discomfort caused by such acts, would be greatly minimized, or a thing of the past.

It is therefore desirable to provide a device which cleans the underside of furniture and fixtures concurrently with normal floor cleaning without requiring separate cleaning effort. It is also desirable that such a device be adaptable for retrofit or original equipment manufacturing of existing floor cleaning appliances.

SUMMARY

Examples of the present invention seek to provide a solution to any or all of the above problem(s) by providing: a robotic vacuum cleaning apparatus, comprising: a head; a suction element to facilitate suction cleaning of a ground surface via the head; and a cleaning element.

According to one aspect of what is claimed, there is provided a robotic vacuum cleaning apparatus, comprising: a head, capable of robotic movement over a ground surface; a suction element to facilitate suction cleaning of the ground surface via the head; and a cleaning element that comprises a brushing portion that, at its highest point, is higher than half height of the head of the robotic vacuum cleaning apparatus; wherein the head comprises a suction system that generates suction, to facilitate suction cleaning of the ground surface, the suction system being a source of suction power.

According to another aspect of what is claimed, there is provided a robotic vacuum cleaning apparatus, comprising: a head, capable of robotic movement over a ground surface via electronics that the head comprises; a suction element to facilitate suction cleaning of the ground surface via the head; and a cleaning element that comprises a brushing portion that, at its highest point, is higher than half height of the head of the robotic vacuum cleaning apparatus.

According to another aspect of what is claimed, there is provided a robotic vacuum cleaning apparatus, comprising: a head, capable of robotic movement over a ground surface via electronics that the head comprises; a suction element to facilitate suction cleaning of the ground surface via the head; and a cleaning element that comprises a brushing portion that, at its highest point, is higher than half height of the head of the robotic vacuum cleaning apparatus; wherein the head comprises a suction system that generates suction, to facilitate suction cleaning of the ground surface, the suction system being a source of suction power.

BRIEF DESCRIPTION OF THE DRAWINGS

These and other features and advantages of the present invention will be better understood by reference to the following detailed description of exemplary embodiments when considered in connection with the accompanying drawings wherein:

FIG. 10 shows how the cleaning element can be positioned and held about the head of the apparatus;

FIG. 11 shows a sawn off cross sectional view of a more evolved embodiment of the hold and curve system where there is provided a receiving channel that substantially encloses and holds the flexible spine of the cleaning element;

FIG. 29 shows an embodiment of the removably attachable utility tool wherein the tool solely incorporates the substantially upstanding central portion of the cleaning element;

FIG. 30 is a perspective view of the cleaning apparatus wherein the cleaning element features a stabilizing member about a lower portion of the cleaning element;

FIG. 35 is a side section view of the apparatus showing inter-engagement of components with a preferred embodiment of the assembly incorporating a mounting bracket, the utility tool mounted on an upright flange of the bracket;

FIG. 36 is a side section view of the apparatus showing the utility tool mounted on an angle flange of the mounting bracket;

FIG. 68 is a birds-eye view of the robotic embodiment as shown in FIG. 67.

FIG. 69 is a birds-eye view of an alternate robotic embodiment of the invention;

DETAILED DESCRIPTION

Figure 1:
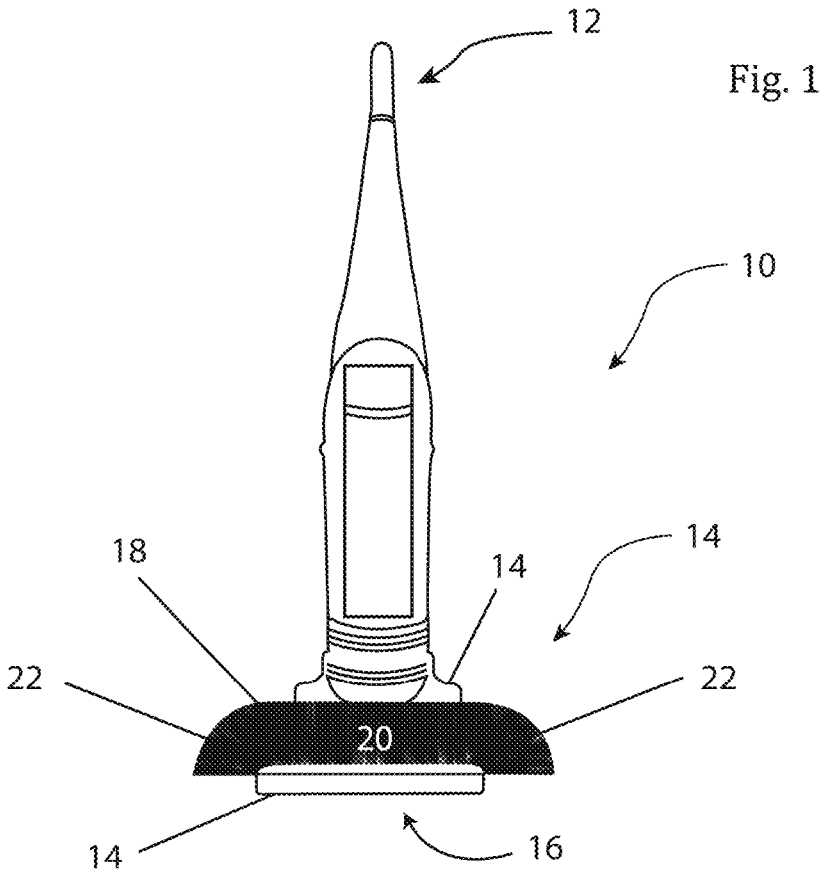
FIG. 1 is a front view of a cleaning apparatus, wherein the cleaning apparatus is an upright vacuum cleaner.

Embodiments shown in the drawings and described herein provide an upward and radial cleaning element that may be used with any floor cleaning apparatus that has a handle for holding, a head, and a downward facing cleaning element for cleaning of a floor, not limited to brooms, upright vacuums cleaners, and canister type cleaners with wand head attachments. Thus it may be used with kitchen floor steamer cleaners, floor roller cleaners, and the like. In a preferred embodiment, the upward and radial cleaning element comprises dramatically resiliently flexible bristles, so that a portion of the element that contacts an engaged surface may be drastically displaced whilst the said cleaning element retains its ability to upwardly and radially clean. The dramatically resiliently flexible bristles then revert to an original position once removed from the said engaged surface, for future cleaning. However, the cleaning element may employ any brush element, not limited to bristles, such as foam, for example, which may also be significantly displaced by an engaged surface, only for the cleaning element to continue cleaning and revert to an original position once removed from the engaged surface.

Preferably the upward and radial cleaning element is fan-shaped, and has a continuous horizon so that there are no significant gaps in the cleaning element. However, it may also contain multiple elements, and, for example, have a separate central portion to its radially outwardly projecting side portions, which may be carried out via separate radial whiskers.

Preferable and/or optional features of the cleaning element particularly are, for example, potentially being intentionally and intuitively movable by a user, and with optional features such as a stabilizing member which may stabilize an upward and radial cleaning element that employs particularly fine hairs, bristles, or similar elements for cleaning.

In a broadest concept, the upward and radial cleaning element may, for example, be non-removable from the cleaning apparatus. However, there may be substantial benefits, as aforementioned, in having a removably attachable upward and radial cleaning element that can be replaced when dirtied or damage. Thus there is provided a hold and curve system for the apparatus, wherein the cleaning element, which now further comprises a resiliently flexible spine that the brush element extends from, is thus curved and held on the apparatus, so that lateral ends of the flexible spine are flexibly downwardly curved, the brush element thus extending outwardly from the curved lateral ends, forming the radially outwardly projecting side portions of the upward and radial cleaning element. The said cleaning element may be removed and replaced by a user. In a particular preferred embodiment of the hold and curve system, a receiving channel is provided, which comprises a receiving portion, a constraining element for holding the flexible spine in the receiving portion, and downwardly curved side portions for creating the radial side portions. Preferably the said cleaning element and receiving channel are dimensioned the same, or substantially the same, with end portions for the channel that placeably block the cleaning element, and a substantially central gap so that the element can easily and intuitively be removed and replaced by the user.

Preferable and/or optional features of the hold and curve system for holding and curving the flexible spine of the upward and radial cleaning element incorporate either a constraining element for constraining the flexible spine thus holding it or downwardly curved side portions for downwardly curving the lateral ends of the flexible spine, thus creating the radially outwardly projecting side portions of the cleaning element.

Alternatively, the hold and curve system is a receiving channel configured to receive and hold the flexible spine of the cleaning element removably. The receiving channel may incorporate a receiving portion for receiving the spine, a constraining element for constraining and thus holding the spine; and downwardly curved side portions for downwardly curving the lateral ends of the flexible spine, thus creating the radially outwardly projecting side portions of the cleaning element for radial cleaning.

In one example, a central gap is provided in the receiving channel through which opposite ends of the flexible spine may be inserted into the receiving channel, the cleaning element thus being removably attachable through the gap.

In yet another example there are provided end portions for the receiving channel, the receiving channel and flexible spine of the cleaning element dimensioned to be substantially the same length, the cleaning element thus easily placeable into position when inserted into the receiving channel via the central gap. The end portions block lateral ends of the flexible spine; the end portions, as well as similar dimensioning of the receiving channel and flexible spine of the cleaning element, thus guaranteeing perfect positioning of the cleaning element for upward and radial cleaning by a user.

For the described embodiments, the flexible spine of the cleaning element is configured for exceptional resilient flexibility and the receiving channel is configured so that the cleaning element resiliently snaps into place when inserted into the gap. The exceptionally resiliently flexible spine extends outwards when inserted into the gap and being restrained by the end portions of the channel, thus guarantees perfect positioning of the cleaning element, without requirement for full placing by a user.

The apparatus, previously defined as incorporating the upward and radial cleaning element, may be provided without the upward and radial cleaning element, for application of the flexibly spined upward and radial cleaning element at a later date, via the hold and curve system.

In a differing embodiment of a removably attachable cleaning element there may be provided a removably attachable base plate for at least one of the central portion of or a whole of, the cleaning element. The base plate is removably attachable from the head of the apparatus, there being provided an attachment mechanism for secure attaching of the base plate to the head of the apparatus. The base plate, and thus the cleaning element, may be, for example, clipped and unclipped to the head of the apparatus, and thus removable. Preferable and/or optional features of the embodiment include a stabilizing member with the at least one of the central portion of or a whole of the cleaning element attached to the base plate via the stabilizing member. Additionally, the base plate is of substantially thin plastics materials.

However, a removably attachable cleaning element is not the only way for the cleaning element to be removably attached to the apparatus; the cleaning element may be provided by way of a removably attachable utility tool, which may be removable by a user for use as a separate handheld cleaning tool, with all the benefits thereof. Thus there is provided, and not appending to the flexibly spined cleaning element with hold and curve system, a cleaning apparatus wherein there is provided a removably attachable utility tool incorporating a base and the upward and radial cleaning element, the upward and radial cleaning element having a substantially upstanding central portion for upward cleaning, and significantly radially extending side portions for radial cleaning. The apparatus further includes an attachment mechanism configured for attaching the utility tool removably to the apparatus for upward and radial cleaning so that the utility tool is removable by a user. The utility tool is thus attachable about the head of the cleaning apparatus via the attachment mechanism for upward and radial cleaning via the cleaning element with the apparatus thus being configured for simultaneous downward cleaning of a surface with the downward facing cleaning element, and upward and radial cleaning via the utility tool, in a same movement. The apparatus is thus configured to clean a greater amount of surfaces than a standard downward facing cleaning apparatus, the utility tool being removable for independent use by a user as a separate handheld cleaning tool, the apparatus thus being further configured to clean a greater amount of surfaces than a standard cleaning apparatus via distinctly separate cleaning with the utility tool.

The attachment mechanism may be any attachment method and/or means, 'attachment mechanism' being a generic term for any attachment method, not limited to being a particularly 'mechanical' means. The cleaning element is thus removable via the utility tool. Preferable and/or optional features of the attachment means particularly are at least one of a male-female attachment mechanism, the cleaning apparatus having a male attachment part configured for receiving by a female attachment part for attaching the utility tool, a female-male attachment mechanism, the cleaning apparatus having a female attachment part configured to receive a male attachment part for attaching the utility tool, or an intermediate attachment mechanism, the utility tool being attachable to the cleaning apparatus via the intermediate attachment mechanism. Alternative mating systems may be employed such as a magnetic system featuring at least one magnet.

In one example, the attachment mechanism is configured so that the utility tool is removably attachable directly to the head of the apparatus.

In a second example, the attachment mechanism includes a placement cavity on the head of the apparatus, the cavity dimensioned substantially similarly to or the same as the base of the utility tool. The head of the apparatus is thus configured to receive the base of the utility tool with the base of the utility tool not substantially protruding from the head, substantially only the cleaning element of the tool extending and protruding from the head of the apparatus for cleaning. In certain embodiments the placement cavity is forwardly angled, so that the cleaning element of the utility tool is forwardly angled from the head of the apparatus when the utility tool is attached via the cavity.

In yet another example, the attachment mechanism includes a handle clip so that the utility tool is removably attachable to the cleaning apparatus via the clip for upward and radial cleaning.

In an example embodiment there is provided a cleaning apparatus wherein the base of the utility tool is a spine, the upward and radial cleaning element received and constrained by the spine and extending therefrom. The spine has at least one of curved side portions or curvable side portions, so that the cleaning element significantly radially extends from the side portions of the spine, thus creating a fan-shaped effect for upward and radial cleaning for the utility tool. The utility tool thus employs a substantially rigid spine, with the brush element (which is preferably bristles), extending therefrom. In one example the cleaning element is specifically defined as comprising bristles. The bristles may be double folded and may be trapped via a trapping element. The trapping element may be a wire.

Further, the base may be a brush clip for receiving and constraining the spine. The brush clip may include an upper channel for receiving the spine, thus constraining the cleaning element. The upper channel of the brush clip may include a front wall, a rear wall, and an upper channel base. These features may include a protruding lip for the front wall, a protruding lip for the rear wall, and at least one of the front wall, the rear wall are resiliently flexible to receive the spine. The brush clip may include relieved portions at the lateral ends, the upper channel base terminating at the relieved portions to accommodate curved side portions at the utility tool spine.

In a second preferred embodiment of the removably attachable utility tool there is provided a cleaning apparatus wherein the upward and radial cleaning element is a flexible spine and the brush element extending therefrom, and there is provided a hold and curve system as previously set forth, wherein the hold and curve system, previously defined as being provided about the head of the apparatus, is now defined as being provided on the base of the utility tool, the hold and curve system thus configured to hold down the flexible spine of the cleaning element and downwardly curve its lateral ends, the tool, and thus the apparatus, thus configured for upward and radial cleaning.

In such an embodiment, the utility tool has an interesting property in that, feasibly both the utility tool itself, and the upward and radial cleaning element, are both removably attachable. This may have benefits. The tool, otherwise, functions extremely similarly.

In a third preferred embodiment of the utility tool there is provided a cleaning apparatus, wherein there are provided a plurality of cavities about the base (of the tool), the cleaning element comprising bristles embedded into said cavities, said cavities configured for substantially upright outward projection of the bristles from a central portion of the base, and radially angled outward projection of the bristles at the side portions of the base, thus configured for upward and radial cleaning. Thus the utility tool employs an embedded bristle configuration for the cleaning element. In one example, the cavities radiate in a plurality of directions, the bristles extending in a plurality of directions not limited to upward and radially. The bristles may be trapped in the cavities via a trapping element. Further, there may be provided at least one of a rubberized bed on the base or a flexible bed on the base, with the embedded bristles extending therefrom.

It is also feasible that the upward and radial cleaning element is formed as one piece with the base of the utility tool. This is well known to manufacturers of santoprene and such other synthetic materials, where unusual shapes can be formed as one piece. Thus the upward and radial cleaning element and the base of the utility tool may be integrally formed as one piece, the tool having bristles and a base of a same synthetic material.

As aforementioned, it is feasible that the upward and radial cleaning element for the apparatus may be multiple elements, and may feature, for example, a separate substantially upstanding central portion for upward cleaning, and separate radial whiskers for radial cleaning, in which case the removably attachable utility tool may feature only the upstanding central portion of the cleaning element, the radial portions feasibly remaining on the cleaning apparatus. Thus there is provided a cleaning apparatus where the upward and radial cleaning element is multiple elements, wherein there is provided a removably attachable utility tool with a base and at least the central portion of the upward and radial cleaning element extending therefrom. At least the central portion of the cleaning element thus being removably attachable via the removably attachable utility tool, and independently usable with the apparatus further incorporting an attachment mechanism for the utility tool as previously set forth.

Thus the utility tool incorporates at least the central portion of the upward and radial cleaning element. (It is feasible the apparatus includes both an upward and radial cleaning element, and also features added whiskers).

Preferable and/or optional features relating to all embodiments of the utility tool may include a bottom aperture on the base of the tool for attaching, and feasible grip elements, which may aid gripping when the tool is used separately by the user. In various examples the utility tool may incorporate at least one of multiple attachment points or an attachment point configured for attachment to a plurality of surfaces.

A retractable handle may be provided within the base of the utility tool, for gripping by a user. Alternatively, a grip for the base may be configured specifically for gripping by a user and may incorporate at least one of a surface for added grip, a shaped surface, shaped specifically to aid handling by a user, or at least one recessed portion, configured to fit a hand of a user for added grip.

At least one attachment flange may be provided on the head of the apparatus for mating with the bottom aperture of the utility tool. The attachment mechanism for the apparatus thus incorporates the at least one attachment flange on the head of the apparatus and the bottom aperture on the utility tool.

Alternatively, a plurality of attachment flanges may be provided on the head of the apparatus for mating with the bottom aperture of the utility tool, the apparatus thus configured for at least one alternate angle of attachment for the utility tool, and thus configured for alternate angulation of the upward and radial cleaning element.

Additionally, at least one of the bottom aperture on the utility tool and the at least one attachment flange have a fastening mechanism for securing attachment In certain examples, the fastening mechanism may be teeth.

A removably attachable secondary handle may be provided for attaching to the utility tool for independent use, removably attachable to the cleaning apparatus, and thus transportable with the apparatus.

In various examples the base of the utility tool is molded plastic, extruded plastic, or extruded metal.

There may be provided a plurality of upward and radial cleaning elements, which may be extravagantly colorized. Cleaning elements of such a type are usually colored black, so as to hide the cleaning element as much as possible, and hide dirt that accumulates on the cleaning element. However, such are the unique characteristics and significant adaptations of the presently set forth upward and radial cleaning element, that it may, counter-intuitively, be beneficial for the said cleaning element to be extravagantly colorized (which is defined as colored in an extravagant color such as green, red, purple, blue, or other selected colors) so that it is extremely visible for the user, forming a type of plumage for the apparatus, wherein the or each upward and radial cleaning element is extravagantly colorized for at least one of: indicating use for an alternate cleaning area; added attractiveness; increased visibility of the element. Thus the extravagantly colorized upward and radial cleaning element may promote use by the user, reminding them of the added cleaning ability of the invention, and may also help differentiate use between alternate locations; a red element for a bathroom; a green element for a kitchen, etc. The said colorization may be provided by way of a coloring addition which is incorporated into the cleaning element at manufacture.

According to a second aspect of the invention, there is provided a removably attachable utility tool for a floor cleaning apparatus as previously described, the removably attachable utility tool incorporating the upward and radial cleaning element for upward and radial cleaning. The utility tool is characterized by an upward and radial cleaning element for a floor cleaning apparatus. As aforementioned, and according to a third aspect of the invention, in a case where the apparatus has a multiple element upward and radial cleaning element, it is feasible the removably attachable utility tool that completes the invention comprises only the central portion of the upward and radial cleaning element.

Thus the upward and radial cleaning element may be provided non-removably; may be provided by way of a removably attachable cleaning element; and may be provided by way of a removably attachable utility tool. It is also feasible that the apparatus is sold and/or manufactured in two parts; a floor cleaning apparatus, and an assembly, with the removably attachable utility tool being provided by way of assembly, an assembly for a floor cleaning apparatus thus being provided, according to a fourth aspect of the invention such an assembly incorporates a removably attachable utility tool as previously set forth; and a mounting element for mounting the removably attachable utility tool to a head of a floor cleaning apparatus, thus converting the floor cleaning apparatus into an upward and radial floor cleaning apparatus, the apparatus thus being configured for both downward facing cleaning via a downward facing cleaning element, and upward and radial cleaning via the removably attachable utility tool.

Preferably the mounting element is a mounting bracket, and may be configured to facilitate various alternate angle attachment methods for attaching the utility tool (and thus the upward and radial cleaning element) to the apparatus at alternate angles. The assembly may also be provided by way of retrofit, which will be obvious, so that, for example, it may be provided to a user, thus converting a standard (and separately manufactured and/or sold) floor cleaning apparatus into the present invention for upward and radial cleaning. In one example, the mounting element is a mounting bracket. The mounting bracket may include an upright flange, a mounting flange, and an angle flange for alternative angled mounting of the utility tool to the apparatus. Additionally, the mounting bracket may be split into separate miniaturized brackets for mounting the utility tool. The assembly may include at least one of adhesive for mounting the mounting bracket to the apparatus or at least one screw cavity in the bracket for screwing the bracket to the apparatus.

The removably attachable cleaning element itself is a novel method of facilitating upward and radial cleaning for a floor cleaning apparatus, and in embodiments characterized by a removably attachable cleaning element, it is clearly an integral element for facilitating the present invention, thus, according to a fifth aspect of the invention, there is provided a removably attachable cleaning element, the cleaning element incorporating a flexible spine, and a brush element extending therefrom. The flexible spine is resiliently flexible, configured for application to a cleaning apparatus specifically via a hold and curve system as previously defined. The hold and curve system curves the flexible spine of the cleaning element, thus creating a substantially upward central portion, and radially outwardly extending side portions. The cleaning element may be removably attachable to the hold and curve system, thus configured for application to a standard floor cleaning apparatus converting the said floor cleaning apparatus into an upward and radial floor cleaning apparatus, the cleaning apparatus having a downward facing cleaning element for downward facing cleaning, and an upward and radial cleaning element for simultaneous upward and radial cleaning. Simultaneous downward, as well as upward and radial, cleaning is thus facilitated, in a same movement, by application of the removably attachable cleaning element to the apparatus via the hold and curve system. The removably attachable cleaning element is removable and replaceable by a user so that a cleaning element can be removed, and a new cleaning element attached, thus renewing clean, effective, and hygienic upward and radial cleaning for the apparatus, wherein the cleaning element is dimensioned specifically for application to the hold and curve system, and thus dimensioned specifically for application about the head of the cleaning apparatus, thus creating a fan shaped effect about the head of the apparatus, for upward and radial cleaning, when applied to the apparatus.

The cleaning element is dimensioned specifically for application to the apparatus via the hold and curve system as previously set forth, which is preferably a receiving channel. Preferable and or optional features of the fifth aspect of the invention include the removably attachable cleaning element feasibly being provided as a length for cutting, so that the length can be cut to form the cleaning element for application to a floor cleaning apparatus, thus forming the present invention. The brush element may be substantially spheroidal. Further, the brush element may be dramatically resiliently flexible bristles.

It is feasible a removably attachable cleaning element may incorporate a brush element with a stabilizing member, thus stabilizing the brush element. Thus, according to a sixth aspect of the invention there is provided such a removably attachable cleaning element having a brush element with a stabilizing member. It is feasible the stabilizing member may act as (and thus is) a flexible spine. An optional feature whereby there is provided a base plate for the cleaning element, which may, for example, be a thin plastic base, and may be attachable direct to the head of the apparatus.

Finally, an upward and radial cleaning element may be particularly appropriate and/or beneficial for a canister-type vacuum cleaner with wand head attachment, which marries the power of a vacuum cleaner with the dexterity of a broom with its wand head, which is particularly useful for the present invention. Thus there is provided, according to a seventh aspect of the invention, a canister vacuum cleaning apparatus which incorporates a canister; a suction system for generating suction; a wand head; a wand handle for holding, a downward facing suction element on a bottom side of the head for downward suction cleaning of a surface. The head may be further defined as being non-rotatable about the suction element, non-rotatable so that the bottom side of the head and a top side of the head cannot be interchangeably used with the suction element, or incorporating a pivoting mechanism so that the wand head is pivotable. The head may further include an interchangeably retractable and projectable downward facing brush element, retractable and projectable from the bottom side of the wand head for use with the suction element, thus optimizing the apparatus for effective suction cleaning on alternate surfacing; a selecting element, selectable by a user, for interchangeably retracting and projecting the downward facing retractable and projectable brush element from the bottom side of the wand head. Operatively associated with the head is an upward and radial cleaning element incorporating a substantially upstanding central portion for upward cleaning and radially outwardly projecting side portions for radial cleaning, the upward and radial cleaning element being distinctly separate from the downward facing suction element. The upward and radial cleaning element includes dramatically resiliently flexible bristles, said bristles configured for optimal upward and radial cleaning of low lying upward surfaces, and high lying upward surfaces, dramatically flexibly bending on contact with an engaged surface thus not blocking the wand head from accessing areas for cleaning, and resiliently returning to an original position once removed from said engaged surface, the upward and radial cleaning element attached substantially upstandingly to the wand head, the cleaning apparatus thus configured for upward and radially extending cleaning of a surface, whilst simultaneously downwardly cleaning via the downward facing suction element, in a same movement, the apparatus thus configured for cleaning of a significantly greater amount of surfaces than a standard canister vacuum cleaning apparatus.

The canister vacuum cleaning apparatus as set forth thus differentiates itself from canister-type vacuum cleaners that have wand heads with upstanding bristles that are configured for facilitating downward cleaning of a surface, rotatable about the downward facing suction element. A retractable and projectable brush element is employed, the upward and radial cleaning element remaining on a top side of the wand head for upward and radial cleaning, distinct and separate from the downward facing suction element. The retractable and projectable brush element is preferably projected to facilitate effective cleaning of hard and flat surfaces, and retracted to facilitate effective cleaning of carpet type surfaces, which brush element feasibly may be of any materials, not limited to bristles.

The canister vacuum cleaning apparatus may employ a non-removable upward and radial cleaning element, a removably attachable cleaning element, or a removably attachable utility tool, and may feature extravagant plumage, the upward and radial cleaning element preferably being extravagantly colorized. In certain examples the cleaning element is dimensioned for dramatic radial cleaning of an extraneous adjacent surface, thus facilitating engaging and cleaning of a surface which the head of the apparatus is blocked from directly engaging by at least 2 inches. As previously discussed, the bristles may be extravagantly colorized for at least one of indicating use for an alternate cleaning area, added attractiveness or increased visibility of the element. The extravagantly colorization may be accomplished via a coloring addition.

In certain embodiments, the upstandingly and radially extending cleaning element may be substantially forwardly and backwardly movable by a user via a movement selecting element.

In certain embodiments there is provided a plug and cable, and a cable retraction system on the canister for retracting the plug and cable. Also in certain embodiments there are provided a plurality of wand head attachments for the apparatus.

Referring to the drawings, there is shown a cleaning apparatus 10 comprising a handle 12 for holding, a head 14, a downward facing cleaning element 16 on the head 14 for downward facing cleaning of a surface, and an upward and radial cleaning element 18 about the head 14 of the apparatus 10, the upward and radial cleaning element 18 comprising at least a brush element 19 for cleaning, and having a substantially upstanding central portion 20 for upward cleaning, and radially outwardly projecting side portions 22 for radial cleaning, the apparatus 10 thus configured for simultaneous upward and radial cleaning via the upward and radial cleaning element 18, and downward facing cleaning via the downward facing cleaning element 16, in a same movement, the apparatus 10 thus configured to clean a greater amount of surfaces than a standard downward facing cleaning apparatus, with little or no added effort by a user.

Figure 2:
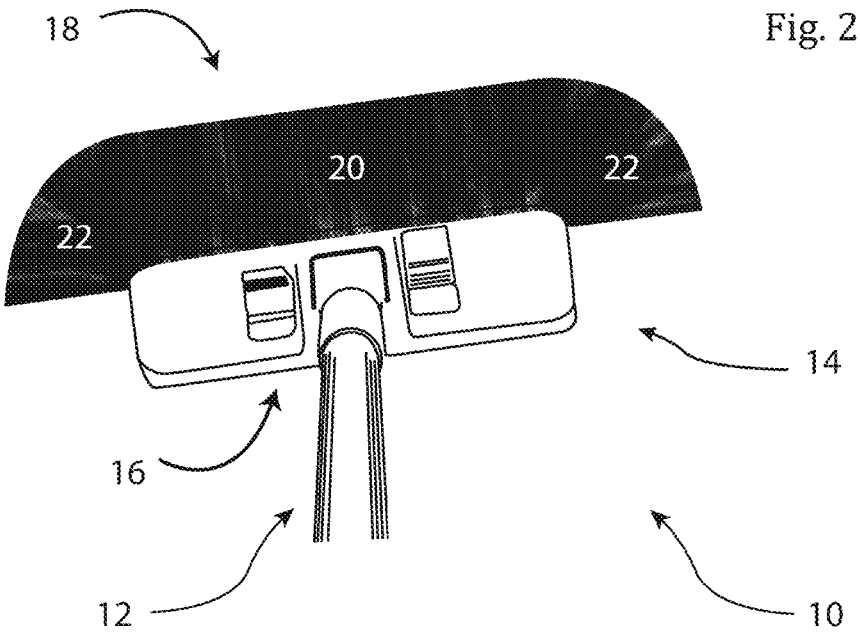
FIG. 2 is a perspective view of the cleaning apparatus with particular attention to an upward and radial cleaning element, wherein the cleaning apparatus is a canister-type vacuum cleaner with wand head.
Figure 3:
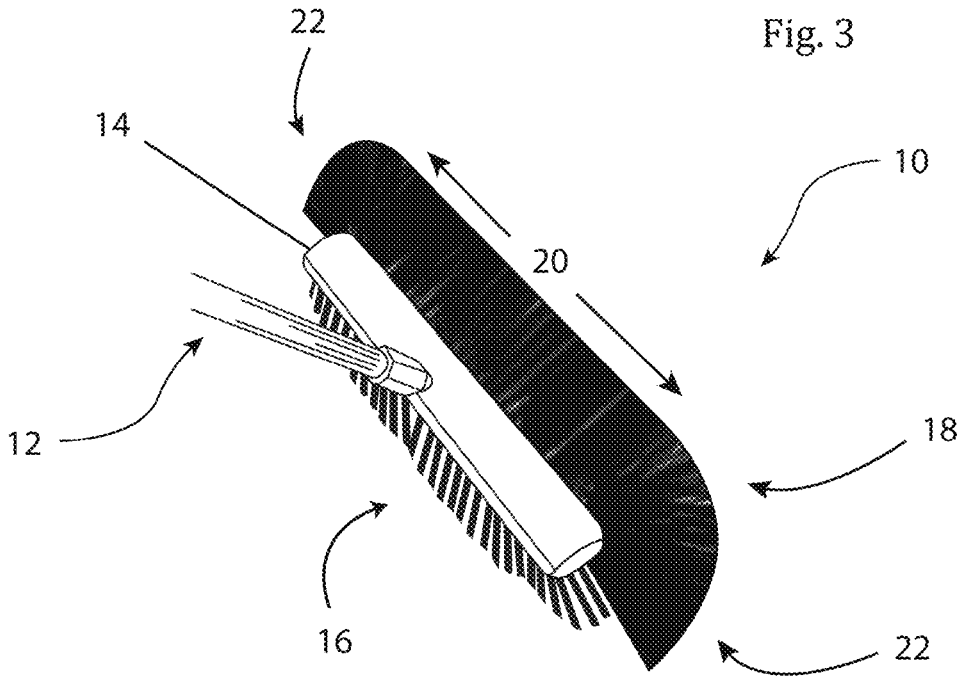
FIG. 3 is a perspective view of the cleaning apparatus, wherein the cleaning apparatus is a broom.

With particular reference to FIGS. 1, 2 and 3, the apparatus 10 may be an upright vacuum cleaner, as shown in FIG. 1, a canister-type vacuum cleaner with wand attachment, as shown in FIG. 2, a broom, as shown in FIG. 3, or any other floor cleaning apparatus that cleans a floor.

Each apparatus as seen in FIGS. 1, 2, and 3 has a handle 12 for holding the apparatus 10 for a user. In a case of FIG. 1, an upright vacuum cleaner, the handle 12 is an abbreviated handle. In a case of FIGS. 2 and 3, the handle 12 is a long handle that extends to the head 14 of the apparatus 10. Necessarily, a floor cleaning apparatus 10 that is manually used by a user must have a handle 12 for holding.

Each apparatus has a head 14, and a downward facing cleaning element 16 on an underside of the head 14 for downward facing cleaning of a floor. In a case of an upright vacuum cleaner as shown in FIG. 1, the head 14 is typically bulky, the apparatus heavy. In a case of FIG. 2 and FIG. 3, the head 14 of the apparatus 10 is lightweight and more dextrous, which may have particular advantages for the present invention 10. The canister for FIG. 2 is not shown, thus focusing on the head 14 and upward and radial cleaning element 18 of the apparatus.

In FIG. 1 and FIG. 2, the downward facing cleaning element 16 is a suction element for cleaning a floor. In FIG. 3, the downward cleaning element 16 is a brush for a broom.

There is provided an upward and radial cleaning element 18 attached to the head 14 of the apparatus 10 which brushes and cleans upwardly and radially, simultaneously whilst the apparatus 10 is used for downward cleaning via the downward facing cleaning element 16. Because the upward and radial cleaning element 18 can clean with no added movement from the user, at a same time as downwardly cleaning, the invention 10 is said to clean upwardly and radially, in a same movement.

In a preferred embodiment, as seen in FIGS. 1, 2, 3, the upward and radial cleaning element 18 is fan-shaped, has a substantially upstanding central portion 20, and radially outwardly projecting side portions 22. Its horizon may extend in a fan-shape continuously from one lateral end to another, thus it could be said to have a continuous horizon, there being no significant gaps or breaks in a top of the brush element 19. If the upward and radial cleaning element comprises bristles, there may be minor gaps between bristles, minor height differentials between individual bristles and the like. Nevertheless, if the horizon of the cleaning element extends continuously from one lateral end to another in a significantly uninterrupted way as seen in FIGS. 1, 2, 3, it is said to have a continuous horizon.

The upward and radial cleaning element 18 is shown in FIG. 2 and FIG. 3 forwardly angled from the head, which may have cleaning benefits.

Preferably, as shown, the radially outwardly projecting side portions of the cleaning element are downwardly curved substantially to 90 degrees, and may even feasibly extend slightly beyond 90 degrees.

Preferably the upward and radial cleaning element 18 is distinctly separate from the downward facing cleaning element 16 in that they are physically separated, rather than continuous, signifying that the upward and radial cleaning element 18 is configured differently from the downward facing cleaning element 16 and performs a different cleaning function, thus requiring different form. Even if the apparatus is a broom, the upward and radial cleaning element 18 may have distinctly different cleaning element constitution and structure to the downward facing cleaning element 16, as shown in FIG. 3, the upward and radial cleaning element 18 thus significantly differentiated from the downward facing cleaning element 16 in design and function.

In a preferred embodiment, the upward and radial cleaning element 18 is distinct from the downward facing cleaning element 16 in so far as being a separate physical cleaning element, has distinct physical properties, comprising a different cleaning material than the downward facing cleaning element 16, and it may also be a significantly different length from the downward facing cleaning element 16, the upward and radial cleaning element 18 thus significantly differentiated from the downward facing cleaning element 16 in design and function, since requirements for effective cleaning are different for an upward and radial cleaning element 18 in relation to a downward facing cleaning element 16.

The upward and radial cleaning element 18 preferably, as shown, comprises dramatically resiliently flexible bristles, which may have particular benefits, as will be explored. However, the upward and radial cleaning element 18 may comprise any material for brushing. It may feasibly employ, for example, foam, or any other materials In FIG. 1, the upward and radial cleaning element 18 (which will herein be described by use of the term 'cleaning element' 18, with the downward facing cleaning element 16 being differentiated via use of the term 'downward facing cleaning element' 16) extends substantially vertically, extending from the head 14 of the apparatus at a substantially vertical upstanding angle perpendicular to a floor surface for cleaning. This may have benefits in terms of gaining a maximum cleaning height for the cleaning element 18, and thus engaging upward and radial cleaning surfaces significantly above a height of the apparatus head 14.

In FIG. 2 and FIG. 3, the cleaning element 18 is forwardly angled from the head 14, extending out in front of the head in a forwardly angulated angle. This may have benefits in contacting a greater amount of surfaces in a same movement as cleaning the floor, and especially in cleaning surfaces which are located in front (both directly in front and radially in front) of the head 14 of the apparatus 10 whilst cleaning of a floor is taking place. In such a case, for example, where the cleaning element 18 is forwardly angled, the cleaning element 18 nonetheless can be said to be an upward and radial cleaning element 18, since it nonetheless extends upwardly, albeit in an angled manner.

In FIG. 3, a significantly broad upstanding central portion 20 for the cleaning element 18 is shown, which significantly straightly extends along a latitude of the cleaning apparatus head 14, its horizon unbroken. However, as with a fan-shape, the cleaning element 18 (and its horizon) need not extend so significantly flatly along its central portion, and may, for example, be significantly roundly curved from side to side, in, for example, a substantially semi-circular, or halo, shape. Nevertheless, it has a substantially upstanding central portion 20 for upward cleaning, and radially outwardly projecting side portions 22 for radial cleaning, even if it is substantially semi-circular, and is configured for upward and radial cleaning.

As shown in FIG. 3, the cleaning element 18 may be slim in depth, although it is equally feasible the cleaning element 18 may be significantly deep in depth, or spheroidal, feasibly having a broadly rounded face, which may increase engagement surface area for the cleaning element 18. The cleaning element 18 may also have brush elements that radiate forwardly and backwardly, and is thus not limited to comprising only a central upstanding and radially outwardly projecting portions, feasibly radiating in a plurality of directions not limited to substantially upstandingly and radially.

Figure 4:
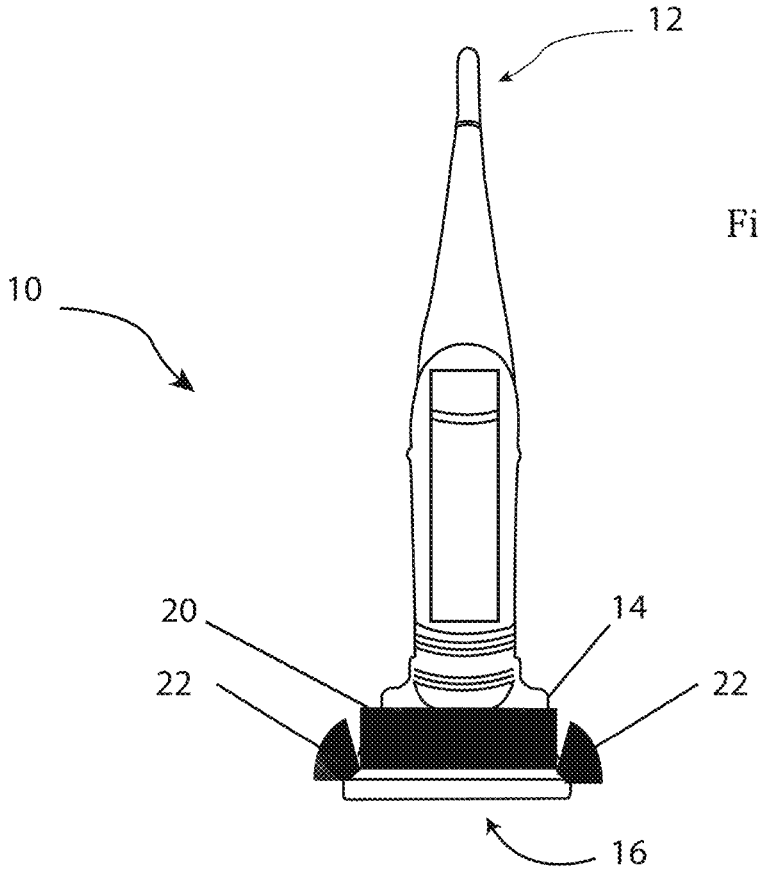
FIG. 4 shows the cleaning apparatus wherein there is provided a multi-partheid cleaning element.

There is shown in FIG. 4 an example embodiment of the invention 10 where the upward and radial cleaning element 18 is composed of multiple parts (defined herein as "multi-partheid"), with the radial portions being separate whisker parts, and the central portion being a separate upstanding portion, separate from the whiskers. Thus the upward and radial cleaning element 18, in the shown example, comprises a substantially upstanding central portion 20, and radially outwardly projecting side portions 22, via a multi-partheid configuration, and, in the example embodiment, via radial whiskers 22 for the radially outwardly projecting side portions 22. Nevertheless, it has a substantially upstanding central portion 20 for upward cleaning, and radially outwardly projecting side portions 22 for radial cleaning. In the shown example embodiment of a multi-partheid upward and radial cleaning element 18, the whiskers are radially outwardly projecting and carry out the radial cleaning, whilst the central upstanding portion carries out the upward cleaning. However, it is feasible in such an embodiment that the central portion also has radially outwardly projecting portions, and that the apparatus further retains whiskers, which may be projected at an alternate angle and/or extend from an alternate position on the head 14 to maximize the cleaning efficiency of the cleaning element 18. Thus the cleaning element 18 could be said to be multi-angulated. It is also feasible, for example, that there are two fan-shaped cleaning elements that extend from the head at alternate angles, both having an upstanding central portion 20 for upward cleaning, and radially outwardly projecting side portions 22 for radial cleaning, in which case, again, the cleaning element could be said to be multi-angulated, which may, feasibly, improve cleaning.

In FIG. 4, the central portion 20 of the cleaning element 18 is located behind the radial whiskers. Thus the multiple comprising parts of a multi-partheid cleaning element may be staggered, multi-angulated, and the like.

In a case of all of FIGS. 1, 2, 3, 4, the upward and radial cleaning element 18 may be, for example, manufactured and/or embedded into the head 14 of the apparatus non-removably. The present invention 10, characterized by an upward and radial cleaning element 18 for a floor cleaning apparatus, will now be explored in embodiments where the cleaning element 18 is removably attachable, which may have significant benefits.

Removably Attachable Cleaning Element

Figure 5:
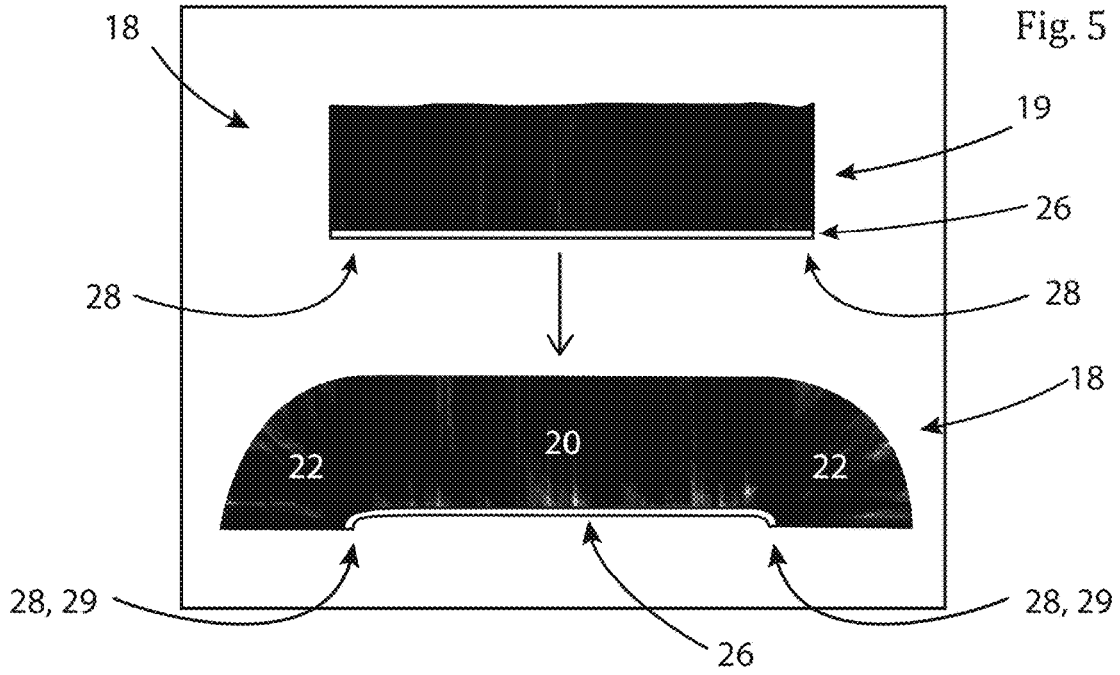
FIG. 5 shows a cleaning element comprising a resiliently flexible spine and a brush element extending therefrom, curving of lateral ends of the flexible spine creating radially outwardly projecting side portions for the cleaning element.

In FIG. 5, there is shown an embodiment of the cleaning element 18 which comprises a resiliently flexible spine 26 and a brush element 19 extending therefrom, and has initially, as shown, a straight spine. Since the brush element 19, extends outwardly from the resiliently flexible spine 26, if the lateral ends 28 are curved, the brush element 19 projects outwardly at the lateral ends 28, thus creating the radially outwardly projecting side portions 22 of the cleaning element 18. Thus there is shown in FIG. 5 a progression of the preferably removably attachable cleaning element 18 from an initial straight spine configuration, to a curved spine configuration, where the lateral ends 28 of the flexible spine 24 are seen converted into curved lateral ends 29 for the flexible spine 26. The flexible spine 26 may be of synthetic materials, rubberised materials, or any other materials. The curved spine configuration as shown in FIG. 5 is shown in a frozen state; preferably, such is the resilient flexibleness of the flexible spine 26, that is resiliently reverts to a substantially straight configuration when released, for example, by a human hand that is curving it.

Thus there is required a curve and hold system for curving the flexible spine 26 of the cleaning element 18 so that it can be held on or about the head 14 of the apparatus 10 in a curved state for upward and radial cleaning for the floor cleaning apparatus 10. It is feasible that such systems are used to permanently attach the cleaning element 18 to the apparatus 10 non-removably, although they have particular benefits when used with a removably attachable flexibly spined cleaning element 18.

Figure 6:
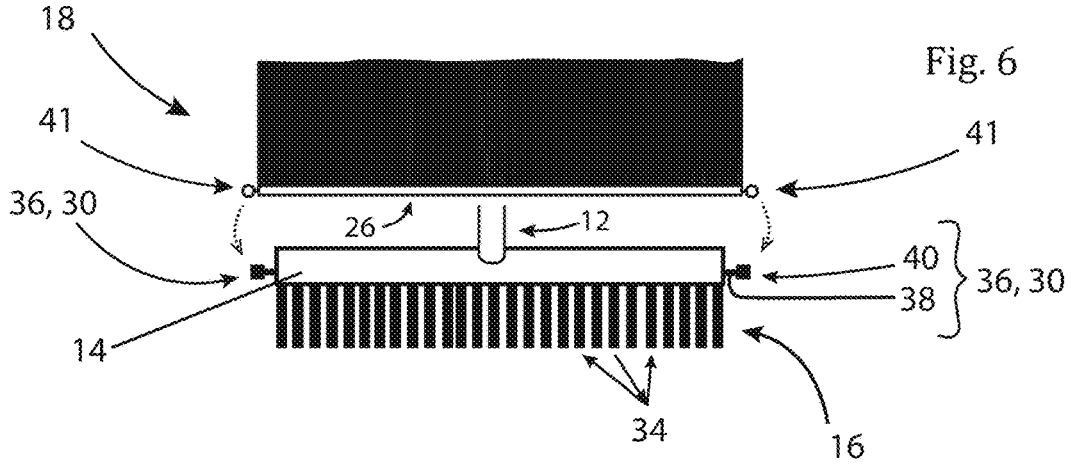
FIG. 6 shows a basic hold and curve system for the cleaning element.

There is shown in FIG. 6 a basic feasible curve and hold system for the flexible spine 26, which is configured to hold down the flexible spine 26 of the removably attachable cleaning element 24, the brush element 19 extending therefrom, and downwardly curve lateral ends 28 of the resiliently flexible spine 26, the cleaning element 18 thus having radially outwardly projecting side portions 22, outwardly projecting from the curved lateral ends 29 of the flexible spine 26, the apparatus 10 thus configured for upward and radial cleaning via holding and curving of the resiliently flexible spine 26 of the cleaning element 18.

Preferably the hold and curve system comprises at least one of a constraining element 30 for constraining the flexible spine 26, thus holding it, and downwardly curved side portions 32 for downwardly curving the lateral ends 28 of the flexible spine 26, thus creating the radially outwardly projecting side portions 22 of the cleaning element 18.

Referring to FIG. 6, there is shown an embodiment of the invention 10 where the cleaning apparatus 10 is a broom, although the apparatus 10 is not limited to a broom and may be any floor cleaning apparatus such as a vacuum-type cleaner, mop, etc. There is shown the head 14 of the broom with its downward facing cleaning element 16, which in this case comprises downward facing floor cleaning bristles 34, which is typical for a broom, although it may be a suction element and the like in the case of a vacuum type cleaner, and a handle 12 for holding the broom. The hold and curve system includes an attaching barb 36 on the head 14 of the broom. The attaching barb 36, in the example embodiment, has a protruding shaft 38 and a shaped head 40. The flexible spine 26 of the cleaning element 18, has ringlets 41 at its lateral ends 28.

Thus it can be seen that the ringlets 41 can be sheathed over the attaching barb 36, the shaped head 40 of the barb 36 holding the flexible spine 26 curvingly around the head 14 of the broom, the lateral ends 28 of the spine 26 thus curving to form curved lateral ends 29, the brush element 19 thus having radially outwardly projecting side portions 22, outwardly projecting from the curved lateral ends 29 of the flexible spine 26 when curved, the apparatus 10 thus configured for upward and radial cleaning via holding and curving of the resiliently flexible spine 26 of the cleaning element 18.

In such a basic feasible embodiment as shown in FIG. 6, the attaching barb 36, could thus be said to be a constraining element 30. Thus the hold and curve system has at least one of: a constraining element for constraining the flexible spine, thus holding it, and downwardly curved side portions for downwardly curving the lateral ends of the flexible spine.

Figure 7:
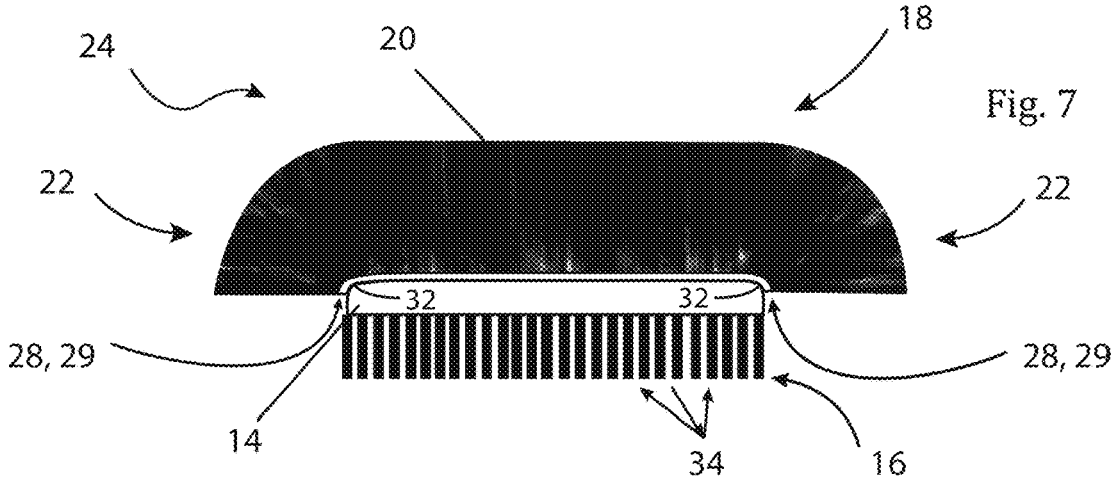
FIG. 7 shows a further basic embodiment of the hold and curve system which includes downwardly curved side portions.

In a still more basic embodiment of a curve and hold system for the flexible spine 26, as shown in FIG. 7, a same example of the broom is shown (although the curve and hold system could be provided with any floor cleaning apparatus, inclusive of a vacuum-type apparatus, etc) where the system includes downwardly curved side portions 32, which in this case are downwardly curved side surfaces 32 on the head 14 of the apparatus 10.

The constraining element 30 may be anything as simple as an adhesive, such as glue, and thus cannot be seen. Similarly the constraining element 30 may be an adhesive strip. It is feasible the constraining element 30 may be an adhesive strip that provides removable attachable properties for the cleaning element 18. For example, it will be well known to those with skill in the art of adhesive stripping that some such stripping may comprise one adhesive side, which may, for example, be permanently or semi-permanently attached to the downwardly curved side portions 32 of the head 14 for the present example, and an aperture or the like on a reverse side of the adhesive strip. The flexible spine 26 of the cleaning element 18 may therefore be configured to mate with the reverse (upward facing) side of the adhesive strip so that it is attachable and/or removably attachable.

Thus it can be seen that the flexible spine 26 of the cleaning element can be held and curved onto the apparatus 10, the downwardly curved side portions 32 of the hold and curve system 32 curving the lateral ends 28 of the flexible spine 26 thus creating curved lateral ends 29 for the flexible spine 26, the cleaning element 18 thus having a substantially upstanding central portion 20 for upward cleaning; and radially outwardly projecting side portions 22 for radial cleaning, the apparatus 10 thus configured for upward and radial cleaning via the upward and radial cleaning element 18.

Figure 8:
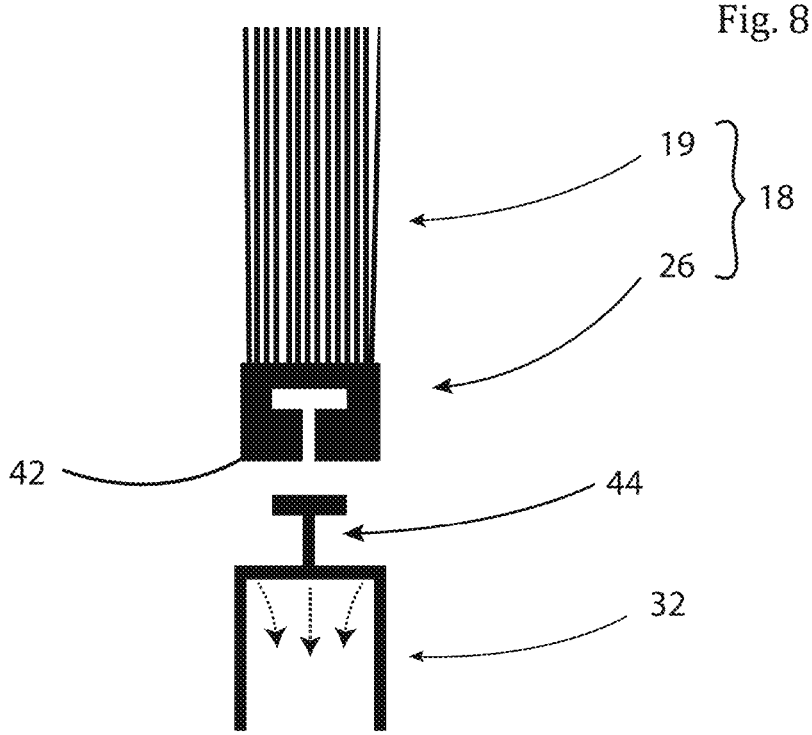
FIG. 8 is a sawn off cross sectional view of a t-slit and t-barb system for constraining the flexible spine of the cleaning element.

In such a hold and curve system defined as having downwardly curved side portions 32 for curving the flexible spine 26, there are various options for constraining elements 30, not limited to adhesive, or any other method and/or means. There is shown in FIG. 8 a T-slit 42 and T-barb 44 system, where the flexible spine 26 of the cleaning element 18 has a T-slit 42 that can be prised onto, and thus receive, the T-barb 44 that projects from the apparatus. There is shown in FIG. 8 the T-barb 44 in a sawn off cross sectional capacity so that the shape of the T-barb 44 is clearly shown. (Three downward arrows below the T-barb 44 artistically denote the downwardly curved side portions 32 for curving the flexible spine 26 downwardly, although they are not visible in a sawn-off cross-sectional view).

The T-barb 44 thus constrains and holds the flexible spine 26. Either one of the T-barb 44 or the T-slit 42, or both in combination, can be seen as a constraining element. Thus the constraining element 30 could be said to be male, received by the female T-slit 42. Similarly, there could feasibly be provided a male T-barb shape on the flexible spine 26, with a T-slit type receiving shape for the apparatus to receive the flexible spine 26.

The T-barb 44 may extend laterally along the head of the apparatus, so that, for example, the flexible spine 26 (and thus the cleaning element 18) can be fitted along the T barb 44 manually, thus attaching the cleaning element 18 to the apparatus and forming the upstanding central portion 20 and radially outwardly projecting side portions 22 of the cleaning element.

Figure 9:
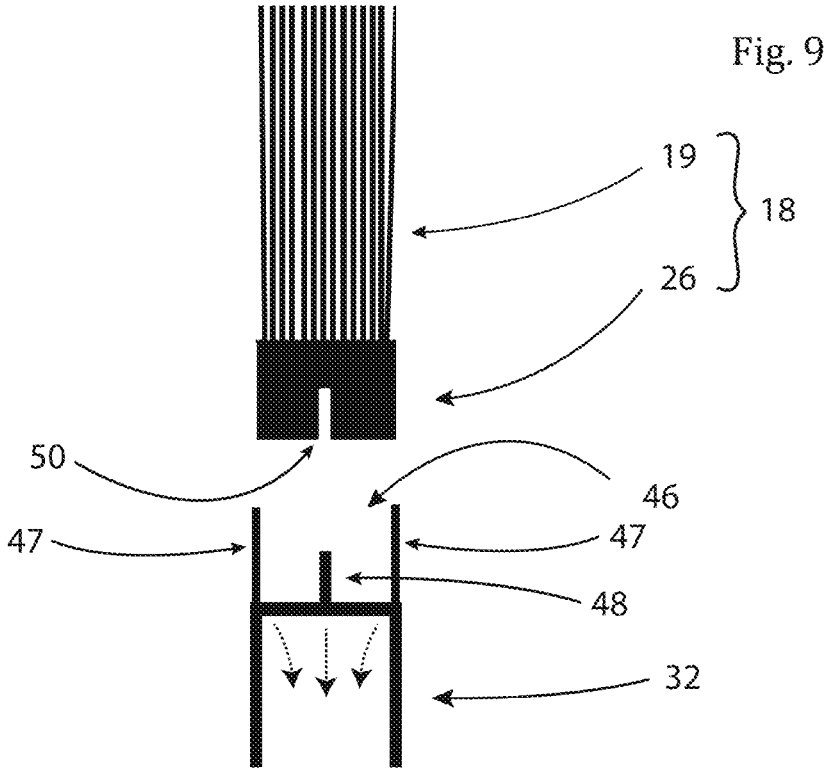
FIG. 9 is a sawn off cross sectional view of an embodiment of the hold and curve system featuring a channel.

There is shown in FIG. 9 an embodiment of the hold and curve system featuring a channel, the system featuring a cavity 46 between walls 47 into which the flexible spine 26 can fit, which channel, in and of itself, may be of such a substantially similar shape to the flexible spine 26 of the cleaning element 18 that it may constrain the cleaning element 18 via tightness of fit alone, in which case tightness could be said to be a constraining element, or that tight walls 47 of the channel could be said to be a constraining element 30. There may be an added constraining element 30, such as a barb 48 protruding from a base of the channel, which may be received by a requisite slit 50 in the flexible spine 26 of the cleaning element 18, thus providing an added constraining element if required. Similarly as shown in FIG. 8, the slit may be a T slit with a T barb etc, or any other constraining element.

Thus it can be seen in both FIG. 8 and FIG. 9, that the cleaning element 18 can be positioned and held about the head 14 of the apparatus 10, and that this may be achieved manually by a user. It is feasible that this is achieved by a user via threading the flexible spine 26 of the cleaning element 18 from one lateral end of the hold and curve system to the other, so that, as shown in FIG. 10, in an example where there is provided a T-barb 44 on the apparatus, and a T-slit 42 (which is not shown) on the flexible spine 26 of the cleaning element 18, the flexible spine 26 is threaded onto the T-barb 44 at one lateral end, via the T-slit 42, and is threaded along the T barb 44, which may run along a full lateral length of the hold and curve system, or be intermittent. The process is denoted sequentially by arrow 111 and arrow 211 as the flexible spine 26 of the cleaning element 18 is threaded onto the T-barb 44 (arrow 111), which could be any sort of attaching barb and the like, and then threaded along the length of the T barb (arrow 211). (The handle 12 of the broom is not shown to provide clarity of the threading and positioning process in such an example embodiment of a hold and curve system).

Thus the flexible spine 26 can be held and, via the downwardly curved side portions 32 of the hold and curve system, forms a substantially upstanding central portion 20 for the cleaning element 18 and radially outwardly projecting side portions 22, thus facilitating upward and radial cleaning for a floor cleaning apparatus 10. In FIG. 10, again an example of a broom is shown, although the hold and curve system, which is described by way of example only, may be employed by any floor cleaning apparatus.

There is shown in FIGS. 11, 12, 13, 14 a more evolved embodiment of a hold and curve system where there is provided a receiving channel 52 that substantially encloses and holds the flexible spine 26 within a receiving portion 60 and further comprises a constraining element 30 and downwardly curved side portions 32.

Figure 12:
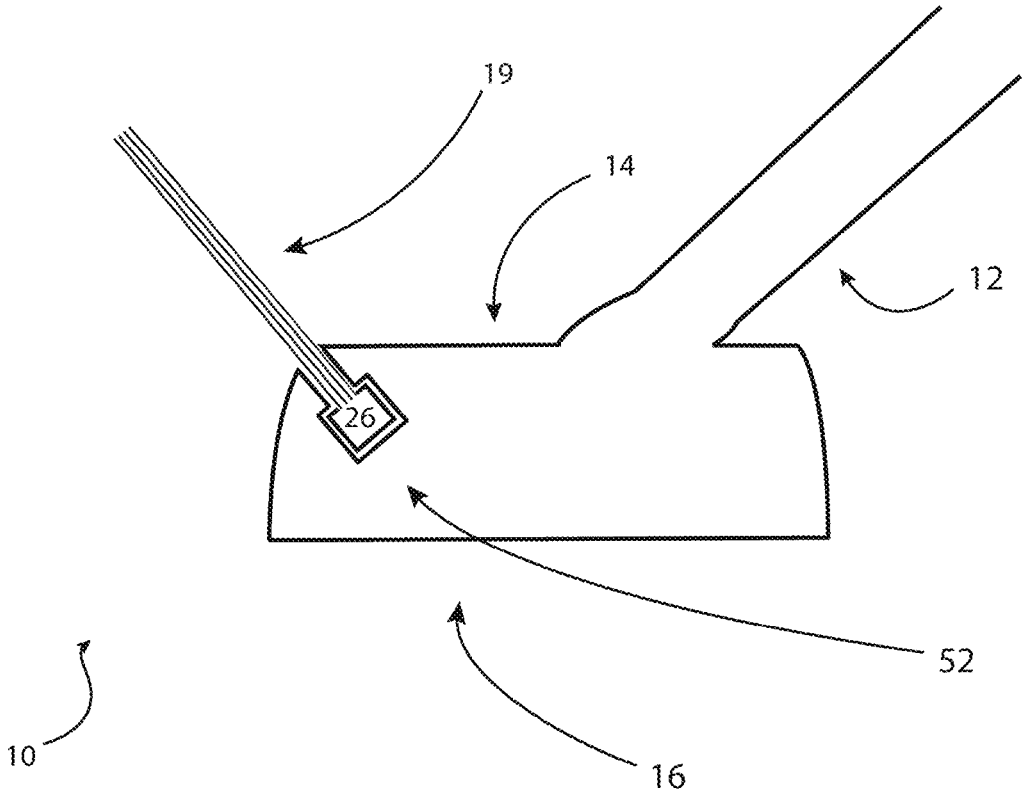
FIG. 12 a sawn off cross sectional view of the receiving channel configured for forward angulation of the cleaning element.

In FIG. 11 and FIG. 12, there is shown a sawn off cross sectional view of a wand head 14 for a canister type vacuum cleaner employing the receiving channel 52 where the receiving channel 52 is configured for vertical angulation and forward angulation of the cleaning element respectively.

In FIG. 11, the receiving channel 52 is configured for vertical orientation of the cleaning element 18, which can be seen extended substantially vertically from the head 14 of the apparatus.

In a preferred embodiment of the receiving channel 52, as shown, the receiving channel 52 comprises a base wall 54, a front wall 56, and a rear wall 58, which substantially define a receiving portion 60 into which the flexible spine 26 of the cleaning element 18 is received. The receiving channel 52 further comprises an upward aperture 62 through which the brush element 19 extends. The receiving channel 52 preferably has at least one protruding lip 64 which acts as a constraining element 30, constraining the flexible spine 26 within the receiving portion 60, whilst the brush element 19 extends through the upward aperture 62. More preferably there are provided two protruding lips 64 so that there is a front lip and a rear lip, the brush element 19 extending therethrough.

There is shown in FIG. 12 a similar receiving channel 52 configured for forward angulation of the cleaning element 18, so that the brush element 19 of the cleaning element 18 extends forwardly from the receiving channel 52, which may be advantageous. In such an embodiment that is thus angulated, the downwardly curved side portions 32 of the receiving channel are said to be downwardly curved if they are downwardly curved with respect to the receiving channel 52, since in an angulated configuration, the receiving channel, and thus the downwardly curved side portions 32 of the receiving channel 52, may be angulated.

Figure 13:
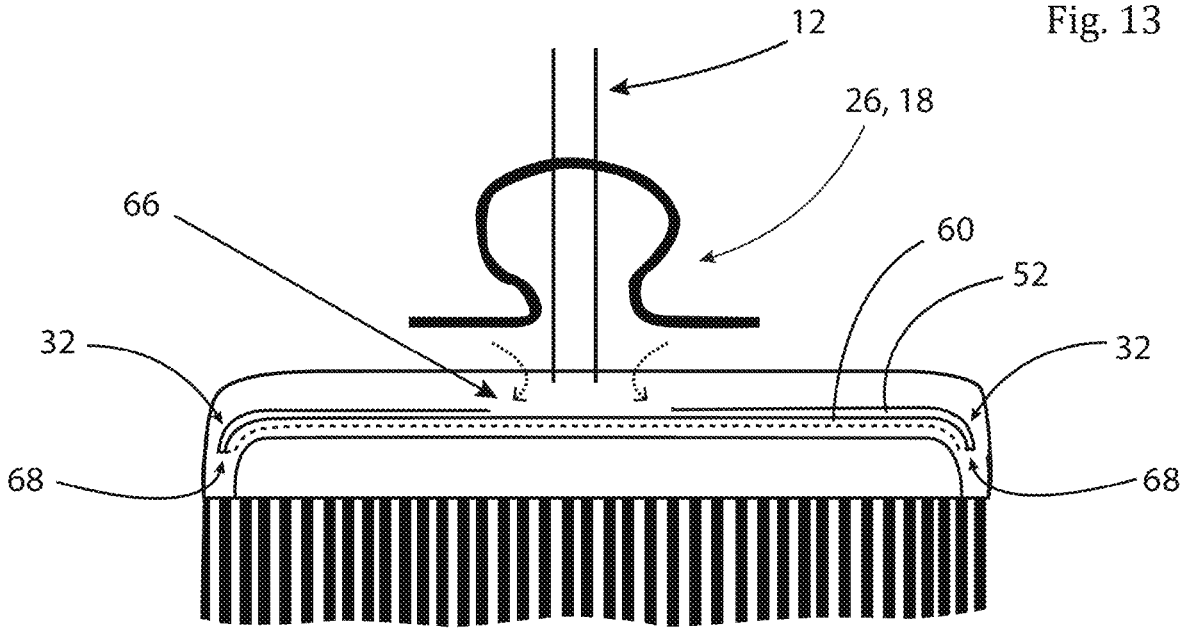
FIG. 13 is a perspective view of a preferred embodiment of the receiving channel wherein there is provided a central gap for introducing the flexible spine into the receiving channel.
Figure 14:
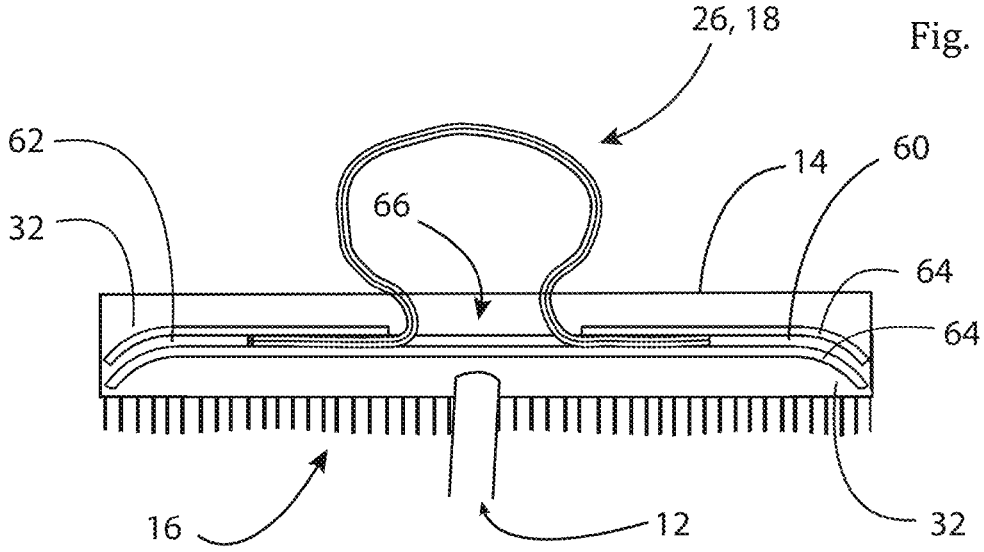
FIG. 14 shows the flexible spine urged into the receiving channel.

The receiving channel 52 is shown in a perspective view in FIG. 13 and FIG. 14 with respect to a preferred method of how to introduce the flexible spine removably into the receiving channel 52, via a central gap 66. The flexible spine 26 is shown without the brush element 19 for greater clarity.

The receiving channel 52 is shown on the head 14 of the floor cleaning apparatus, and comprises a receiving portion 60 for receiving the flexible spine 26, a constraining element for constraining the flexible spine 26 and thus holding it, the constraining element being at least one protruding lip 64, and downwardly curved side portions 32 for downwardly curving the lateral ends 28 of the flexible spine 26, thus creating the radially outwardly projecting side portions 22 of the cleaning element 18 for radial cleaning. In FIG. 13, the flexible spine 18 is bent and arched by a user for feeding into the receiving channel 52 via the central gap 66. The cleaning element 18 can then be urged into place by the user and fed into the receiving channel 52, so that the lateral ends 28 of the flexible spine 26 extend into the downwardly curved side portions 32 of the receiving channel 52. In FIG. 14, the flexible spine 26, having been introduced into the receiving channel 52, is urged into position by the user, so that the flexible spine 26 is curved and forms a substantially fan-shaped effect for the cleaning element 18 for upward and radial cleaning. The central gap 66 need not be exactly central, and may be positioned anywhere between the lateral extents of the receiving channel. Thus it is substantially central.

The receiving portion 60 is shown in phantom in FIG. 13. Preferably the receiving channel 52 has end portions 68, as shown in FIG. 14, said end portions 68 preferably being a termination of the receiving portion 60 (and thus the receiving channel 52) as shown, the receiving channel 52 and flexible spine 26 of the cleaning element 18 dimensioned to be the same, or substantially the same, length, the cleaning element 18 thus easily placeable into position when inserted into the receiving channel 52 via the substantially central gap 66 (which is preferably central), the end portions 68, as well as correct and similar dimensioning of the receiving channel 52 and flexible spine 26 of the cleaning element 18, thus guaranteeing perfect positioning of the cleaning element 18 for upward and radial cleaning by a user.

Preferably the end portions 68 are simply an end wall that blocks the flexible spine 26, thus guaranteeing correct positioning of the flexible spine 26 when fully erected into the channel 52. It is feasible, however, that a wall is not present, in which case, the receiving channel 52, for example, may narrow to such an extent as that the flexible spine 26 is blocked, thus similarly blocking the flexible spine 26.

There is shown in FIG. 14 the at least one protruding lips 64 of the receiving channel 52 that act as a constraining element 30, the flexible spine 26 being fed into the receiving channel 52. Thus it can be seen that the cleaning element 18 can be removably attachably inserted into the receiving channel 52 via the central gap 66, the brush element 19 of the cleaning element 18 extending through the upward aperture 62, the flexible spine 26 flexibly curved at its lateral ends 28, thus creating a fan-shaped effect for upward radial cleaning by the cleaning element 18. It can also be seen how the cleaning element 18 can easily be removed from the receiving channel 52 via the central gap 66.

It is feasible the flexible spine 26 of the cleaning element 18 is resiliently flexible to such an extent that it resiliently snaps into place independently when arched and fed into the central gap 66 by the user. This may require the flexible spine 26 be manufactured with particular materials that have extremely flexibly resilient qualities, and/or that the flexible spine 26 is manufactured with, for example, internal wiring, spring-type materials, etc, (and/or any other method) for creating dramatic resilient flexibility.

There are significant benefits of a removably attachable cleaning element 18. If the cleaning element 18 becomes dirty or damaged, it can be replaced. Thus there may be provided a plurality of cleaning elements 18 for the apparatus, and flexibly spined resiliently flexible cleaning elements 18 may be provided separately from the apparatus for using.

Preferably the hold and curve system for removable attachment of the flexibly spined cleaning element 18 is provided directly on the head 14 of the apparatus 10. However, it is feasible the cleaning element 18 may be attachable to a handle clip that extends from the handle 12 of the apparatus 10, over the head 14 of the apparatus 10. A handle clip of such a type may be a permanently attached, or removably attached, clip and the like that extends from the handle of the apparatus 10 and facilitates attachment of the cleaning element 18 for upward and radial cleaning, Thus it is said that the hold and curve system is provided 'about' the head of the apparatus, incorporating any method and placement that facilitates attaching the cleaning element 18 on, or in a proximity of, the head 14 of the apparatus 10 for upward and radial cleaning.

It will be obvious to those with skill in the art that, if a hold and curve system is provided for the apparatus 10 so that the cleaning element 18 is removably attachable, the apparatus may be provided excluding the removably attachable cleaning element 18, for application of the cleaning element 18 to the apparatus at a later date. In such a case, the said apparatus is within a scope of the present invention.

Removably Attachable Utility Tool

There may be provided a removably attachable utility tool 70 for the apparatus 10, in which case, rather than a removably attachable cleaning element 18 being provided for attachment about the head 14 of the apparatus 10, there may be provided a removably attachable utility tool 70 that comprises a base, and the upward and radial cleaning element 18, the cleaning element 18 having a substantially upstanding central portion 20 for upward cleaning, and significantly radially extending side portions 22 for radial cleaning, the utility tool 70 thus being configured for significant upward and radial cleaning, the apparatus 10 further comprising an attachment mechanism configured for attaching the utility tool 70 removably to the apparatus 10 for upward and radial cleaning so that the utility tool 70 is removable by a user, the utility tool 70 thus being upward facingly attachable about the head 14 of the cleaning apparatus 10 via the attachment mechanism for significant upward and radial cleaning of a surface via the cleaning element 18, the apparatus 10 thus being configured for simultaneous downward cleaning of a surface with the downward facing cleaning element 16, and upward and radial cleaning of a surface with the utility tool 70, in a same movement, the apparatus 10 thus configured to clean a greater amount of surfaces than a standard downward facing cleaning apparatus, the utility tool 70 being removable for independent use by a user as a separate handheld cleaning tool, the apparatus 10 thus being further configured to clean a greater amount of surfaces than a standard cleaning apparatus via distinctly separate cleaning with the utility tool 70 by a user.

The utility tool 70 may be attachable by any means, attachment mechanism being a generic term including any method and/or means of attachment under the Sun, and not limited to being a particularly 'mechanical' means. An attachment mechanism, for example, may simply be an adhesive. Thus an attachment mechanism need not be particularly 'mechanical'.

Similarly to the removably attachable cleaning element 18, the utility tool 70 is preferably attachable direct to the head of the apparatus, which may be any floor cleaning apparatus that has a downward facing cleaning element, although it is feasible the utility tool may be attachable via a handle clip and the like that extends from the handle 12 of the apparatus 10, over the head 14 of the apparatus 10.

Three preferred embodiments of the removably attachable utility tool 70 will herein be described, in no way limiting the scope of the removably attachable utility tool as aforedescribed.

First Embodiment of the Utility Tool

There is shown in FIGS. 15-21 inclusive a first preferred embodiment of the removably attachable utility tool, wherein the base 72 of the utility tool 70 is a rigid, or substantially rigid, spine 72', the cleaning element 18 received and constrained by the spine 72' and extending therefrom, the spine 72' having at least one of curved side portions; curvable side portions, so that the cleaning element 18 significantly radially extends from the side portions of the spine 72', thus creating a fan-shaped effect for upward and radial cleaning for the utility tool 70. While described herein as a utility tool embodiment, the rigid spine and cleaning element may be employed as removably attachable cleaning element as previously described.

Figure 15:
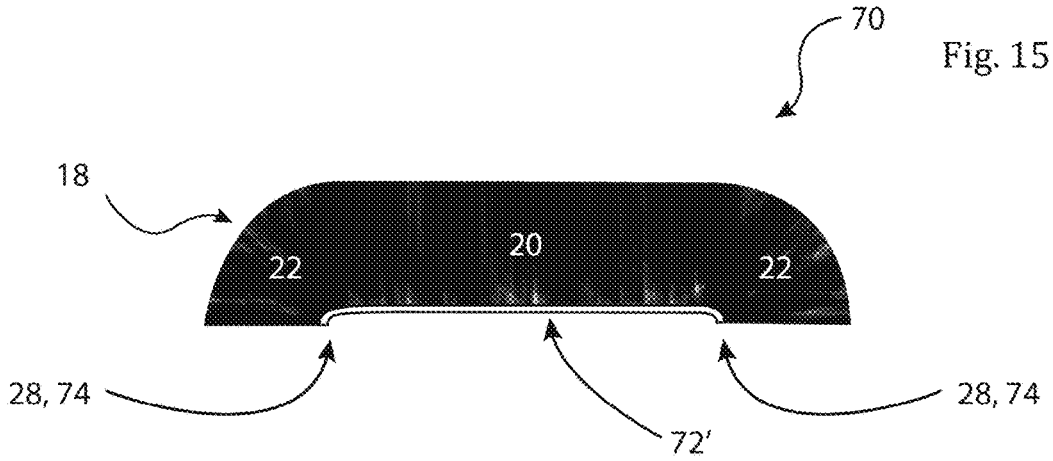
FIG. 15 is a front on view of a first preferred embodiment of a removably attachable utility tool wherein the base of the utility tool is a rigid, or substantially rigid, spine, the cleaning element received and constrained by the spine.

Referring to FIG. 15, there is shown the utility tool 70, which comprises the cleaning element 18, and a spine 72'. The spine 72' includes curved side portions 74 at its lateral ends 28, which are not resiliently flexible and are therefore rigid, or substantially rigid. The spine 72' may be absolutely rigid, or may be curvable so that it can be curved into a rigid shape. Thus the spine 72' has at least one of curved side portions; curvable side portions.

Preferably the cleaning element 18 comprises bristles, which have dramatically resiliently flexible properties, which may be beneficial for cleaning. It will be well known to those with skill in the art that a feasible way of holding and projecting the bristles and/or cleaning element from the spine 72' is via trapping the bristles in the spine 72'. The bristles may be double-folded and trapped into the spine 72' via a trapping element, which may, for example, be a wire. Thus, in a preferred embodiment, the bristles are trapped in the spine 72' and project outwardly, the cleaning element 18 having a substantially upstanding central portion 20 for upward cleaning and radially outwardly projecting side portions 22 projecting from the curved side portions 74 of the spine 72' for radial cleaning.

Figure 16:
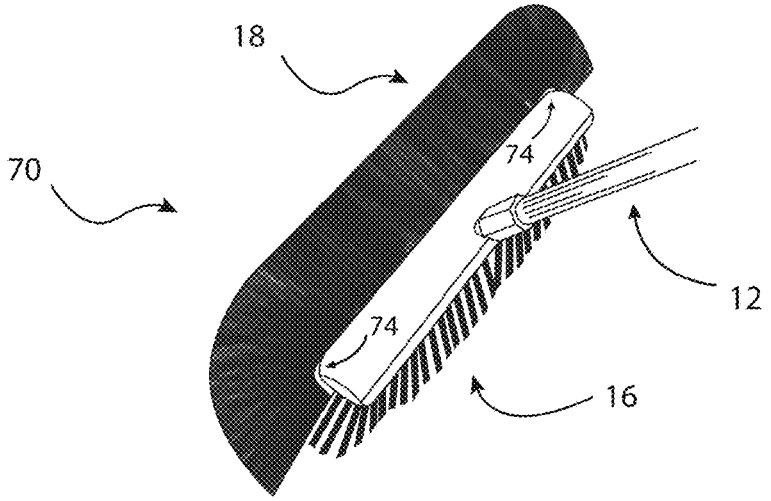
FIG. 16 is a perspective view of the spine, and thus the cleaning element, attached to a broom head.

As will be shown, the base 72 of the utility tool 70 may have further comprising elements to aid gripping and attaching about the head 14 of the apparatus 10. However, the spine 72' itself may be directly attachable about the head 14 of the apparatus 10. In FIG. 16, the spine 72' is attached directly, which may be carried out, for example, via a carved groove, machined groove, and the like, which simply receives and holds the spine 72'. The spine 72' is shown attached in a forwardly angled manner so that the cleaning element 18 projects forwardly from the head 14 of the apparatus 10, which may be beneficial. The curved side portions 74 of the spine 72' can be seen protruding.

Figure 17:
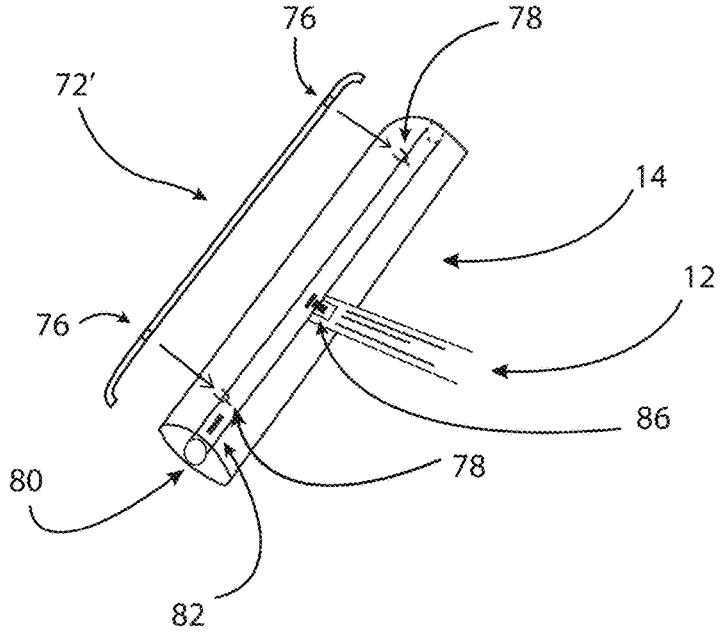
FIG. 17 shows a raised clipping attachment mechanism for the spine.

There is shown in FIG. 17 a raised clipping attachment mechanism, where the spine 72' is received via a clipping mechanism and thus removably attachable to the head 14. The spine 72' (which is shown without the cleaning element 18 for clarity) has clip receiving portions 76 (although the said clip receiving portions 76 do not necessarily require specific adaptation to be received by a clip), which can be clipped to at least one clip 78, which at least one clip 78 holds the spine 72', and thus the cleaning element 18, for upward and radial cleaning. There may be provided a rotator 80 and the like, so that the cleaning element 18 can be selectably angled and/or moved when attached to the head 14. It may be desirable for the cleaning element 18 to be selectably movable, for example, forward and back, when attached, so that it can intuitively be moved by a user to access areas for cleaning without a requirement to manipulate the head 14 of the apparatus 10. This may be achieved manually by a user (by direct manipulation of the cleaning element 18), or there may preferably be provided a movement selecting element 82 that can be selected and/or moved by the user, thus manipulating angulation and/or movement of the cleaning element. In FIG. 17, movement selecting element 82 is located on the head 14 of the apparatus 10, which may be a switch and the like, so that angulation of the cleaning element 18 can be manipulated by selection of the movement selecting element 82 on the head 14 by a user. However, it may be beneficial for a user, as will be shown, if the movement selecting element 82 is located on the handle 12 of the apparatus 10. Thus there is also shown a plausible comprising element 86 of a second plausible movement selecting system 89 for moving the cleaning element 18, which will be shown in greater detail in FIG. 19. Any system and/or combination of features whereby the cleaning element 18, or a portion of the cleaning element 18, is movable via selecting of any movement selecting element 82 by a user, is said to be a movement selecting system 89 for moving the cleaning element 18.

Figure 18:
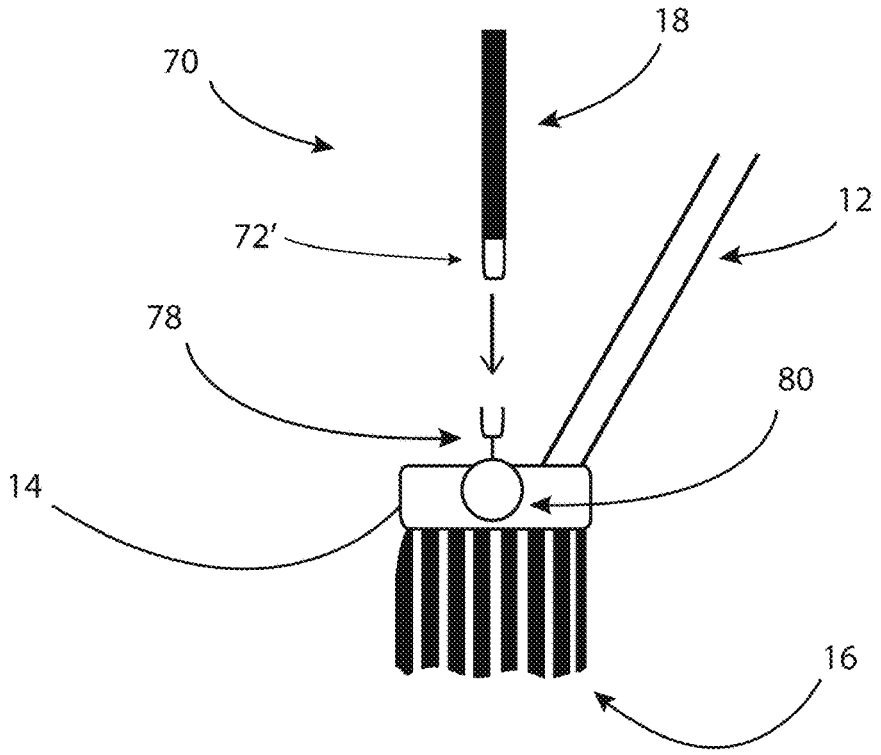
FIG. 18 is a side on view of the clipping attachment mechanism wherein a clip is located on a rotator so that angulation of the utility tool and the cleaning element can be selectably altered by a user.

There is shown in FIG. 18 the clipping attachment mechanism, which is just one example of an attachment mechanism for the first preferred embodiment of the utility tool 70, in no way limiting a scope of the invention, where the spine 72' of the utility tool 70 is shown and the at least one clip 78 which receives the spine 72'. The clip 78 is located on the rotator 80, which may be circular, but is not limited to being circular, so that angulation of the clip 78, and thus the utility tool 70 and cleaning element 18, can be selectably altered by a user. A rotator 80 is just one example of a method of moving the cleaning element 18 and a movement selecting system 89 for moving the cleaning element 18 is not limited to use of such a rotator element. It will be obvious to those with skill in the art that there are a vast array of methods and/or embodiments for a movement selecting system 89 for the cleaning element 18, the here examples being shown by example only, in no way limiting the scope of a movement selecting system. A movement selecting system 89 may be as simple as a rotator 80, and the like, alone, whereby the rotator is movable by direct manipulation, for example, via a foot of a user, in which case, it may be said that the rotator 80, and the like, is also the movement selecting element 82.

Figure 19:
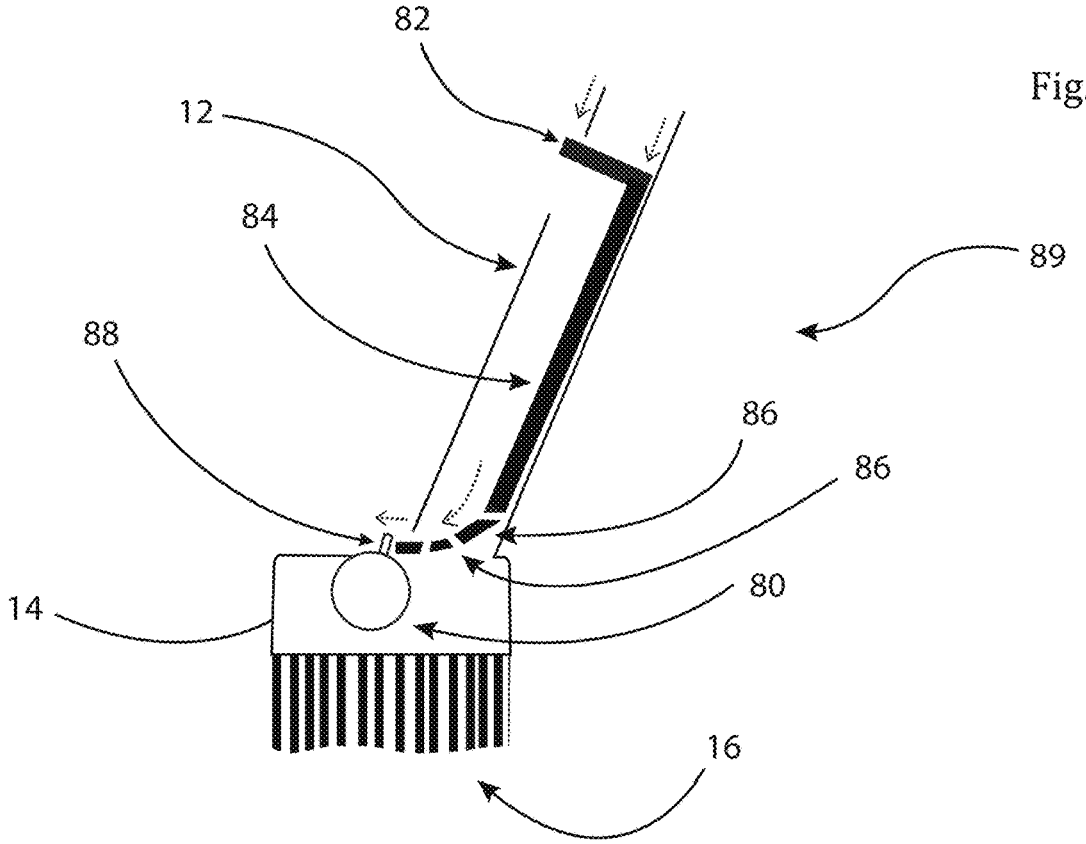
FIG. 19 is a side on view of a cleaning element movement selecting system for movement of the cleaning element by a user.

There is shown in FIG. 19 a cleaning element movement selecting system 89 where the movement selecting element 82 is on the handle 12 of the apparatus 10. (The handle 12 is shown abbreviated to better display the movement selecting system 89). The movement selecting element 82, which may be a switch, may be downwardly pressed and/or moved by a user, which in turn moves an internal elongate member 84 which runs from the movement selecting element 82 down to the rotator 80. There may be provided direction altering members 86 (which need not be plural) which alter directional impetus of the internal elongate member 84 culminating in engagement with a rotator knob 88, which is attached, or an integral part of, the rotator 80. Dashed arrows denote directional impetus when the movement selecting element 82 is pressed and/or moved by a user. Thus when the rotator knob 88 is engaged and pushed forward via use of the movement selecting element 82 by a user, the rotator 80 itself is rotated, and thus the utility tool 70 and cleaning element 18 is moved by the user. The rotator 80 may be spring loaded so that it returns to an original position when the movement selecting element 82 returns, or is returned, to an original position. Similarly, the movement selecting element 82 may be spring loaded. Thus an intuitive system for moving the cleaning element 18 is provided for the user. Thus the cleaning element 18 may be angulated forwardly and backwardly by a user via use of the movement selecting element 82. The example provided is provided by way of example only.

Figure 20:
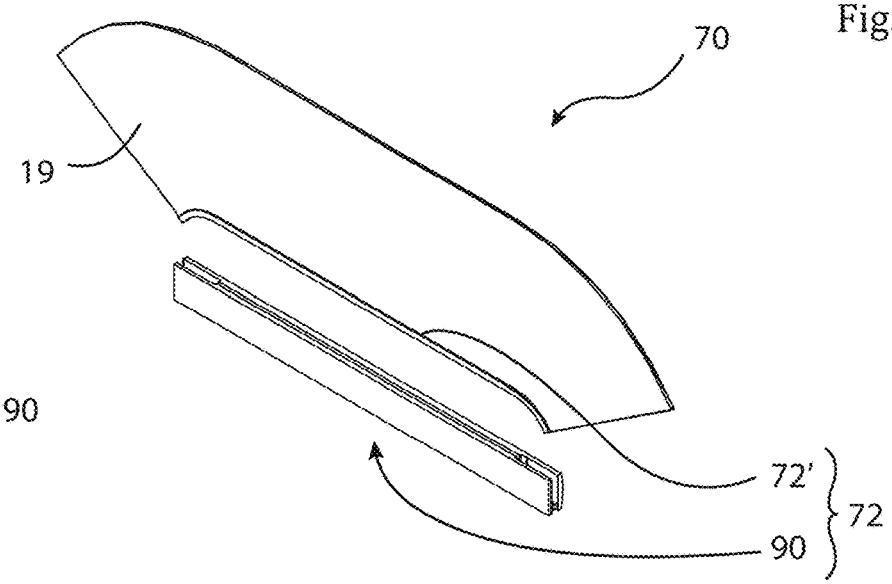
FIG. 20 is an exploded isometric view of the first preferred embodiment of the removably attachable utility tool wherein the base further comprises a brush clip for receiving and constraining the spine.

In such an example embodiment, the utility tool 70 may not be an ideal shape for holding by a user as a separate handheld cleaning tool, or for attaching to the apparatus 10. Thus, as shown in FIG. 20, the base 72 of the utility tool may further comprise a brush clip 90 for receiving and constraining the spine 72', which may be beneficial for holding by the user.

Figure 21:
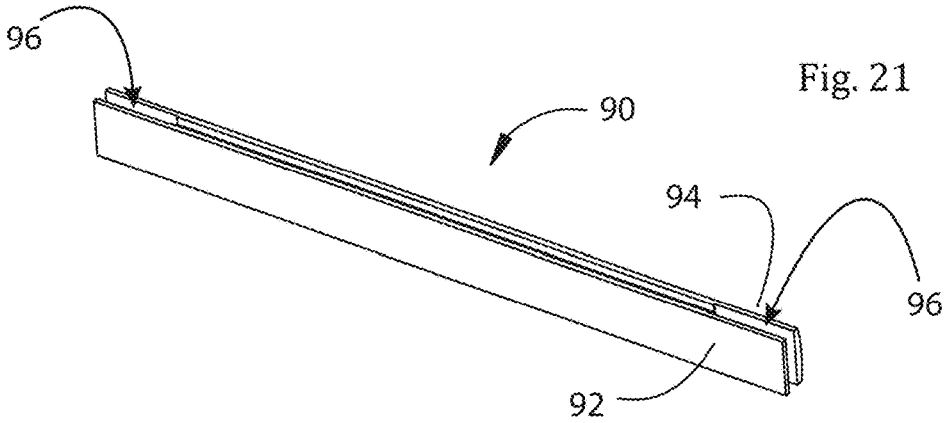
FIG. 21 is a perspective view of the brush clip.
Figure 22:
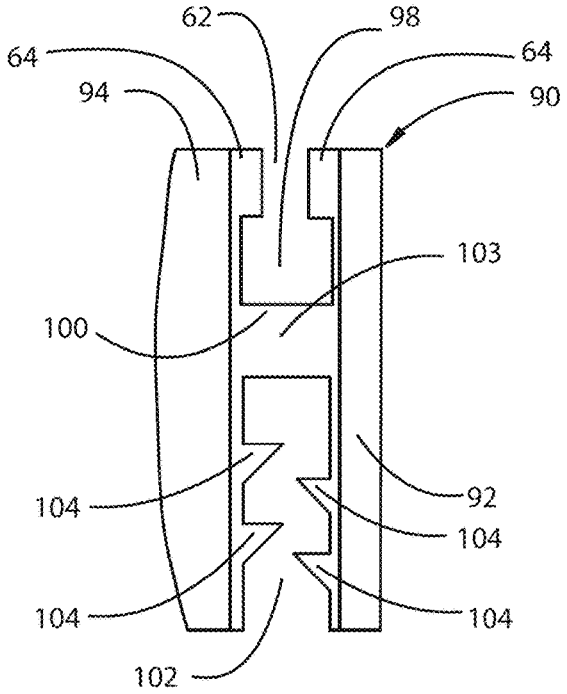
FIG. 22 is a side section view of the brush clip.

For the example embodiment of the brush clip 90 as shown in FIG. 21, the brush clip 90 is a molded or extruded plastic and/or synthetic material element, having a front wall 92 and a rear wall 94, which is preferably joined by an upper channel base 100 as best seen in FIG. 22. In alternative embodiments an aluminum extrusion may be employed. Preferably there are provided relieved portions 96 at the lateral ends of the brush clip 90, relieved for receiving the curved side portions 74 of the spine 72'. The relieved portions 96 may secure the curved side portions 74 or may simply be vacuous, with the spine 72' securely held centrally via an upper channel 98, as best shown in FIG. 22.

Referring to FIG. 22, there is shown the example embodiment of the brush clip 90 where an upper channel 98 is formed by the front wall 92, the rear wall 94, and an upper channel base 100, which has an upward aperture 62 through which the brush element 19 extends, and preferably has two protruding lips 64, which are preferably resiliently flexible, and may be of rubber-type material, so that they can resiliently flexibly open to receive the spine 72' of the utility tool 70, and resiliently flexibly return to an enclosed position, thus enclosing the spine 72' of the utility tool 70 in the upper channel 98, the brush element 19 extending out of the upward aperture 62. It is feasible that one or both of the rear wall 94 and the front wall 92 are themselves resiliently flexible, which may aid insertion of the spine 72' into the upper channel 98. Thus, preferably, at least one of the front wall 92, the rear wall 94, and a protruding lip 64, are resiliently flexible to receive the spine 72'.

Figure 23:
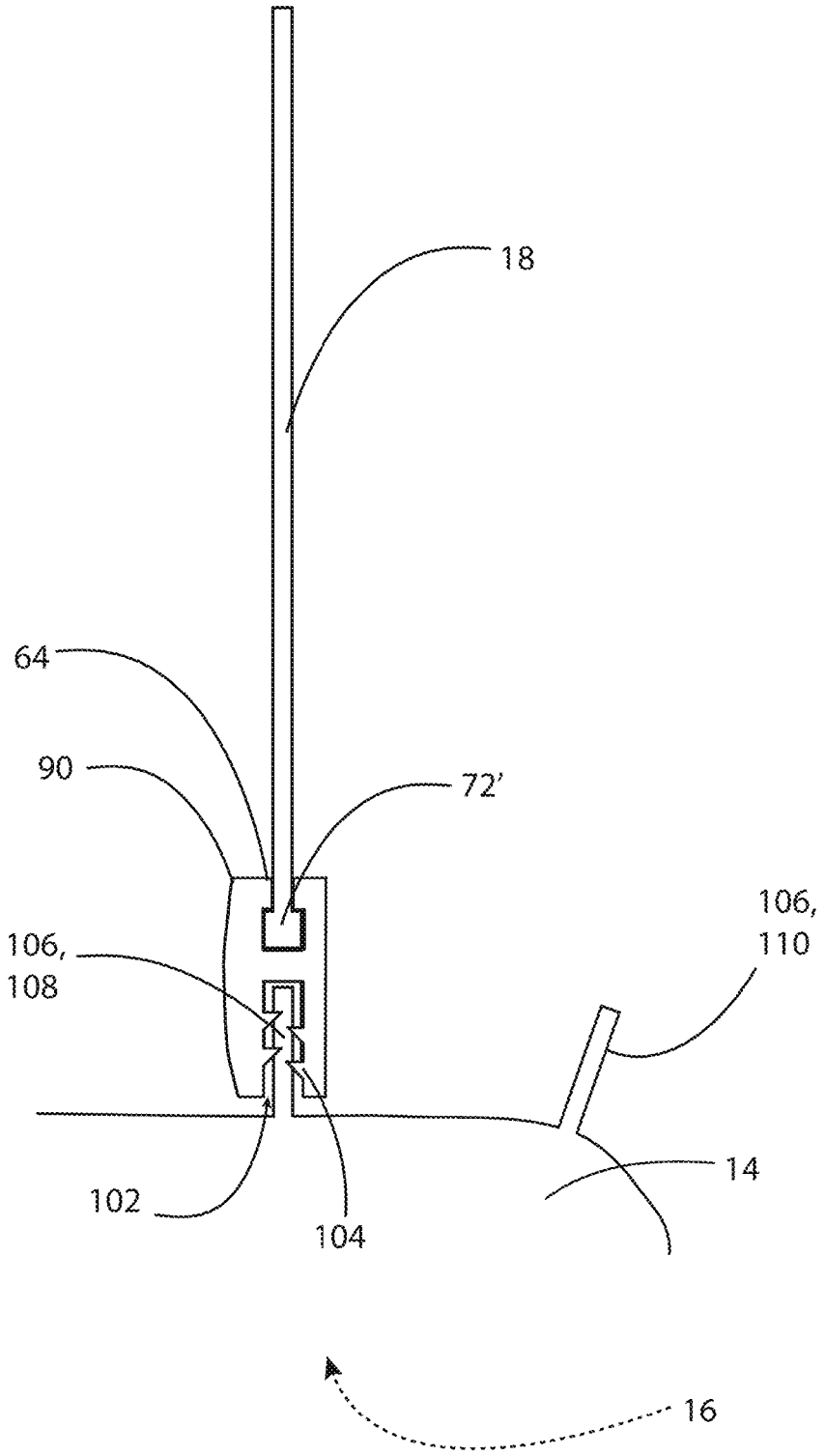
FIG. 23 shows the utility tool attached to a head of the cleaning apparatus via an attachment flange.

As will be shown, all embodiments of bases 72 for the utility tool 70 may include a bottom aperture 102 for attaching. Thus in one preferred embodiment of an attaching mechanism for the tool 70, as shown in FIG. 22, there is provided a bottom aperture 102 for attaching, which may have teeth 104. The bottom aperture 102 may be provided for attaching the base 72 of the tool 70 directly to the head 14 of the apparatus 10, in which case the head 14 may have at least one attachment flange 106 that protrudes from the head 14 for attaching into the bottom aperture 102, as shown in FIG. 23. Thus a web 103 is formed between the upper channel 98 and the bottom aperture 102.

In FIG. 23, the attachment flange 106 is an upright flange 108, although the head 14 of the apparatus 10 may have a plurality of attachment flanges 106, including an angled flange 110 as shown for alternate fixing and angulation of the utility tool. As shown, such flanges 106 may be molded directly into the head 14 of the apparatus 10. As will also be shown, they may be provided by means of a separately formed bracket. Preferably the bottom aperture 102, the or each attachment flange 106, or both, have teeth 104, thus further securing the utility tool 70 to the head 14 of the apparatus 10. Teeth 104 are just one example of a fastening mechanism and there are many other plausible embodiments of a fastening mechanism and/or means, which will be obvious to those with skill in the art.

Thus it can be said, for such an example embodiment, that the attachment mechanism for the apparatus 10 comprises the at least one attachment flange 106 on the head 14 of the apparatus, and the bottom aperture 102 on the utility tool 70, which could be said to be a male-female attachment mechanism—the male attachment part being the attachment flange 106 on the head 14 of the apparatus 10, the female attachment part being the bottom aperture 102 on the utility tool 70. However, the attachment mechanism may equally be a female-male attachment mechanism, where there is provided an upward aperture, channel, or the like on the head of the apparatus, and a flange, barb and the like on the bottom of the base 72 of the utility tool 70.

Second Embodiment of the Utility Tool

Figure 24:
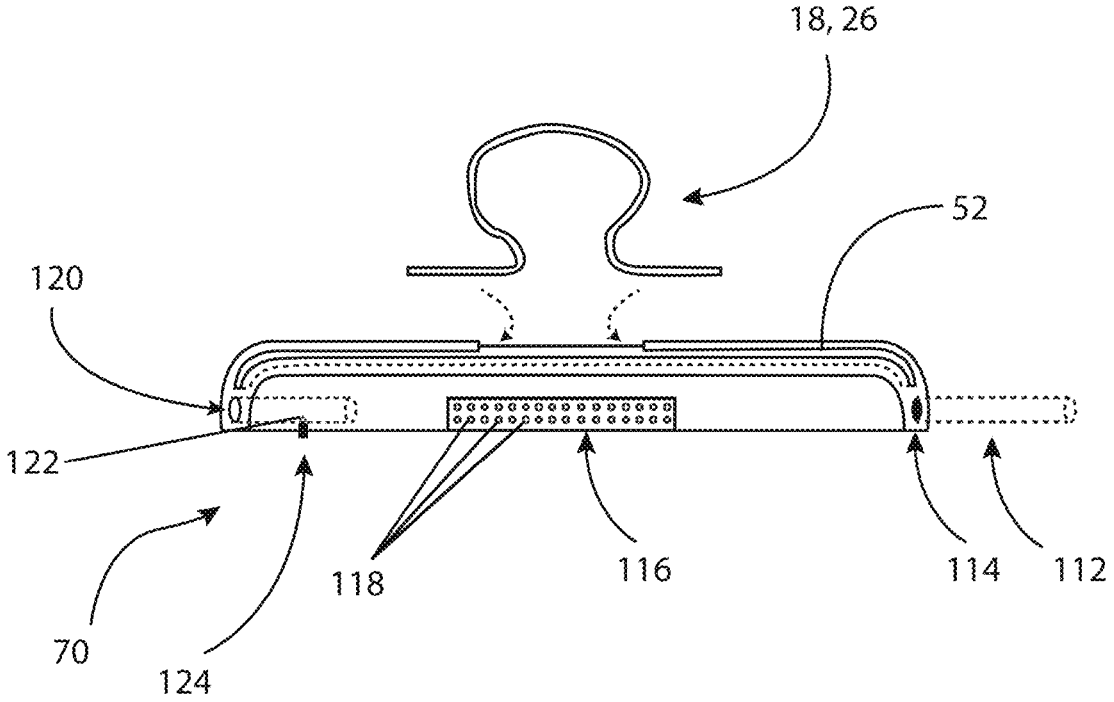
FIG. 24 is a perspective view of a second preferred embodiment of the removably attachable utility tool wherein the cleaning element comprises a flexible spine and brush element extending therefrom, and there is provided a receiving channel on the base of the utility tool for receiving the spine.
Figure 25:
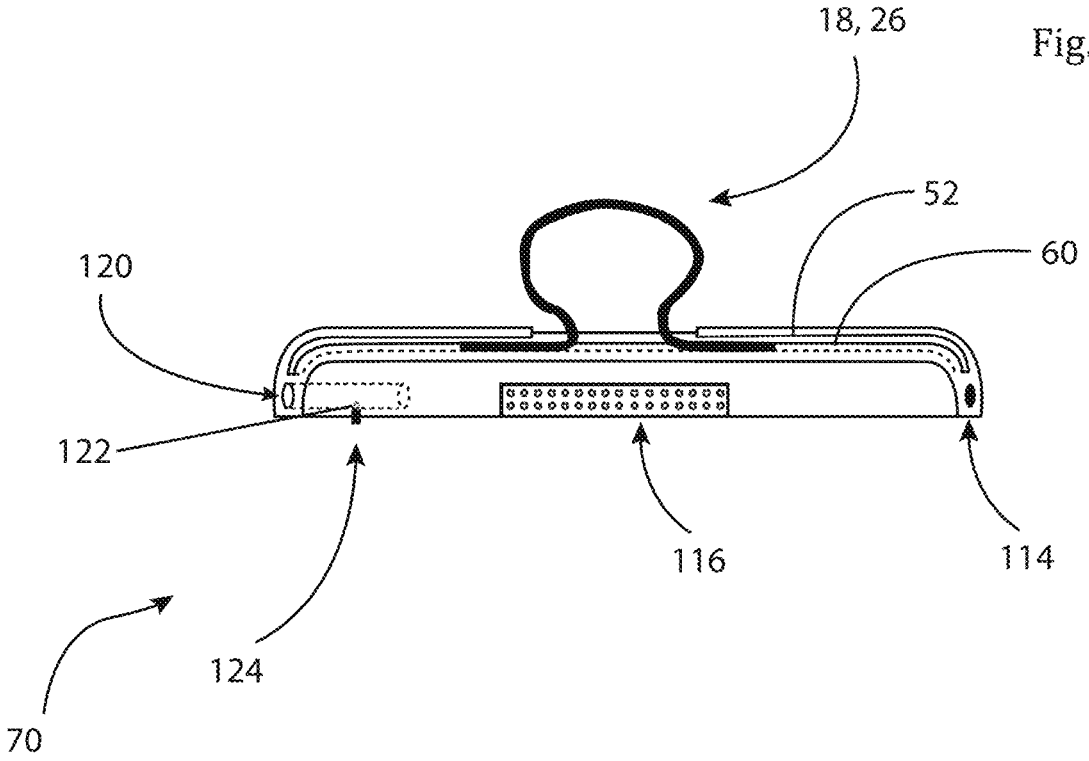
FIG. 25 shows the flexible spine urged into the receiving channel.
Figure 26:
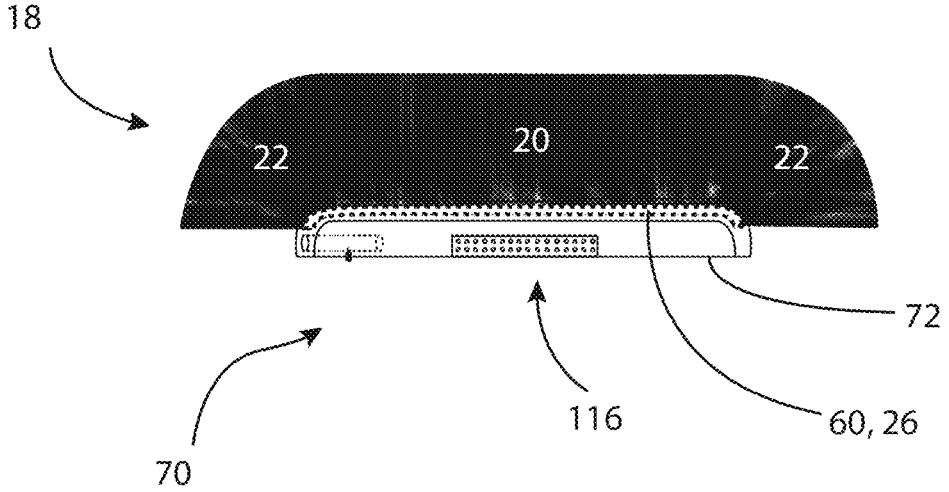
FIG. 26 shows the flexible spine of the cleaning element received and constrained within the receiving channel.

With respect to a second preferred embodiment of the utility tool, as shown in FIG. 24, FIG. 25 and FIG. 26, there is shown a removably attachable utility tool 70 for the apparatus 10, wherein, similarly to an embodiment of the cleaning element 18 for removably attaching about the head 14 of the apparatus 10 via a hold and curve system, the cleaning element 18 comprises a flexible spine 26 and a brush element 19 extending therefrom. There is provided the identical hold and curve system as predefined with reference to a removably attachable cleaning element 18 for directly attaching about the head 14 of the apparatus 10, wherein the hold and curve system, previously defined as being provided about the head 14 of the apparatus 10, is now defined as being provided on the base 72 of the utility tool 70, the hold and curve system thus configured to hold down the flexible spine 26 of the cleaning element 18 and downwardly curve its lateral ends 28, the tool 70, and thus the apparatus 10, thus configured for upward and radial cleaning.

FIG. 24 and FIG. 25 show an identical insertion procedure for the flexibly spined cleaning element 18 as shown in FIG. 13 and FIG. 14 for insertion of the flexibly spined cleaning element 18 into the head 14 of the apparatus 10. Whereas the hold and curve system was previously shown for insertion of the cleaning element 18 into the apparatus 10, it is now shown for insertion into and/or attaching onto the utility tool 70. Preferably the hold and curve system, as aforementioned, is a receiving channel 52. Thus the identical procedure with reference to insertion of the flexibly spine cleaning element 18 is shown in FIG. 24 and FIG. 25, the receiving channel 52, which is a preferred embodiment of the hold and curve system, having downwardly curved side portions 32 for downwardly curving the lateral ends 28 of the flexible spine 26, and a constraining element, which is preferably at least one protruding lips 62, the brush element 19 extending out from the upward aperture 62 of the receiving channel 52.

Thus it can be seen that the upstanding central portion 20 and radially outwardly projecting side portions 22 of the cleaning element 18 are provided via the hold and curve system on the utility tool 70. The utility tool 70 is removably attachable to the apparatus 10 via any attachment means and/or method under the Sun, which will shortly be shown, thus facilitating upward and radial cleaning for the apparatus 10, whilst also being independently and separately usable as an independent cleaning tool by a user.

The utility tool 70 is shown in FIG. 26 with the flexibly spined cleaning element 18 received and constrained within the receiving portion 60 of the receiving channel 52, clearly usable independently as a handheld cleaning tool, and removably attachable to the apparatus 10, as will be shown. The receiving channel 52 is not limited to having a slim upward aperture for extension of a slim cleaning element. The cleaning element 18, and the upward aperture 62, may be significantly broader to allow for a thicker cleaning element.

There is shown in FIGS. 24 to 26 inclusive several preferable and/or optional features for the utility tool 70, which are not limited only to the second preferred embodiment as shown, and may be provided for any embodiment of the removably attachable utility tool 70. Such features include a retractable handle 112 for the utility tool 70, which may be retractable within the base 72 of the utility tool 70 and preferably is accessible by the user via depressing of a depressible button 114 that spring loads the retractable handle, releasing a holding mechanism, and thus extends the retractable handle 112 from the housing via a spring loaded system. Such a retractable handle 112 feature is not limiting to a spring loaded system and/or a depressible button 114 feature, which is provided by way of example only. Such systems are common place and will be obvious to those with skill in the art. Similarly the retractable handle 112 can then be re-housed into the base 72 by the user, preferably via pushing the retractable handle 112 back into the base, which preferably re-asserts the holding mechanism for holding the retractable handle 112. The retractable handle 112 may aid comfortable and effective holding of the utility tool 70 when used by a user as an independent handheld cleaning tool.

There may be provided a grip 116 for the base, said grip 116 configured specifically for gripping by a user, the grip comprising at least one of: a surface for added grip, a shaped surface, shaped specifically to aid handling by a user, and at least one recessed portion, configured to fit a hand of a user for added grip.

In FIG. 24, the grip 116 is shown with pips and projections 118 that aid gripping. It thus has a surface for added grip. The grip 116 may be of different materials than the base 72 of the utility tool 70. It is feasible the grip 116 may have recessed portions shaped to aid grip for a hand of a user, such as at least one recess shaped for receiving fingers of a user for gripping. Such shaping is commonplace for handgrips in a plurality of arts which seek added comfort for a user.

There may be provided a cavity 120 for insertion of a secondary handle into the base 70. It will be obvious that, in an embodiment of the invention 10 where there is provided a removably attachable utility tool 70, if a secondary handle is provided for attaching to the utility tool 70 (an example embodiment of the secondary handle 176 best shown in FIG. 40) the utility tool 70 could feasibly independently be used to access hard to reach areas, such as ceilings, ceiling corners, and the like, thus further increasing a cleaning capacity of the apparatus 10. Thus, in an example embodiment of an attachment method for attaching the secondary handle 176 to the base 72, there may be provided a cavity 120 for receiving the secondary handle 176, with a holding mechanism, which in the present example, includes a protruding pip 122 that protrudes into the cavity 120 and a button 124 which, when pressed, recedes the pip 122, thus releasing the secondary handle 176. Thus the secondary handle 176, if it is configured with a pip receiving cavity and/or channel on the handle to match and receive the protruding pip 122, may be inserted into the cavity 120, depressing the protruding pip 122 on entry, the pip 122 then re-protruding when the pip receiving cavity and/or channel on the handle is aligned with the pip 122, thus holding and constraining the secondary handle 176. The example of an attachment method and/or mechanism for attaching the secondary handle 176 is given by way of example only.

More basic attachment mechanisms for the optional feature of the secondary handle 176 may be provided, such as a clip, etc., the present example being provided by way of example only. Thus the utility tool 70 may, on the one hand, have multiple attachment points, either for attaching the tool 70 to multiple items, (such as the head 14 of the apparatus 10 as well as the secondary handle), or for attaching the utility tool at multiple angles, or, on the other hand, may have an attachment point configured for attaching to multiple surfaces, such as an aperture configured for attaching the utility tool 70 to the head 14 of the apparatus 10, and also configured for attaching the utility tool 70 to the secondary handle 176.

Such preferable and/or optional features are not limited to the second preferred embodiment of the utility tool 70 and may be provided on any embodiment of a removably attachable utility tool 70 for the invention 10. Similarly to an embodiment of the invention 10 where the upward and radial cleaning element 18 is removably attachable about the head 14 of the apparatus 10, there not being provided a removably attachable utility tool 70, it is feasible that the apparatus 10 may be provided without the removably attachable cleaning element 18, for application to the utility tool 70 at a later date.

Third Embodiment of the Utility Tool

Figure 27:
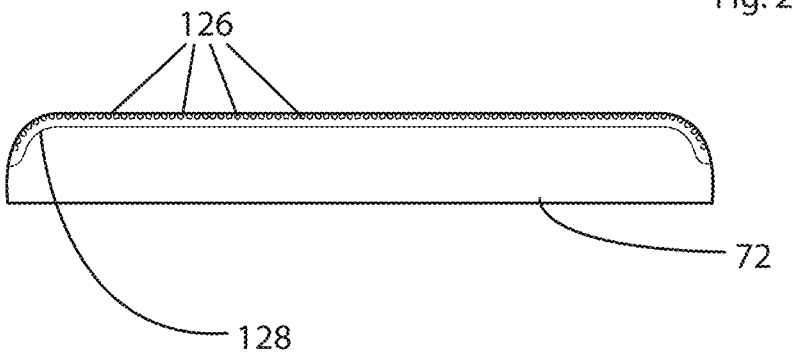
FIG. 27 is a front on view of a third preferred embodiment of the removably attachable utility tool, wherein there are provided a plurality of cavities on the base of the tool, the cleaning element comprising bristles embedded into said cavities.
Figure 28:
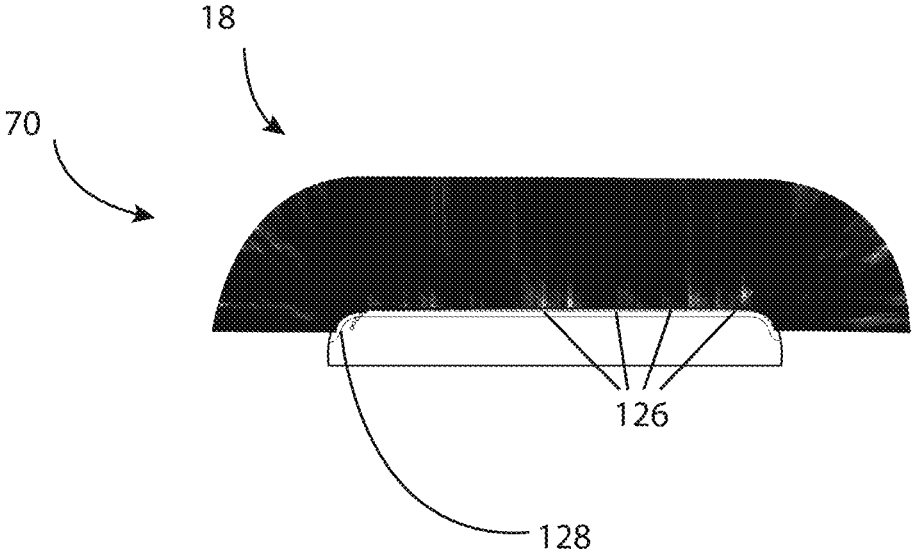
FIG. 28 shows the embedded bristles creating a fan shaped effect for upward and radial cleaning.

There is shown in FIG. 27 a third preferred embodiment of the removably attachable utility tool 70 wherein there are provided a plurality of cavities 126. The cavities 126 are configured so that bristles may be embedded into said cavities 126, thus forming the cleaning element 18, said cavities 126 configured for substantially upright outward projection of the bristles from a central portion of the base, and radially angled outward projection of the bristles at the side portions of the base, thus creating a fan shaped effect for upward and radial cleaning as shown in FIG. 28. The bristles may be trapped in the cavities 126 by a trapping element, such as a metal shard for securing the bristles within the base 72.

There may be provided a rubberized base 128, or the like, or a more flexible base material 128 for embedding the bristles into, which may aid manufacturing.

It is feasible that the cavities 126 radiate in a plurality of directions, the bristles (and thus the cleaning element 18) thus extending in a plurality of directions not limited to upward and radially when embedded in the cavities 126, the cleaning element 18 thus feasibly being spheroidal or any other shape. The brush element 19 may thus extend in a plurality of directions, which feasibly may be beneficial for cleaning and engaging a multitude of surfaces.

Thus it can be seen that a similarly upstanding and radially outwardly projecting cleaning element 18 can be provided by way of embedded bristles into cavities 126 about the base 72. This may be beneficial for particular bristle types and/or effects. Each of the three preferred embodiments for the utility tool 70, which utilize different methods for projecting the brush element 19 and thus for creating the upstanding central portion 20 and radially outwardly projection side portions 22 of the cleaning element 18 may have particular benefits. For example, preferred embodiment two, characterized by a flexibly spine cleaning element 18, has the unique property whereby both the cleaning element 18, and the utility tool 70 itself, are removably attachable. This may have significant benefits for replacing the cleaning element in an easy and affordable fashion, without a need for replacing the base 72, or a portion of the base 72, of the utility tool, (which may also be more cost effective and save materials).

It will be obvious to those with skill in the art of manufacturing objects with polypropylene, santoprene, and the like, that unusual and unorthodox shapes can be manufactured integrally as one part that would otherwise require separate construction and/or molding. Thus it is feasible the brush element 19 (which may preferably comprise bristles) and base 72 of the utility tool 72 may be integrally formed as one piece, the tool having bristles and a base 72 of the same synthetic material. In such an embodiment, the utility tool 70 may closely resemble the first preferred embodiment of the utility tool in appearance, but need not have a rigid, or substantially rigid, spine 72', the bristles simply projecting from the base 72, formed as one integral part with the base 72, the cleaning element 18 having a substantially upstanding central portion 20 for upward cleaning; and radially outwardly projecting side portions 22.

In a case as shown in FIG. 4, where the cleaning element is multi-partheid, a removably attachable utility tool 70' may solely incorporate the substantially upstanding central portion 20 of the cleaning element 18, and may, as shown in FIG. 29, similarly be removably attachable, so that the radially outwardly projecting portions 22 of the cleaning element 18 for the apparatus 10 are retained on the apparatus 10 as whiskers 23, whilst the utility tool 70' is removably attachable and thus usable independently as a separate handheld cleaning tool by a user.

The utility tool 70', in such a configuration, is thus specifically configured for attaching to a cleaning apparatus as a comprising part of the upward and radial cleaning element 18 which comprises a substantially upstanding central portion 20 for upward cleaning and radially outwardly projecting side portions 22 for radial cleaning, wherein the utility tool 70' cleaning element comprises at least the central portion 20 of the upward and radial cleaning element 18 of the apparatus 10, the apparatus 10 having whiskers 23 as radially outwardly projecting side portions 22.

If particularly fine bristles are used for the brush element 19, such as horse hair and the like, it may be desirable and/or necessary to have a stabilizing member 130 for the lower portion of the cleaning element 18. Thus there is shown in FIG. 30 a wand head 14 for a canister type vacuum floor cleaning apparatus wherein the cleaning element 18, which has a substantially upstanding central portion 20 for upward cleaning and radially outwardly projecting side portions 22 for radial cleaning, has a stabilizing member 130 about a lower portion of the cleaning element 18, which stabilizing member 130 may be a sponge type material and the like, with dramatic resiliently flexible properties. The stabilizing member 130 has at least one stabilizing cavities 132 through which bristles, hairs, etc. of the cleaning element 18 are embedded. The purpose of the stabilizing member 130 is to facilitate use of finer bristles which are not resilient enough to stand to, for example, a height of 3 inches or more without losing shape and form, or which may not be dramatically resilient enough to retain their said shape and form, which may affect cleaning ability of the cleaning element 18. Such bristles, fine hairs, and the like (which may be any brush element) may have exceptional and/or superior cleaning ability, but, as mentioned, may lack requisite qualities for an effective upward and radial cleaning element 18 if standalone. Thus, embedded in and/or through a stabilizing member 130, the sais bristles, hairs etc. are stabilized, thus retaining their shape and form.

Such an embodiment of the cleaning element 18 may be utilized either embedded directly to the head 14 of the apparatus 10 as shown in FIG. 30, or may equally be utilized for the removably attachable cleaning element 18, or, in fact, for the cleaning element 18 of the removably attachable utility tool 70. The bristles may thus be embedded into the head 14 of the apparatus 10 or into the utility tool 70 through the at least one stabilizing cavities 132 of the stabilizing member 130, facilitating use of fine hair type bristles which would otherwise not have enough resilience to reliably form a substantially upstanding central portion 20 for upward cleaning and radially outwardly projecting side portions 22 for radial cleaning.

As aforementioned, the bristles, hair and the like may be embedded through the stabilizing member 130 fully, and thus embedded into the apparatus 10 is a non-removable embodiment, or embedded into the utility tool base 72 and thus be removably attachable from the apparatus. It is also feasible that the bristles, hair, and the like which is embedded into the stabilizing member, is held in the stabilizing member 130, not penetrating through to the apparatus 10, or utility tool base 72, in which case, typically a trapping mechanism is needed in the stabilizing member 130 to trap the bristles, hair, and the like so that it is steadfastedly trapped for cleaning.

Preferably the stabilizing member 130 is sponge like in property, so that it continues to provide and enhance resilient flexibility for the cleaning element 18. The stabilizing member can be said to be part of the cleaning element 18, and may have cleaning properties itself in an embodiment where it contacts and engages a surface. However, in a substantially spheroidal embodiment of the cleaning element 18, it may be substantially, or fully, hidden by the brush bristles, hair and the like, which it is a stabilizing member 130 for.

If the stabilizing member 130 is a sponge or foam type material, it may itself brush and clean surfaces that are engaged. However, one primary function of the stabilizing member is to retain and enhance resilient flexibility for the cleaning element 18. It is feasible there is just one linear stabilizing cavity 132 that runs along a length of the stabilizing member 130 through which bristles are embedded.

Figure 31:
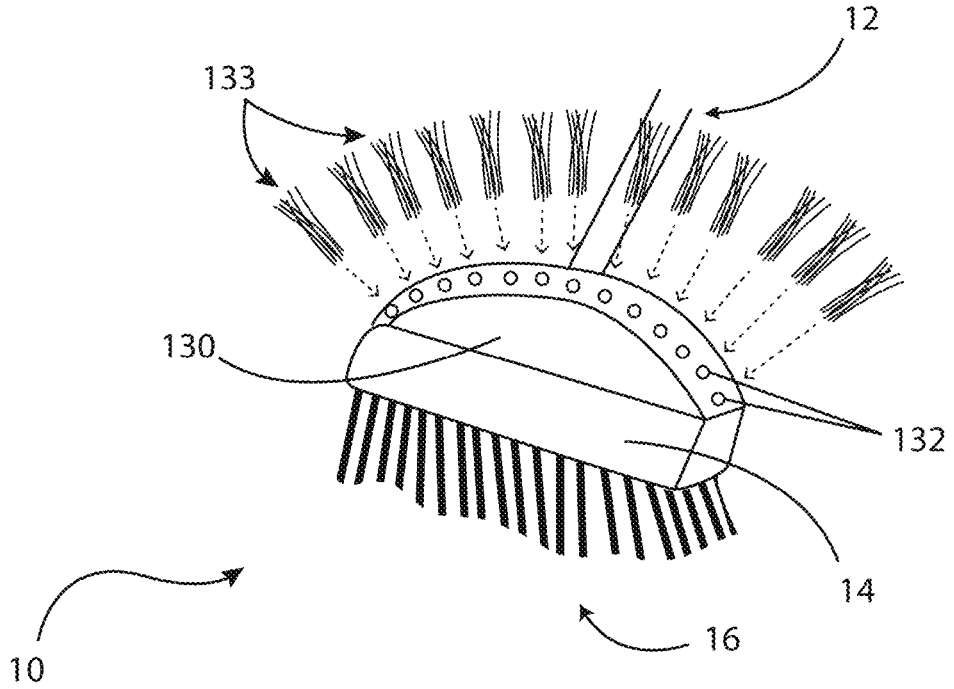
FIG. 31 is an exploded view of the cleaning element featuring the stabilizing member.

There is shown in FIG. 31 an exploded view of a basic example embodiment of the stabilizing member 130 and fine bristles 133 embedded therein, when used with a broom, (although such a configuration employing a stabilizing member 130 may be more suited for use with, for example, a wand head 14 for a canister type vacuum cleaner). The stabilizing member 130 is here shown in a crescent-like shape and has a plurality of stabilizing cavities 132 for receiving the fine bristles 133, although it may feasibly have only one stabilizing cavity which runs along a length of the member. The fine bristles 133 are shown in clumps, with arrows denoting their entry into the stabilizing cavities 132, the fine bristles 133 thus embedded into the stabilizing member. The stabilizing member 130 may be tailored in shape to form a more viably and effectively shaped upward and radial cleaning element 18, and, as aforementioned, may itself have cleaning properties and/or modifications.

As aforementioned, fine bristles 133, such as horsehair, may have superior cleaning properties for cleaning dust, but may have inferior resiliency qualities for being flexibly resilient. The stabilizing member 130 thus donates the fine bristles 133 resiliency and prevents drooping, loss of shape and form, etc.

In the embodiment as show in FIG. 31, it is feasible the fine bristles 133 are embedded through the stabilizing cavities 133 and directly into the head 14 of the apparatus 10. If they are used with a removably attachable utility tool 70, it is feasible they are similarly embedded through the stabilizing cavities 132 into the base 72 of the utility tool 70. It is also feasible that they do not extend fully through the stabilizing member 130 and are, thus, embedded securely into the stabilizing member 130 itself, in which case there may be provided ringlets and the like at a pit of each stabilizing cavity 133 (or any other fixing mechanism) so that clumps of fine bristles 133 can be securely embedded into the cavities 132. It is also feasible the stabilizing member 130 has a base plate, which may be a base not intended for utilizing as a grip, or that the stabilizing member itself acts as a base and/or spine for the cleaning element 18.

The utility tool 70, may be provided separately for attachment to a cleaning apparatus 10 previously configured to receive the tool 70.

In various embodiments of the utility tool 70, base 72 of the utility tool 70 may be molded plastic, or extruded plastic. It may also, in various embodiments, be extruded metal, such as aluminum and the like.

Attachment Mechanism

The present invention may utilize any method and/or means for attaching the utility tool 70 removably about the head 14 of the apparatus 10. The attachment mechanism, which is a generic term for any attachment method and/or means under the Sun, may be as simple as a placement mechanism, where the utility tool 70 is placed on the head 14 of the apparatus 10, the head 14 of the apparatus and the base 72 of the utility tool 70 shaped in such a way that the utility tool 70, and thus the cleaning element 18, is securely placed for upward and radial cleaning.

If a utility tool 70 of any given shape is placed on a floor cleaning apparatus of any given shape, clearly it will fall. If it does not, the moment the floor cleaning apparatus is moved, or engages a surface, it will detach from the apparatus. Heavy engagement with a surface is not at all uncommon for floor cleaning apparatuses, thus an attachment method and/or means of some type is required.

As will be shown, preferred embodiments of an attachment mechanism are configured for effective attachment of the utility tool 70 about the apparatus 10 so that it is secure, and simultaneously is configured for easy and effective removal for use as a handheld cleaning tool.

Thus the term 'attachment mechanism', which is a generic term for any attachment method and/or means under the Sun for attaching the utility tool 70 to the apparatus, need not be particularly (or at all) 'technical', the present invention feasibly incorporating any method and/or means for attachment.

Various attachment mechanisms may be used, for example, a male-female attachment mechanism, the cleaning apparatus having a male attachment part configured for receiving by a female attachment part for attaching the utility tool 70; a female-male attachment mechanism, the cleaning apparatus having a female attachment part configured to receive a male attachment part for attaching the utility tool 70; an intermediate attachment mechanism, the utility tool 70 being attachable to the cleaning apparatus via the intermediate attachment mechanism; a mating system; a magnetic system featuring at least one magnet, or any other attachment mechanism, an attachment mechanism for the apparatus in no way limited to the above, which are provided by way of example only. In certain embodiments, combinations of the above example attachment mechanisms may be provided.

A male-female attachment mechanism may be utilized, where a male attachment part on the head 14 of the apparatus 10 is received by a female attachment part on the base of the utility tool 70, as shown, for example, in FIG. 23, the male attachment part being the attachment flange 106, the female attachment part being the bottom aperture 102 on the utility tool 70 that receives the attachment flange 106. A female-male attachment mechanism may be used where a male attachment part on the base 72 of the utility tool 70 is received by a female attachment part on the head of the apparatus.

An intermediate attachment mechanism may be used to removably attach the utility tool 70. An example of an intermediate attachment mechanism is an adhesive strip, since an adhesive strip is intermediate, in between the utility tool and the head of the apparatus. For example, an adhesive strip may be adhered to the head 14 of the apparatus 10 which has a slit. A second adhesive strip may be adhered to an underside of the base of the utility tool 70, which includes a male part to attach into the slit, which may run along the length of the strip. Such adhesive strips are well known to those with skill in the art. Thus such an attachment mechanism could be said to be both an intermediate attachment mechanism, (since the strip is intermediate between the head 14 of the apparatus and the utility tool 70), and also could be said to be a female-male attachment mechanism, (since a male part is received by a female part on the adhesive strip, and thus the apparatus). It is also feasible that the utility tool 70 is configured with a flange and the like that is removably attachably received by such an adhesive strip slit, without the need for a second adhesive strip on the utility tool 70.

Another feasible intermediate attachment mechanism is a mounting bracket. It goes in between the head 14 of the apparatus 10 and the utility tool 70 and is therefore said to be intermediate.

It is feasible velcro and the like is used. It is feasible the attachment mechanism includes magnetic features. Any attachment mechanism and/or method may be used.

Figure 32:
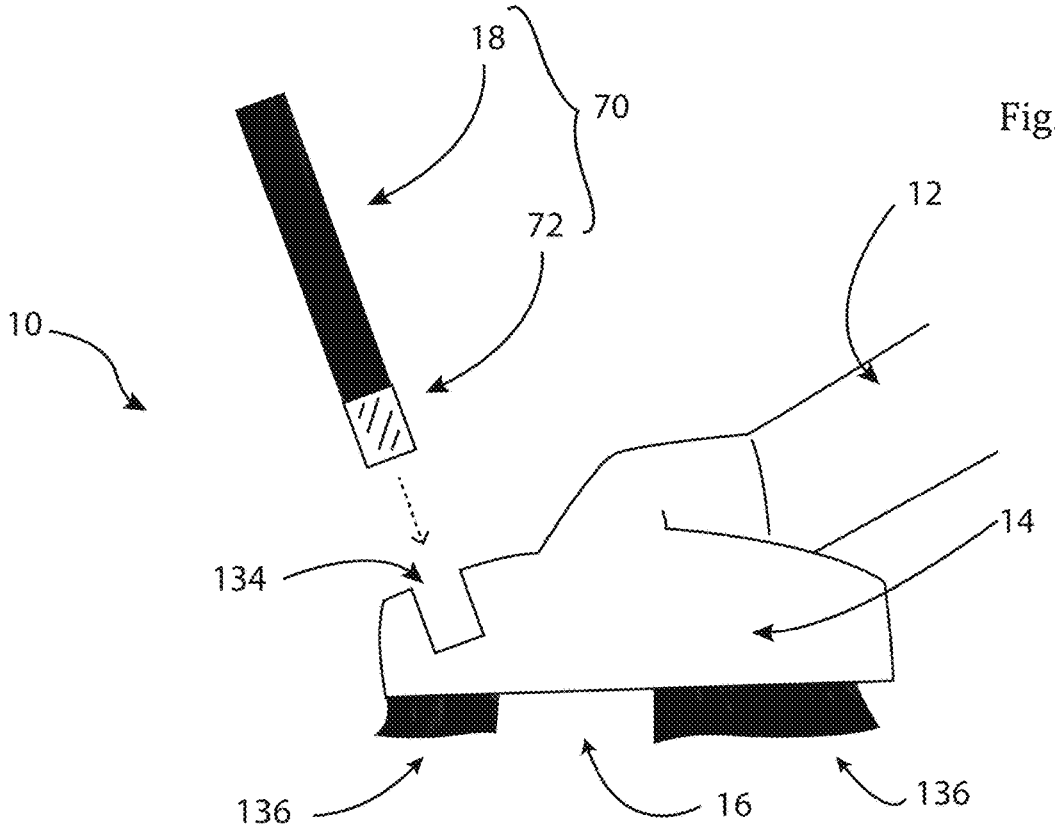
FIG. 32 shows a placement cavity on the head of the apparatus for attachment of the utility tool.
Figure 33:
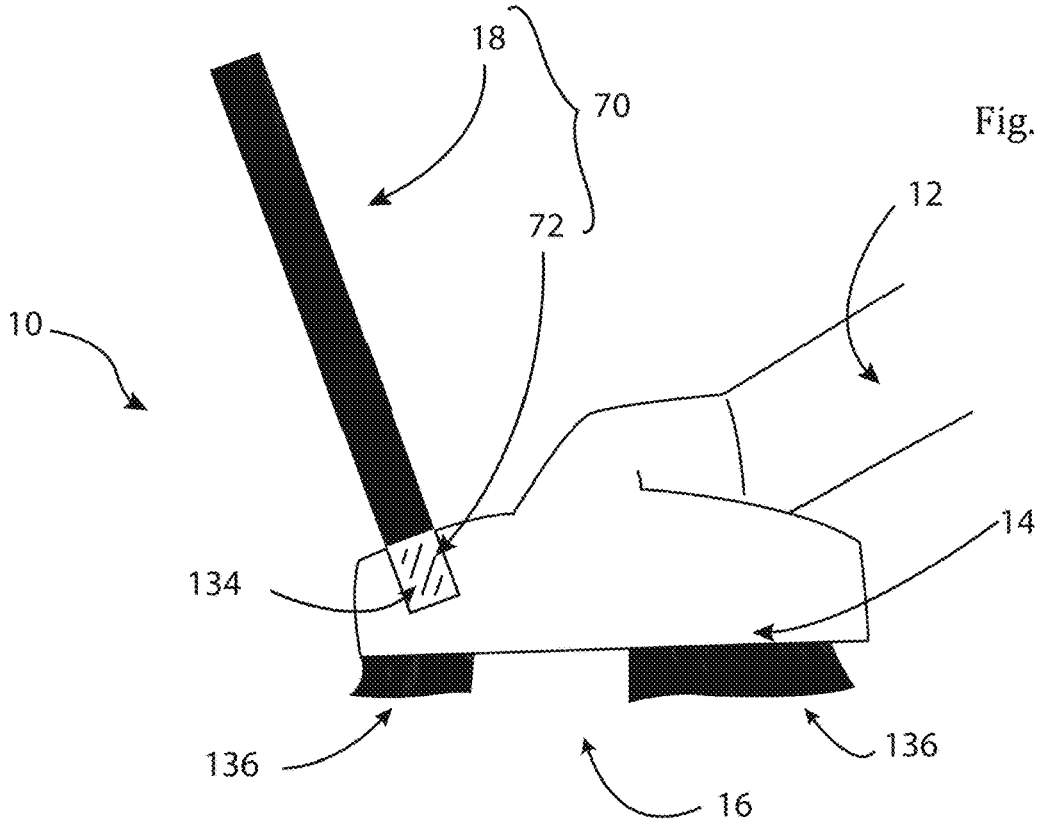
FIG. 33 shows the utility tool placed into the placement cavity of FIG. 32.

One particularly beneficial attachment mechanism, and one preferred embodiment of an attachment mechanism, as shown in FIG. 32 and FIG. 33, may be a placement mechanism where there is provided a placement cavity 134 on the head 14 of the apparatus 10 (which is here shown as a wand head 14 for a canister type vacuum cleaner, but may be any floor cleaning apparatus), the said placement cavity 134 dimensioned substantially similarly, or the same, as the base 72 of the utility tool 70, the head 14 of the apparatus 10 thus configured to receive the base 72 of the utility tool 70, the utility tool base 72 not substantially protruding from the head 14. In such an embodiment, since the base 72 of the utility tool 70 is received fully, or substantially fully, into the head 14, only the cleaning element 18 of the utility tool 70 extends from the head 14 of the apparatus 10. This may be beneficial since, if the base 72 of the utility tool 70 significantly protrudes, it may engage surfaces, such as low overhangs, which will then block access to cleanable areas for the cleaning element 18, and the apparatus 10, thus limiting cleaning. Furthermore, if the base 72 of the utility tool 70 significantly protrudes from the apparatus 10, and is heavily contacted by a surface when the cleaning apparatus 10 is in use, it may dislodge the utility tool 70 (and thus the cleaning element 18) and/or damage the attachment mechanism. For example, if the attachment mechanism is a mounting bracket, if the utility tool 70, protruding from the head of the apparatus 10, is heavily contacted when in use, the mounting bracket may snap, twist, or screws may become loosened. The utility tool 70 may also be dislodged from the bracket.

The apparatus 10 is shown in FIG. 32 before the utility tool is placed into the placement cavity 134, a dashed arrow below the utility tool 70 denoting it is purposed for placement into the cavity 134.

In FIG. 33, the apparatus is shown with the utility tool 70 placed into the placement cavity 134. It can be seen that the base 72 of the utility tool 70 either does not protrude at all from the head 14, or substantially does not protrude, with the benefits as aforedescribed. The cleaning element 18 alone protrudes from the head 14 for upward and radial cleaning. In the present example embodiment of such a placement cavity 134 attachment mechanism as shown in FIGS. 32 and 33, the placement cavity 134 is forwardly angled so that the cleaning element 18 is forwardly angled from the head 14 of the apparatus 10 when the utility tool 70 is placed in the placement cavity 134, which may be beneficial. Placement alone may hold and secure the utility tool 70. However, it is feasible further attachment mechanisms and/or fastening mechanisms are also included for the placement cavity, so that, for example, there may be provided barbs, flanges, and the like that are received into a bottom aperture 102 on the base 72 of the utility tool 70, as aforedescribed, thus further securing the utility tool, and thus the cleaning element, to the apparatus. Thus, as aforementioned, attachment mechanisms may be used in combination.

The example is shown for use with a wand head 14 for a canister type vacuum cleaner, thus the downward facing cleaning element 16 is, in this case, a suction element. However, the or any attachment mechanism for attaching the removably attachable utility tool 70 to the cleaning apparatus may be used with any floor cleaning apparatus, such as a broom, an upright vacuum cleaner, or any other floor cleaning apparatus that has a downward facing cleaning element 16 for cleaning of a floor. The present invention is thus not limited to a broom, canister-type vacuum, upright vacuum cleaner, etc. It will be well known to those with skill in the art that there are floor cleaning apparatuses that neither have a suction element, or brush and the like. For example, there are floor cleaning apparatuses that have roller type heads that use unusual (or substantially unusual) methods for cleaning of a floor. There a steam cleaners that use steam from boiled water (that may be boiled within the floor cleaning apparatus for use by the user), the apparatus having a downward facing cleaning element that includes a cloth and the like (that may be disposable) through which steam is ejected, combination of the steam and the cloth downwardly cleaning a floor. Nevertheless, they are floor cleaning apparatuses and have a handle 12 for holding, a head 14 for moving across a floor surface, and a downward facing cleaning element 16 for cleaning of a floor, thus they are within a scope of the present invention.

In a case of both FIG. 32 and FIG. 33, there is shown a downward facing retractable and projectable brush element 136, (which may be multi-partheid), on a downward facing side of the head 14 of the wand head 14. These are extremely common for wand heads 14 on canister-type cleaners that are non-rotatable about the suction element 16, the purpose of the downward facing retractable and projectable brush element 16 being to optimise the cleaning ability of the apparatus on a plurality of different floor surfaces, the retractable and projectable brush element for example being projectable by a user for use on hard and flat floor surfaces, where it helps cleaning, and retractable by a user the for use on carpets and the like where the downward facing brush element 136 creates too much friction to move the wand head along the carpet floor, and thus hinders cleaning. Such elements are often referred to as 'brush elements', since they tend to be stiff brush-like elements. However, it is feasible that they are not brushed, and may, for example, be pads and the like, therefore the term 'retractable and projectable downward facing brush element' incorporates any element for brushing that is retractable and projectable in the said manner for the said function, and should not be taken to be limited to being a brush (for example having bristles) if the element carries out the said function Assembly and Retrofit If a placement cavity 134, attachment flange 106, etc., and any other integral attachment mechanism, is not included about the head 14 of the apparatus 10, then an assembly is required to convert a floor cleaning apparatus into the present invention 10, as characterized by having both a downward facing floor cleaning element 106 and an upward and radial cleaning element 108 for upward and radial cleaning.

An assembly 138 of such a type, where there is no other attachment mechanism present, must include a mounting element. A mounting element may be as simple as an adhesive strip. Preferably the mounting element is a mounting bracket 140. Thus the invention 10 may be manufactured and/or sold in two parts; a downward facing floor cleaning apparatus, and an assembly, thus resulting in an upward and radial floor cleaning apparatus in accordance with the present invention. The present invention has already been shown in FIG. 23, where an upstanding flange 106, 108 is integral to the head 14 of the apparatus 10 for attaching to a bottom aperture 102 on the base 72 of the utility tool 70. The invention 10 will now be shown wherein there is no integral attachment flange 106 about the head 14, and a or plural flange(s) is provided by way of an assembly 138, the assembly 138 including a mounting bracket 140.

Figure 34:
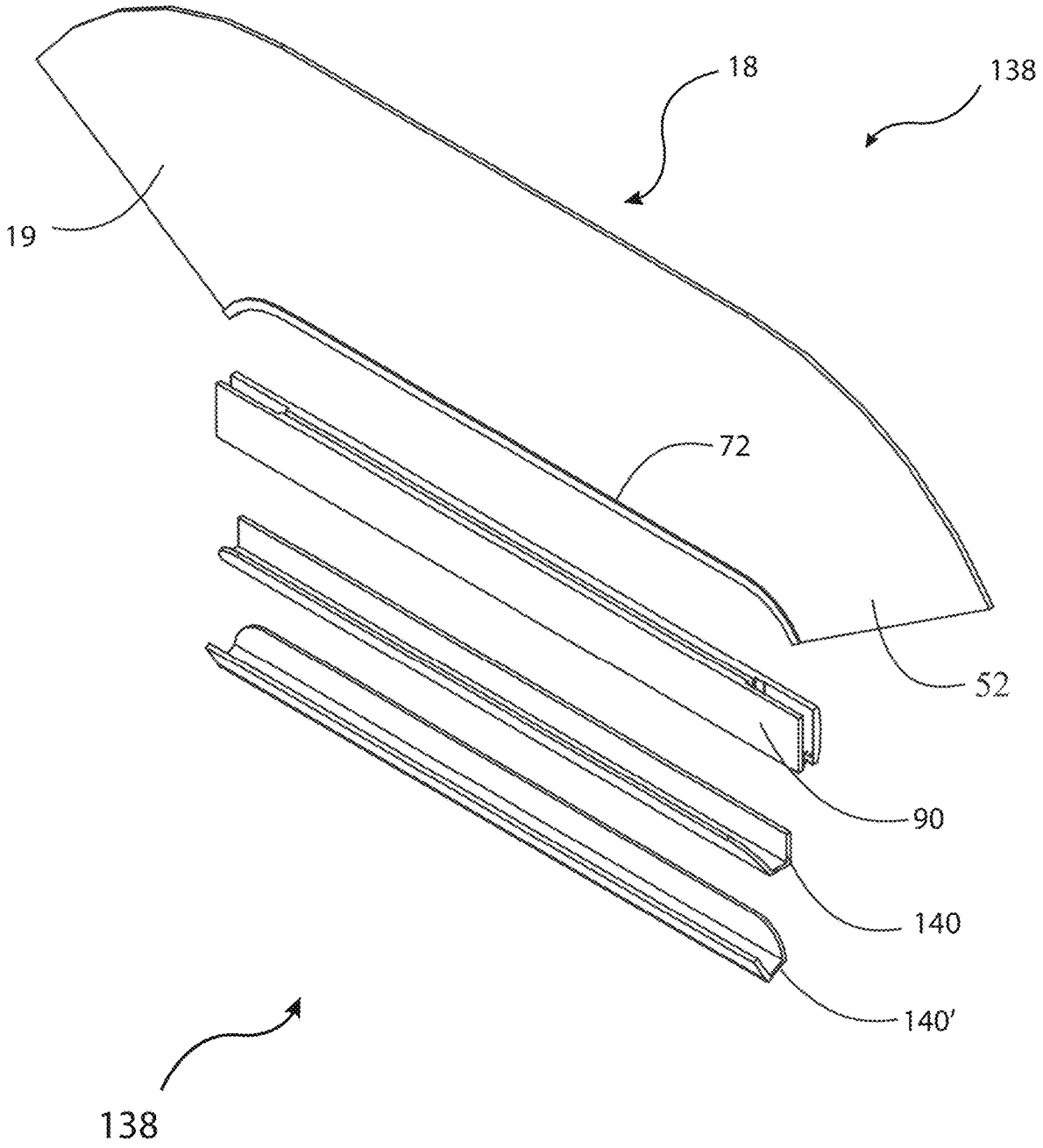
FIG. 34 is an exploded isometric view showing individual components of an assembly, for installing the removably attachable utility tool.

There is shown in FIG. 34 an exploded isometric view showing such an assembly 138. In the shown example, there is provided the utility tool 70 (in accordance with the first preferred embodiment of the utility tool 70, in an embodiment where the base 72 comprises a spine 72' and a brush clip 90), and a mounting bracket 140, which mounting bracket 140 is also shown in a reversed position 140' as the mounting bracket 140 can be used reversibly for mounting the utility tool 70, which will become apparent.

The example for the assembly 138 is shown with reference to the first preferred embodiment of the removably attachable utility tool 70. However, any embodiment of the removably attachable utility tool 70 may employ the mounting bracket 140 and thus be included in the assembly 138 since any embodiment of the utility tool 70, (including the second and third preferred embodiment), may include a bottom aperture 102 which will be used for mounting the utility tool 70 onto the mounting bracket 140 in the example embodiment.

Thus there is shown in FIG. 34 the or any embodiment of the removably attachable utility tool 70 comprising the cleaning element 18, and the base 72 for holding the cleaning element, the base 70 having a bottom aperture 102 for attaching.

Referring to FIG. 35, the mounting bracket 140 incorporates an upright flange 142, which is received by the base 72 of the utility tool 70 through a bottom aperture 102, which may have teeth 104. The mounting bracket 140 employs a horizontal engagement flange 144 perpendicular to the upright flange 142, which is mounted to the head 14 of the vacuum attachment or other appliance, to provide a vertical extension of the cleaning element 18. An angle flange 146 is provided as a secondary mounting for the utility tool base 72, which provides an angle protrusion of the cleaning element 18 as an alternative angled cleaning position as shown in FIG. 36. The mounting bracket 140 may be reversed as shown in FIG. 34 as element 140', which places the engagement flange 144 at an angle for mounting to a sloping surface such as an upright vacuum cleaner, which often have a forwardly sloping front face, with angle flange 146 now providing the vertical positioning of the cleaning element 18 and upright flange 142 providing mounting for the alternative angled cleaning position. The three elements of the mounting bracket 140 (which is a preferred embodiment of a mounting element), the upright flange 142, engagement flange 144, or angled flange 146, may provide the attachment surface to the cleaning device, depending on whether the attachment surface is horizontal, vertical, or sloped. The attachment of the assembly 138 to the apparatus 10 may be carried out by way of adhesives, mechanical fastener, such as screws and the like, or other attaching methods. In various embodiments, the mounting bracket 140 may be extruded or molded rigid plastic, aluminium, or steel, depending on strength and durability requirements for the desired application.

Figure 37:
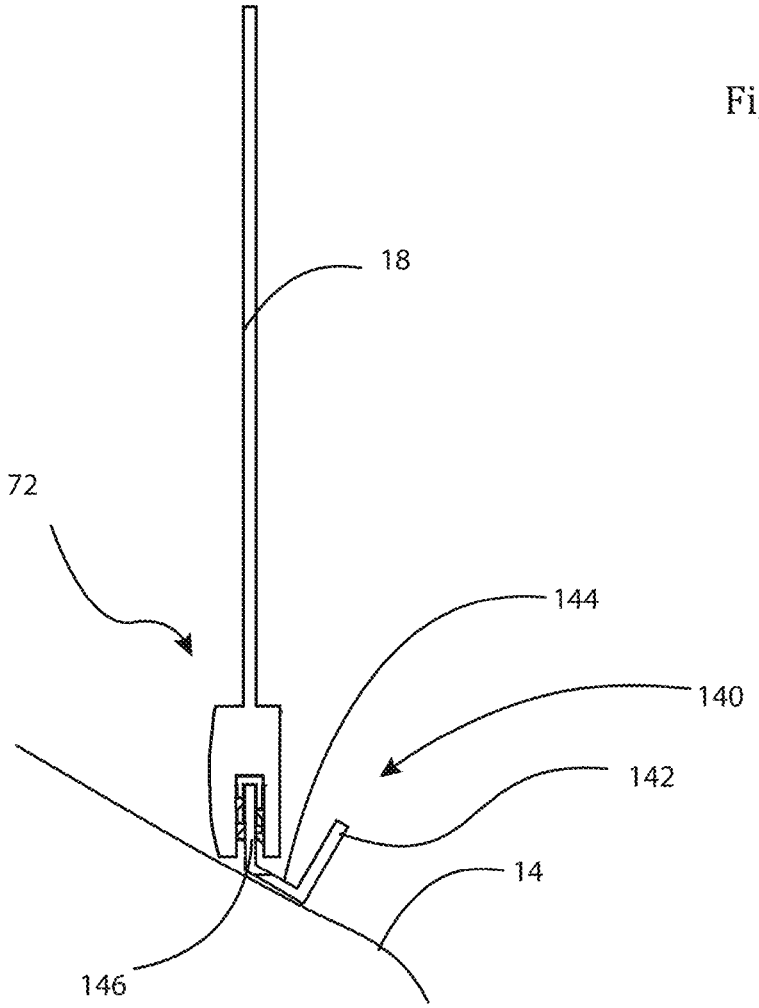
FIG. 37 shows a reversed orientation of the mounting bracket, the bracket mounted to a sloped surface, the utility tool mounted vertically on the angle flange.
Figure 38:
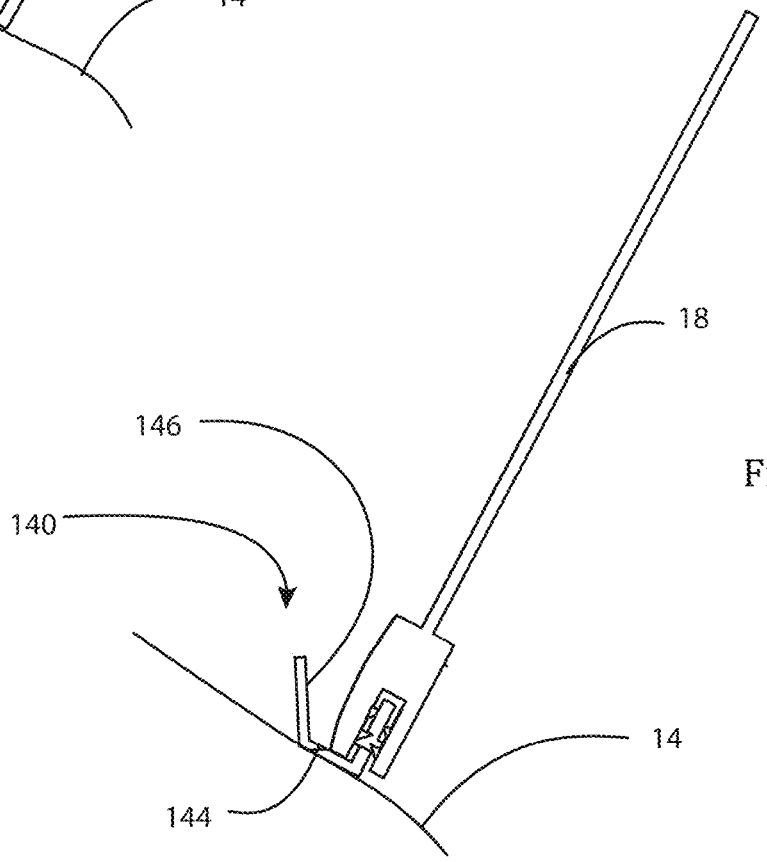
FIG. 38 shows a reversed orientation of the mounting bracket, the bracket mounted to a sloped surface, the utility tool mounted in an angulated manner on the upright flange.

As shown in FIG. 35 and FIG. 36, attachment of the mounting bracket 140 to a horizontal surface allows vertical extension of the cleaning element 18 when mounted on the upright flange 142, and angled protrusion of the cleaning element 18 when mounted on the angle flange 146. Similarly, with the mounting bracket 140 reversed as shown in FIG. 37 and FIG. 38, mounting of the bracket 140' to a sloped face allows vertical extension of the cleaning element 18 when mounted on the angle flange 146 (FIG. 37) and angled protrusion of the cleaning element 18 when mounted on the upright flange 142 (FIG. 38).

Such a configuration of a mounting bracket 140 for use as a mounting element is viable for all embodiments of the removably attachable utility tool 70, as all embodiments of the utility tool 70 have a base 72, and may therefore have a bottom aperture 102 for attaching to the mounting bracket 140.

Clearly an assembly 138 as herein shown, or any assembly 138 including a mounting element, (which may be an adhesive strip or any other element for mounting), for mounting the utility tool 70 may be used for retrofit. Thus it is feasible the assembly 138 is provided for attachment of the utility tool 70 to an apparatus previously not having an upward and radial cleaning element 18, thus forming the present invention. Thus it can be seen that the assembly 138 as hereinbefore described may be provided for a user for converting a cleaning apparatus into the present invention.

In a more elegant embodiment of the mounting bracket 140 which may save costs, the mounting bracket 140, which is seen in FIG. 34 as an elongate bracket 140 that substantially runs along a length of the head 14 of the apparatus 10 and of the utility tool 70, may come as two miniaturized parts, so that there are two mini-brackets, with similar flange properties as hereinbefore described with reference to the mounting bracket 140, the utility tool 70 thus being mountable via the two mini-brackets, which may attach to the utility tool 70 via a similar flange and bottom aperture 102 attachment. There may be provided an adhesive element and/or a screw cavity in each bracket for attaching the bracket (or mini-brackets) to the apparatus 10 via at least one screw, although the or any bracket may be attached via any other means.

Thus it can be seen that the invention 10, as characterized by a cleaning apparatus which has a downward facing cleaning element 16 for floor cleaning, and an upward and radial cleaning element 18 for upward and radial cleaning can be carried out: feasibly with a non-removable upward and radial cleaning element 18; with a removably attachable cleaning element 18 which comprises a resiliently flexible spine 26 and a brush element 19 extending therefrom; and with a removably attachable utility tool 70 that incorporates the upward and radial cleaning element 18, the utility tool 70 comprising a base 72 and the cleaning element 18 for upward and radial cleaning.

The Cleaning Element

With regard to the cleaning element 18, preferably dramatically resiliently flexible bristles are provided for upward and radial cleaning. Bristles, particularly of certain materials, may have extremely resiliently flexible properties that allow the brush element 19 to bend dramatically, therefore providing access for the cleaning element 18 to a multitude of surfaces for cleaning, whilst also being extremely resiliently flexible, so that they bend back into position once displaced. This has significant advantages, which will be shown. However, softer bristles and materials, for example, horse-hair, velour, etc that have thick and soft piles for cleaning, may have superior cleaning and dust adherence properties, whilst being inferior in terms of resilient flexibility, which may lead to loss of shape, form, and function for the brush element 19.

As aforementioned, it is therefore feasible that, if a softer brush element 19 is utilised, there is provided a stabilizing member 130 for a lower portion of the cleaning element 18, with the softer brush elements embedded therethrough, the purpose of the stabilizing member 130 being to establish and reassert resilient flexibility for the brush element 19, whilst retaining superior cleaning properties that a softer brush element may provide.

Similarly, it is feasible that dramatically resiliently flexible bristles are retained as the brush element 19, which may have inferior cleaning and dust adhering properties, and that a top portion (or an engaging portion) of the cleaning element 18 (and thus the bristles) is treated and surfaced with a cleaning enhancing material, which, when surfaced on the bristles, enhances their cleaning capacity. An engaging portion is a portion of the brush element 19 (in this case bristles) that engages a surface for cleaning. For bristles, the engaging portion of the brush element 19 is most likely to be the tips of the bristles.

For example, the bristles may be sprayed with a mild fluid adhesive, and then be treated so that fur filaments are adhered to the bristles. The fur filaments, being applied to a surface of the bristles where there is adhesive present, may resoundingly stick to the surface of the bristles. Thus the bristles (and thus the cleaning element 18) retain their dramatically resiliently flexible qualities, whilst having enhanced cleaning qualities via the treated surface, which, with fur filaments adhered, may, for example, have superior properties at dust adherence and the like. Fur filaments are simply an example of surfacing the bristles for superior cleaning properties. It is also feasible an engaging portion of the brush element 19 is treated without a surfacing element. For example, a portion or a whole of the brush element 19 may be heat treated or abraded to enhance cleaning properties.

In embodiments of the invention 10 where the cleaning element 18 is removably attachable, there may be provided a plurality of cleaning elements. The or each upward and radial cleaning element may be extravagantly colorized for at least one of: indicating use for an alternate cleaning area, added attractiveness, increased visibility of the element. For example, a cleaning element 18 for use in a kitchen may be extravagantly colorized in the color green, whilst a cleaning element that is for use in a bathroom/lavatory, may be extravagantly colorized in the color red, which differentiates the two and may be important for hygiene reasons. Thus it can be seen that extravagant colorization can be used to denote use for the cleaning element 18 and/or apparatus for a particular area. There may be provided a plurality of cleaning elements 18 that are separately and differently colorized. This may also provide greater attractiveness for the cleaning element 18 and thus the device, which is beneficial. Extravagant coloration also makes the cleaning element 18 more visible than a standard black color (which is often used for such like cleaning elements), which has the benefit both of allowing the cleaning element 18 to be eminently visible to a user whilst the apparatus 10 is in use, thus facilitating the user in directing the cleaning element 18 more easily, and showing dirt collected on the cleaning element, which facilitates the user in knowing when the cleaning element 18 is dirty and should therefore be replaced.

Definition of Extravagantly Colourised

A standard plaster for a hand cut, etc. is approximately skin colored, in order that it is least noticeable. This is a standard and default color for a plaster. However, in a restaurant, plasters (for staff) are colored blue—they are 'colorized', in this case so that they are eminently noticeable in case they fall into food.

Similarly, the default color for brush strips and the like for cleaning elements of many types is black, for similar reasons as to why a plaster is skin-colored; so that it will be least noticeable, with a further reason particular to brush strips and brushing elements being that the color black best hides dirt and particulate matter on the cleaning element.

Therefore any color that is significantly not black is said, for the purpose of the present invention, and legal reasons thereof, to be 'colorized', particularly one in a color that is configured to draw attention to the cleaning element 18, which may have benefits for an upward and radial floor cleaning apparatus. A cleaning element 18 which is, for example, light green and thus extremely noticeable, for the purpose of drawing attention to the cleaning element, rather than away from it, is said to be extravagantly colorized.

Colorization may be achieved via incorporation of a coloring addition to the materials for manufacture of the brush element at the manufacture stage, the cleaning element 18 thus incorporating a coloring addition for extravagant colorization.

In Use

The invention 10 will now be described by way of demonstrating the dramatic and unusual cleaning abilities of a preferred embodiment of the upward and radial cleaning element 18 of the invention 10, where the cleaning element 18 is fan-shaped, has a continuous horizon, the radial portions of the cleaning element 18 curve substantially downward to 90 degrees, and the cleaning element 18 employs dramatically resiliently flexible bristles, which have particular advantages as will be shown.

There is shown in FIGS. 39-44 inclusive the invention 10 in use displaying cleaning properties of the invention 10. Irrespective of whether the cleaning element 18 is shown as non-removable, via use of a removably attachable cleaning element 18, via use of a removably attachable utility tool 70 that incorporates the cleaning element 18, or via use of an assembly 138, any of the said configurations may be used with respect to FIGS. 39-44. Thus if the invention 10 is shown with what appears to be a non-removable upward and cleaning element 18, it will be obvious that the invention 10 may equally employ, for example, a removably attachable cleaning element 18 configuration, a removably attachable utility tool 70 configuration, or an assembly 138 configuration.

As shown in the examples of a preferred embodiment of the cleaning element 18, the upward and radial cleaning element 18 is clearly distinctly separate from the downward facing cleaning element 16, and has different cleaning element constitution, the upward and radial cleaning element thus significantly differentiated from the downward facing cleaning element in design and function.

Figure 39:
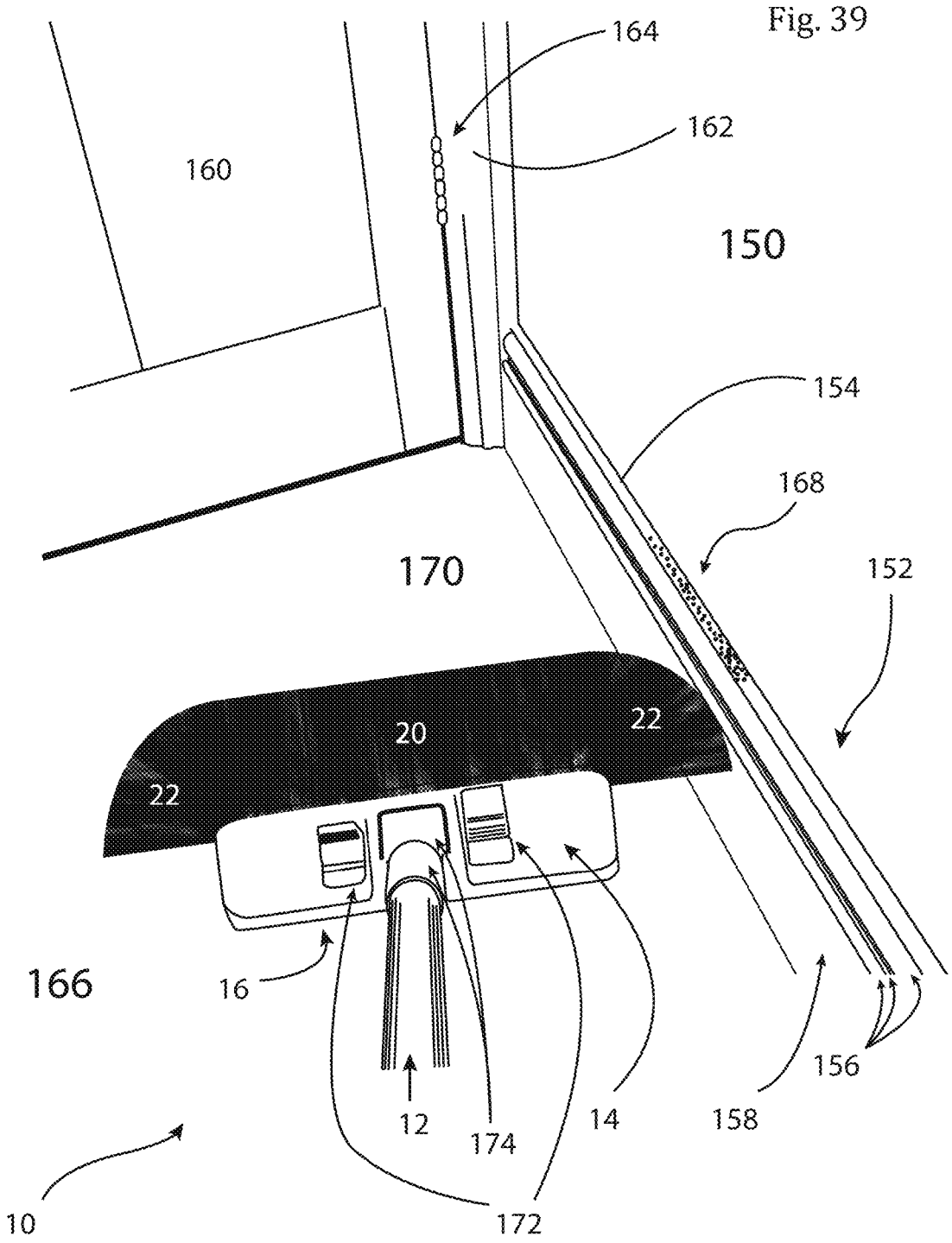
FIG. 39 shows the cleaning apparatus in process of cleaning a floor and a skirting board.

Referring to FIG. 39, the invention 10 is extremely useful in an embodiment where the cleaning apparatus is a canister vacuum cleaner with wand attachment. A canister wand vacuum cleaner substantially combines the power and effectiveness of a vacuum cleaner, with the dexterity of a broom, the head 14 being easily liftable and maneuverable, the head 14 being substantially slim for accessing tough-to-reach areas for suction cleaning. To summarize, a vacuum cleaner is so large and bulky that it cannot, for example, easily be lifted and manipulated by the user for cleaning, and cannot access various areas for cleaning. A broom, on the other hand, is extremely lightweight and dexterous, and can easily be manipulated and lifted by a user. Yet it has no suction, so it cannot erase dirt—it simply brushes it. A canister vacuum cleaner with wand attachment combines suction (with all its cleaning benefits) with extreme dexterousness. Whilst the canister itself is not easily lifted and manipulated, the wand head 14 is. This may bring particular benefits for the present invention.

There is shown in FIG. 39 a common occurrence.

A bathroom wall 150 has a skirting board 152. The skirting board 152 has an overhanging ledge 154, various ornamental curved grooves 156, and a flatboard 158. There is also shown a bathroom door 160, and a surround for the door 162. The door 160 has hinges 164. In this case, a floor 166 of the bathroom is flat.

Dirt 168, cracked paint 168, and other dust 168 has gathered on the overhanging ledge 154. This is a common occurrence, obvious to all laypeople and cleaners. The present invention 10 is shown in an embodiment where the cleaning apparatus is a canister vacuum with wand attachment.

As can be seen, a radial portion 22 of the cleaning element 18 immediately engages and extends into the curved grooves 156, thus cleaning them, in a same movement as cleaning the floor. This is an exceptionally effective method of cleaning a plurality of surfaces, requiring no extra movement and/or effort from a user. Aspects of the skirting board 152 are thus cleaned without any extra effort by the user, whilst the downward facing cleaning element 16, which is here a suction element 16, cleans the floor 166. Thus downward facing cleaning via the downward facing cleaning element 16, and upward and radial cleaning via the upward and radial cleaning element 18 are accomplished in a same movement, with no extra effort. The overhanging ledge 154 of the skirting board 152, however, remains inaccessible in a same movement as cleaning the floor 166. In a preferred embodiment of the upward and radial cleaning element 18, the cleaning element 18 may be anywhere from 3.5 in to 6 in, although it could be any height.

Without the present invention 10, in order to suction clean the overhanging ledge 154, and the dust 168 thereon, the wand head 14 must be lifted substantially high above the ground and the suction element 16 pressed down against the overhanging ledge 154. However, the wand head 14 is not designed for this and is extremely bulky for the task. A large amount of manipulation may be required, which may be ungainly for the user, and may not be entirely successful.

Furthermore, it is extremely likely, due to bulkiness of the head 14 for this task, that such an action may lead to bumping of the wall 150 with the wand head 14, which could mark the wall 150, and could crack and dislodge further paint 168.

Some may detach the wand head 14, using the (pipe) handle 12 without the head 14 to clean the overhang, which is a technique often used to clean and access difficult areas, such as corners of rooms, with a canister vacuum wand head 14. However, this is even more likely to leave markings on the wall since such pipes are often metallic and fairly sharp edged. The pipe must then be replaced back into the wand head to resume cleaning via the wand head, which is cumbersome to repeat.

In both cases, significant manipulation is required by a user. Not so with the present invention. With minimal manipulation and barely lifting the wand head 14 off the floor, the wand head 14, in the present example as shown in FIG. 39, can be tilted slightly to the right.

The radial cleaning element 18, 22 may then engage the dust 168 and dirt 168 on the overhanging ledge 154 of the skirting board 152, with some dust 168 being retained in the cleaning element 18, and some dislodged directly onto the floor space 170 in front of the wand head 14, where it is then vacuumed and erased by the suction element 16.

Not only is the present invention 10 designed for such a purpose, and highly effective, but the highly visual effect of the plumage 18 (which is the cleaning element 18), particularly in a case where the plumage 18 is colorized extravagantly, reminds the user to clean such surfaces, which is beneficial. Thus ornamentation and/or colorization of the cleaning element 18 may increase likelihood of use.

Skirting boards 152 are prevalent in almost all modern households in the world, with each house often having approximately 50 meters of skirting boards throughout the house. Many are designed in such a way that a wand attachment head 14 is simply not ergonomic enough to clean. Many users simply forget to clean the skirting boards 152; if a layperson runs a finger along any given overhanging ledge 154 of a skirting board 152 in any given house, (even an overhanging ledge 154 that appears clean), it is usually found that there is dust 168 and decay 168 on the ledge 154, which appears as a grey or black mark on the finger.

Thus it can be seen that not only does the present invention 10 provide a superior method of cleaning skirting boards 152, but it also does this with a potential for reminding the user of such cleaning in an embodiment where the upward and radial cleaning element 18 is colorized, and that a minimal amount of manipulation is required by the user.

It should also be noticed that the cleaning element 18 engages the whole flatboard 158 of the skirting board 152, as well as the ornamental curves 156, in a same movement as cleaning the floor 166 downwardly, which a downward cleaning apparatus, typically, does not. Thus it can be seen that the present invention 10 has specialized adaptations specifically configured for the purposed task; for cleaning a greater amount of surfaces than a standard downward facing floor cleaning apparatus.

Because the upward and radial cleaning element 18 is designed to point upwardly (which may include angled upwardly) and radially, there is thus provided a selecting element 172 for a downward facing interchangeably retractable and projectable brush element 136, as aforeseen in FIGS. 32 and 33. Furthermore, because the upward and radial cleaning element 18 is designed and positioned for upward and radial cleaning, and not for downward facing cleaning, the canister type vacuum cleaner with wand attachment thus has a head 14 that is non-rotatable about the suction element 16. Thus a selecting element 172 for an interchangeably selectable brush element 136 is required to optimize the apparatus (and wand head) for downward facing cleaning of alternate floor surfaces. Thus, the interchangeably selectable brush element 136 may be projected from the head 14 for use on hard flat floors to aid cleaning, and may be retracted by the user for downward cleaning of surfaces such as carpet and the like, where the interchangeably selectable brush element 136 causes too much friction. Such selection can be achieved via the selecting element 172, which on the device as seen in FIG. 39, is diploid. However, a selecting element 172 for an interchangeably retractable and projectable brush element 136 may be shaped, configured, and designed in any way, which will be obvious to those with skill in the art. Thus it can be seen that, via the selecting element 172, the interchangeably selectable brush element 136 can be interchangeably projected and retracted from the head of the apparatus for cleaning of multiple variable surfaces.

The head of the wand is ideally pivotable, which aids thorough cleaning. Thus there is provided a pivot mechanism 174 for the head 14, which is extremely useful for a wand head 14 of a canister type vacuum cleaner.

Figure 40:
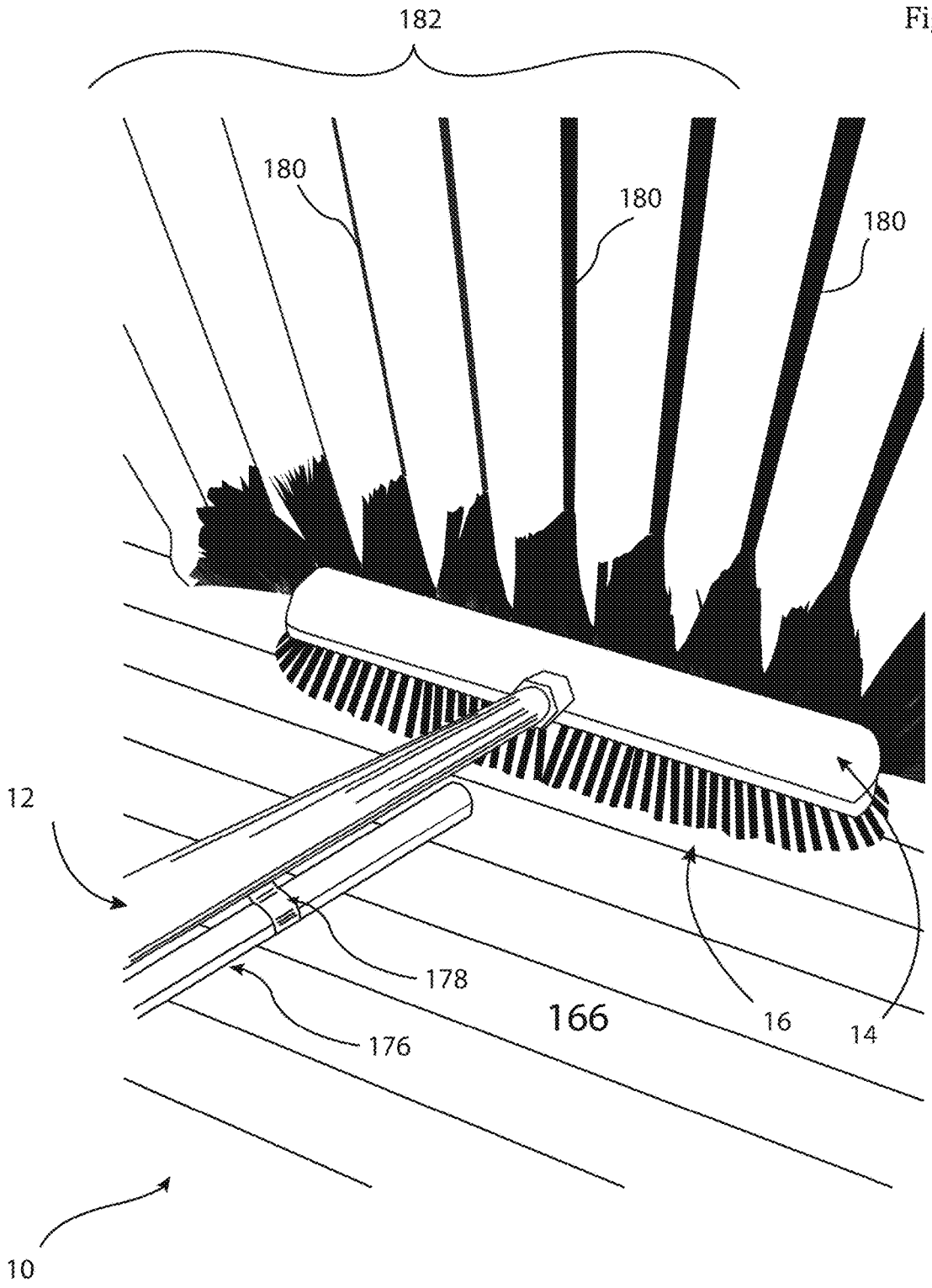
FIG. 40 shows drastically displaced portions of the cleaning element cleaning gratings of a radiator.

Referring to FIG. 40, the invention 10 is provided wherein the cleaning apparatus 10 is a broom. The broom, in this case, has a secondary handle 176 which is attached removably to the handle 12 of the apparatus 10 via a clip 178. In an embodiment of the apparatus 10 where there is provided a removably attachable utility tool 70 that incorporates the upward and radial cleaning element 18, it is feasible the secondary handle 176 may be attachable to the utility tool 70 so that not only can the utility tool 70 be used for separate cleaning as a handheld cleaning tool, but it can also be used to clean far-reaching surfaces, such as ceiling corners, roof struts, etc which would otherwise be inaccessible, thus further optimizing the present invention 10 for cleaning of a greater amount of surfaces that a standard downward facing cleaning apparatus.

The floor 166, for the present example, has boards, and may be wooden. The dramatically resilient and displaceable qualities of the upward and radial cleaning element 18 are shown, whereby the cleaning element 18 is drastically displaced into many separate portions for cleaning of, for the present example, gratings 180 of a radiator 182. As can be seen, the invention 10 provides an incredible array of cleaning methods and possibilities; in this case cleaning the gratings 180 of a radiator 182. In an embodiment where there is provided a removably attachable utility tool 70, the utility tool 70 can easily be removed to similarly clean, for example, slats in a venetian blind, and any other surface.

Such is the dramatic resilient flexibility of the bristles that they simply reform to their original position when removed from the displacing obstacle, which, in this case, is gratings 180 of a radiator 182.

In the shown example, the upward and radial cleaning element 18 is forwardly angled. It can be seen that forward angulation may have significant benefits, such as, (as herein shown), engaging and radiating the cleaning element 18 into a plurality of forward areas. It may be particularly beneficial, and intuitive, therefore, if there is provided a cleaning element movement selecting system 89 as shown in the example embodiment of a cleaning element movement selecting system 89 in FIG. 19, so that, preferably via a movement selecting element 82 on the handle 12 of the apparatus 10, the cleaning element 18 can be easily and intuitively selectably moved by the user, so that it can, for example, be interchangeably forwardly and backwardly angled to engage with, and thus clean, a desired surface or surfaces.

Figure 41:
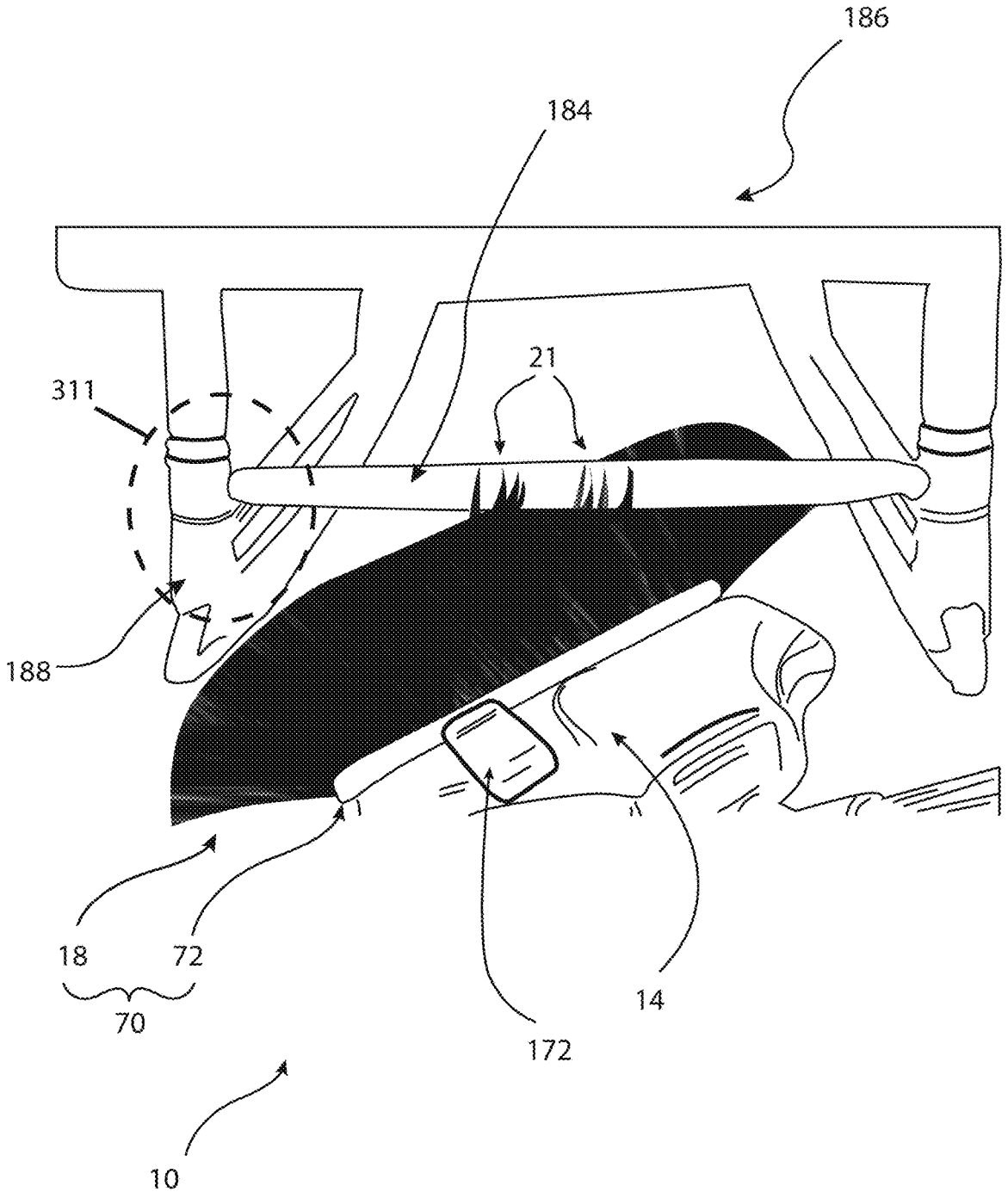
FIG. 41 shows individually displaced bristles of the cleaning element cleaning a horizontal strut.

Further evidence of the dramatically resiliently flexible qualities of the cleaning element 18 are shown in FIG. 41, where there is shown the invention 10 upwardly cleaning a horizontal stabilizing strut 184 of a chair 186. Individual displaced bristles 21 can be seen flexibly curved that have been displaced by the horizontal strut 184 of the chair 186. The displaced bristles 21 of the cleaning element 18 continue to clean even when displaced, in this example, cleaning a forward facing side of the horizontal strut 184. The displaced bristles 21 simply reform to their original position when removed from the displacing obstacle, which, in this case, is the horizontal strut 184. However, it can be seen that dashed circle 311, which defines a corner in between the horizontal strut 184 and a vertical leg 188 of the chair, is also engageable by the radial side portions 22 of the cleaning element 18. All this may be achieved in a same movement as downward cleaning of the floor, with little, or no, extra effort from the user. Thus the apparatus 10 is optimized for cleaning of a greater amount of surfaces than a standard floor cleaning apparatus.

There is shown in the example embodiment the removably attachable utility tool 70, which has a base 72 and the upward and radial cleaning element 18, and may be attached to the head 14 of the apparatus via an assembly.

Figure 42:
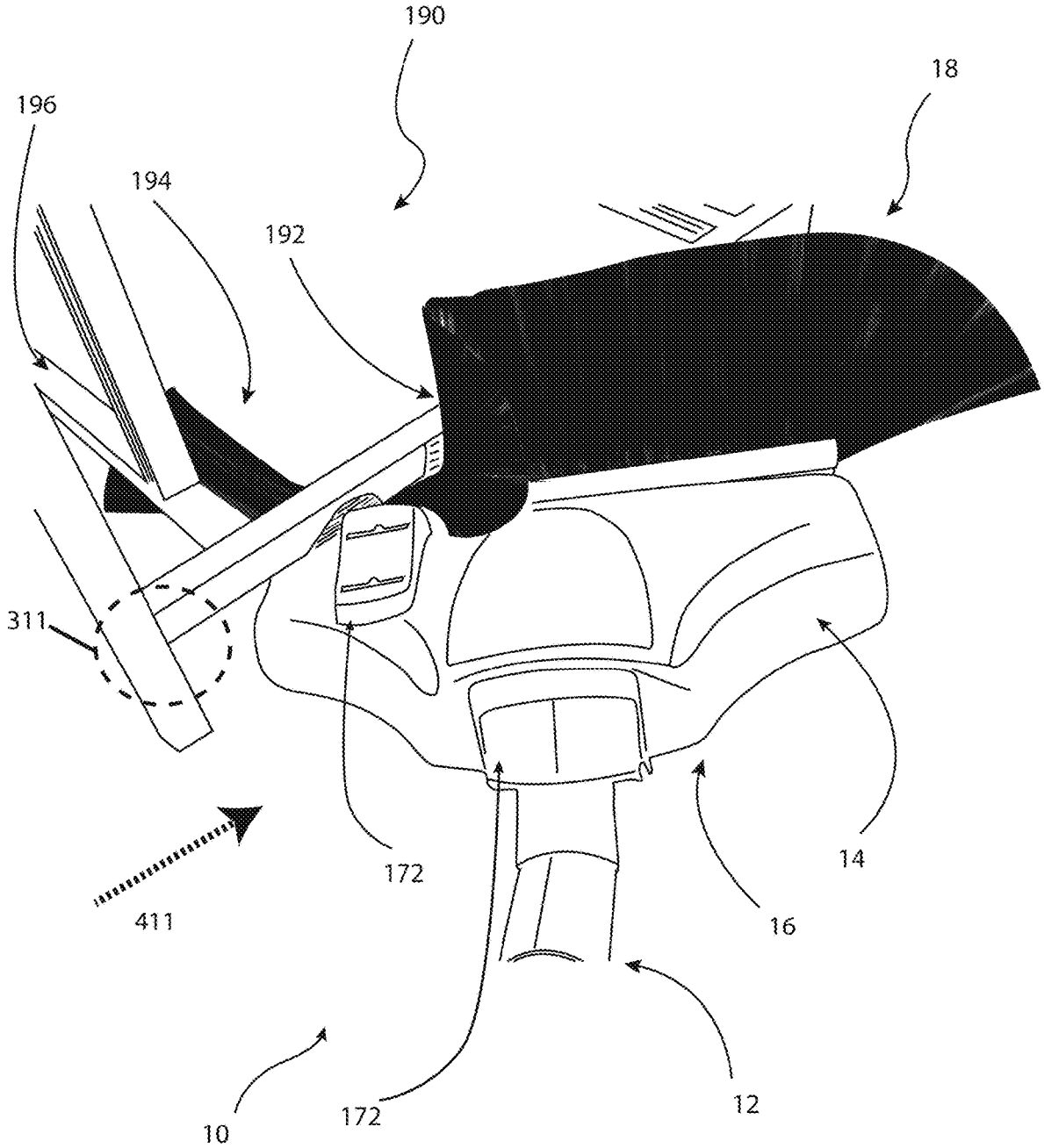
FIG. 42 shows a drastically displaced portion of the cleaning element, creating a bowed portion.

Referring to FIG. 42, there is shown the invention 10, wherein the object for cleaning is a side-table and the like, which also has supportive struts. The cleaning element 18 has been drastically displaced in one portion, creating a bowed portion 192, and a drastically displaced portion 194, drastically displaced from the rest of the cleaning element 18. Nevertheless, the drastically displaced portion 194 continues to clean, engaging an underside of a table strut 196 that is inaccessible to any other form of downward facing cleaning apparatus, and would otherwise remain uncleaned. Significant dust, dirt, and particulate matter, as well as cobwebs, spiderwebs, and the like, may be collected in such areas, which are made accessible by the dramatically resiliently flexible bristles of the cleaning element 18. This is all achieved in a same movement as downward cleaning of a floor with no added effort from the user. Thus it can be seen, due to the unusual dramatically resilient flexibility of the bristles, in a preferred embodiment, the cleaning element 18, via displacement, can effectively carry out a job of multiple standard cleaning elements or apparatuses, then, once displacement ceases, revert to an original position, which, in the present example embodiment, is a fan-shape configuration.

Dashed circle 311 again denotes the cleaning element 18, and in particular a radial portion 22 of the cleaning element 18 is easily able to access diagonal corners between struts, legs and the like. Dashed arrow 411 denotes that in an alternative angle of attack for the apparatus 10, such is the extended cleaning ability of the radially outwardly projecting portions 22, cleaning from a sideways angle may also significantly clean the side table struts. Thus the apparatus 10 can clean such surfaces adjacently, in a same movement as cleaning the floor.

Figure 43:
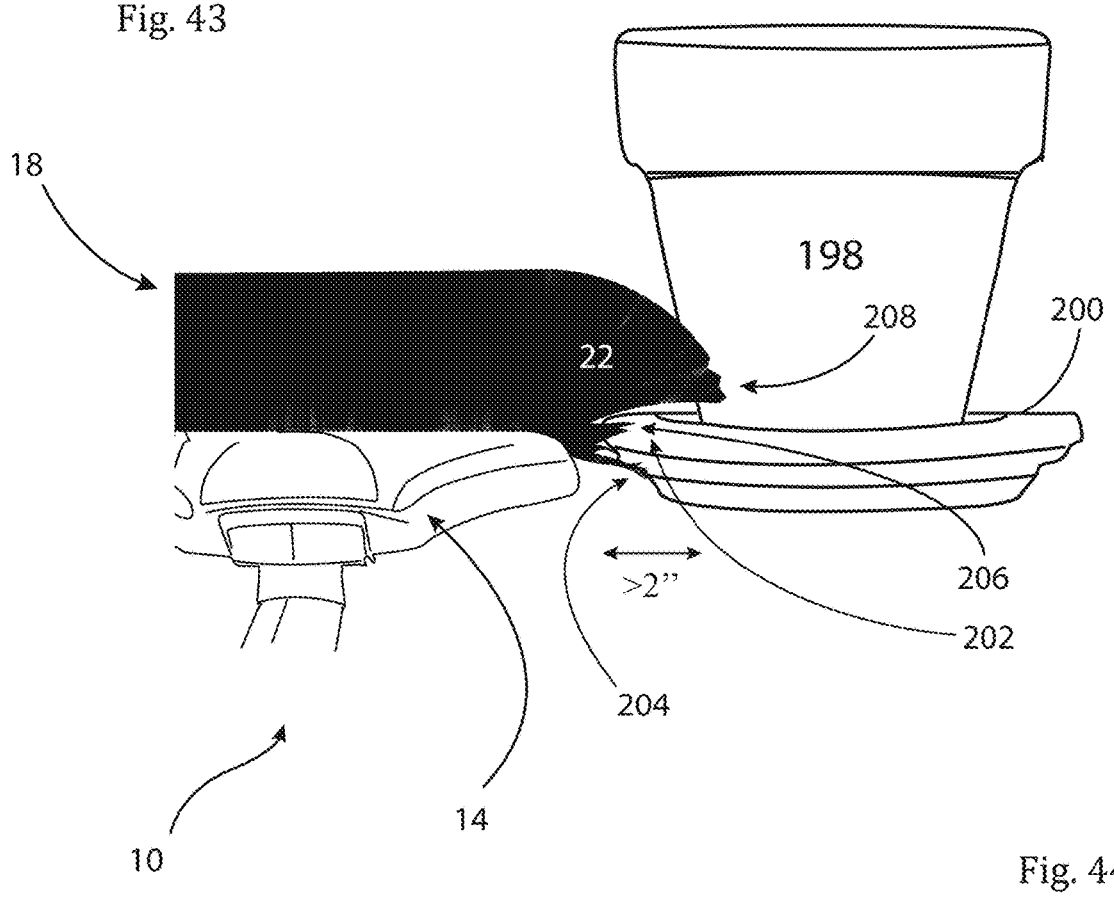
FIG. 43 shows the cleaning apparatus cleaning an extraneous adjacent surface whilst simultaneously downwardly cleaning a floor.

With particular respect to adjacent cleaning properties of the present invention 10, there is shown in FIG. 43 an example of extraneous adjacent cleaning by the invention 10. It will be well known that in Mediterranean countries, as well as the United States of America, due to a hot climate and extremely large house space in comparison to, say the average house size in Europe, there are kept in many houses palm-type trees and plants that can be exceptionally large. These require a large plant pot 198, which may, for example, require a water drainage saucer 200 that is in excess of 12 inches in diameter. As shown in FIG. 43, the lip 202 of the saucer is 2 inches, and the wand head 14 is blocked from accessing the surface of the plant pot 198 by the 2 inch lip 202.

An extraneous adjacent surface is a surface that is at least 2 inches from the head 14 of the apparatus 10, the head 14 of the apparatus 10 being blocked from accessing the said surface in a same movement as cleaning the floor, by at least 2 inches. In this case, the lip 202 blocks the wand head 14 from contacting the surface in a same movement as cleaning the floor by the at least 2 inches. Nevertheless, such is the resilient flexibility of the bristles of the cleaning element 18, that the radial portion 22 of the cleaning element 18 contacts and engages all of: an underside of the saucer (denoted by the number 204 at the point of engagement and cleaning), the lip 202 itself (denoted by the number 206 at the point of engagement and cleaning), and, most pleasingly, a side surface of the plant pot (denoted by the number 208 at the point of engagement and cleaning), all in a same movement as downward cleaning of a floor, with no extra effort required by the user. This is extremely unusual. Thus it can be seen that an extraneous adjacent surface, one the head of the apparatus is blocked from by at least 2 inches, can be accessed, engaged, and cleaned by the present invention 10. It is feasible that surfaces of still more extraneous distance than 2 inches may be accesses, engaged, and cleaned by the cleaning element 18, and in particular the radial portion(s) 22; for example, extraneous adjacent surfaces of 2.5 in, 3 in, 3.5 in, 4 in, 4.5 in, 5 in distance, or greater.

Figure 44:
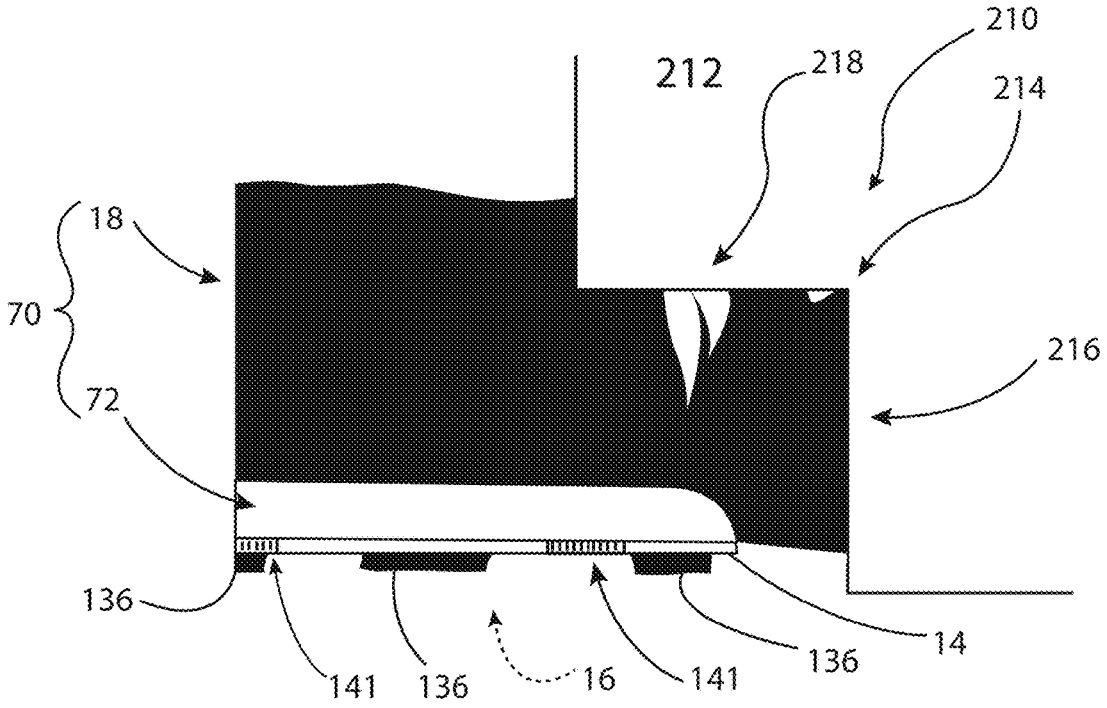
FIG. 44 shows the cleaning apparatus cleaning a toe kick.

An example that will be well known in terms of its difficulty of cleaning is a toe kick 210, as shown in FIG. 44. A toe kick 210 is a square recess at the base of kitchen units 212 that provides adequate space for a user's shoes/toes so that a user can place their feet under the kitchen units 212 and thus stand closer to the unit 212 whilst retaining full balance. This is important for carrying out everyday jobs like cutting food items, and for reaching across the unit 212. With reference to cleaning of a toe kick 210, it is particularly difficult to access a top inner corner 214 of the toe kick 210 for cleaning, especially whilst simultaneously cleaning the floor downwardly so that no separate cleaning and/or cleaning apparatus is required. Kitchen floors are hard and bending down on one's knees to separately clean an inner corner 214 of the toe kick 210, perhaps with a wetted towel, is an undertaking that is both undesirable and toilsome, and may not be physically possible or recommended for a person of advanced age.

Such areas can become soiled, greasy and may well include cobwebs, dust, and the like. It would be desirable if all of a sideways surface 216 of the toe kick 210, an upward surface 218 of the toe kick 210, and the hard-to-reach inner corner 214 of the toe kick 210 could all be cleaned in a same movement, and with little or no added effort by a user, as downwardly cleaning the floor with a downward facing cleaning element 16.

The present invention 10 provides a solution to this by simultaneously cleaning all of the aforesaid surfaces. The embodiment of the invention 10 as shown in FIG. 44 employs a removably attachable utility tool 70 on the wand head 14 for a canister type vacuum cleaner, which is shown attached to the head 14 via an assembly 138 that employs two miniaturized brackets 141 that function similarly to the elongate mounting bracket 140 as shown in FIG. 34. Each miniaturized bracket 141 may have an adhesive strip for attaching and/or may have at least one screwing cavity for screwing the bracket 141 into the head 14 of the apparatus, although it is feasible an alternate attachment method may be used. A multi-partheid interchangeably projectable and retractable downward facing brush element 136 is shown for facilitating cleaning of a hard and flat surface.

As aforementioned, the utility tool 70 may be used as a separate handheld cleaning tool in order to, for example, clean a base of a lamp and the like, as well as many other (household) cleaning jobs. If the utility tool 70 is configured for cleaning of such items, which by nature should not be cleaned with a downward facing cleaning element 16 for hygiene reasons, the cleaning element 18 of the apparatus must be distinct from the downward facing cleaning element 16 for cleaning of a floor, thus separate and retaining hygiene.

Removably Attachable Cleaning Element

With reference to embodiments of the invention incorporating a removably attachable cleaning element 18 with flexible spine 26 and brush element 19 extending therefrom, there are two manners in which the cleaning element 18 may be provided.

Firstly, the cleaning element 18 may be provided dimensioned particularly for application about the head 14 of the apparatus 10 via the curve and hold system, which most preferably is a receiving channel 52 as described with reference to FIGS. 13, 14, 24, 25. If the curve and hold system is the receiving channel 52, in such an embodiment, it would be desirable if the cleaning element 18 (and in particular its flexible spine 26) are dimensioned substantially similarly, or the same, so that the cleaning element 18 fits appropriately into the receiving channel 52. If the receiving channel 52 has end portions 68, a correctly dimensioned cleaning element 18 of such a sort is extremely easy to place for a user, thus guaranteeing perfect placement of the cleaning element 18 for upward and radial cleaning.

Figure 45:
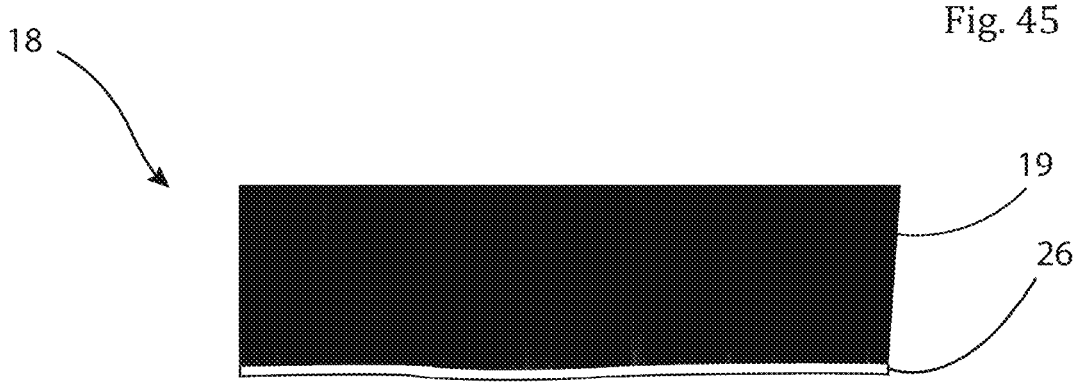
FIG. 45 shows an example of a pre-dimensioned cleaning element, configured for immediate application to, and incorporation with, the apparatus and/or utility tool.

Thus there is shown in FIG. 45 an example of the upward and radial cleaning element 18, wherein it may be provided separately, or as a plurality of cleaning elements 18, for a user, comprising the resiliently flexible spine 26 for applying and curving to the apparatus, and the brush element 19, the cleaning element pre-dimensioned, and configured for immediate application, and incorporation into, the apparatus 10 and/or the utility tool 70.

Figure 46:
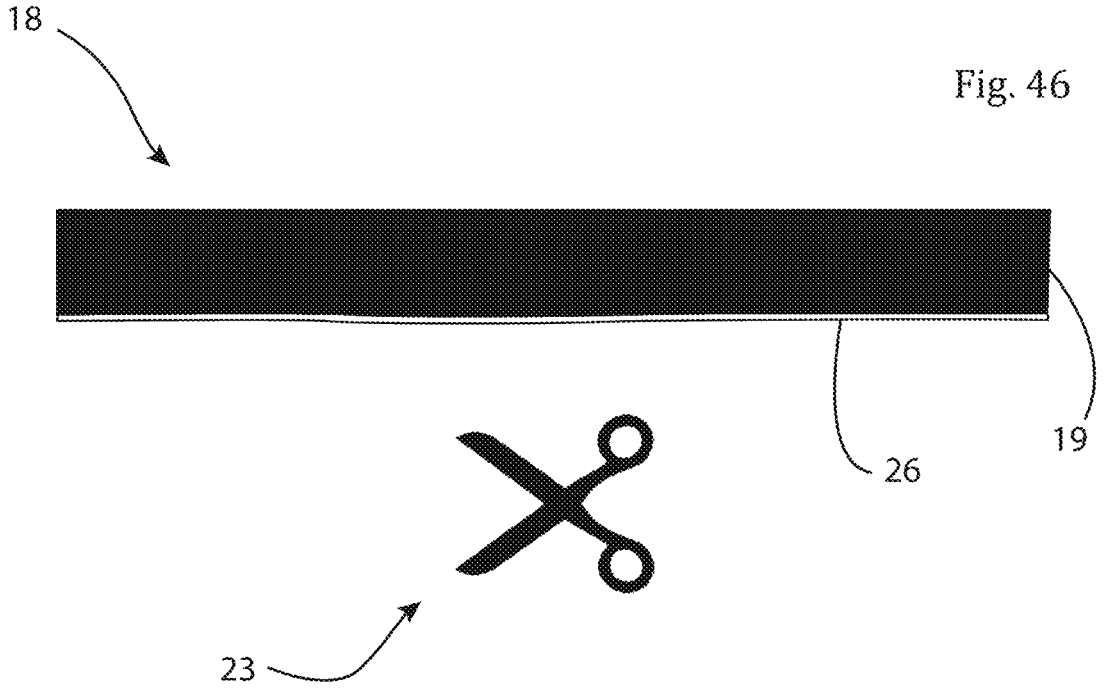
FIG. 46 shows an example of the removably attachable cleaning element, provided as a length for cutting.

In an alternate embodiment of how to supply the removably attachable cleaning element, it may be supplied as a length, for cutting. Thus the length can be cut to the desired length, for application to, or providing an integral part of, the apparatus. Thus there is shown in FIG. 46 a length of the cleaning element for the said cutting. The length may be machine cut or cut, for example, by household scissors 23.

Preferably the cleaning element 18 comprises dramatically resiliently flexible bristles, though it may be any brush element. Preferably the upward and radial cleaning element 18, when applied and/or used as part of the apparatus 18, extends between 3.5 in to 6 in, although it may be of any height.

The cleaning element 18 may include any additional and/or optional features as aforementioned, for example, a treated and/or surfaced portion for enhanced cleaning, which may be treated by way of surfacing with an enhanced cleaning element. As aforementioned, there may be provided as part of the cleaning element 18 a stabilizing member 130, which may be beneficial for stabilizing brush elements that use particularly fine bristles and/or hairs, which may not be resiliently flexible enough to maintain shape and form of the cleaning element 18.

The cleaning element 18 of the apparatus 10 need not be limited to extending upwardly and radially, and, as aforementioned, may be multi angulated, either by way of a multi-partheid cleaning element, or by way of a cleaning element 18 that itself radiates in a plurality of directions. The cleaning element may, for example, be substantially spheroidal, feasibly extending forwardly, and, feasibly, backwardly, and feasibly both.

Figure 47:
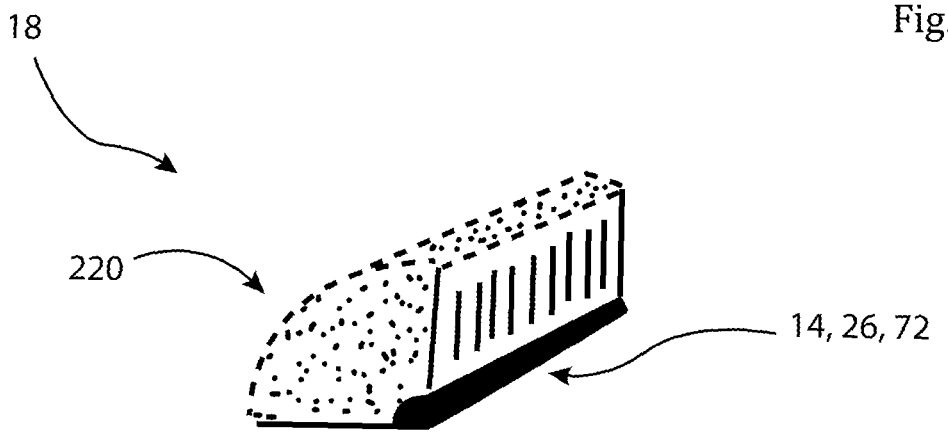
FIG. 47 is an angled perspective side view of the cleaning element, wherein the cleaning element has a forwardly angled curved face.
Figure 48:
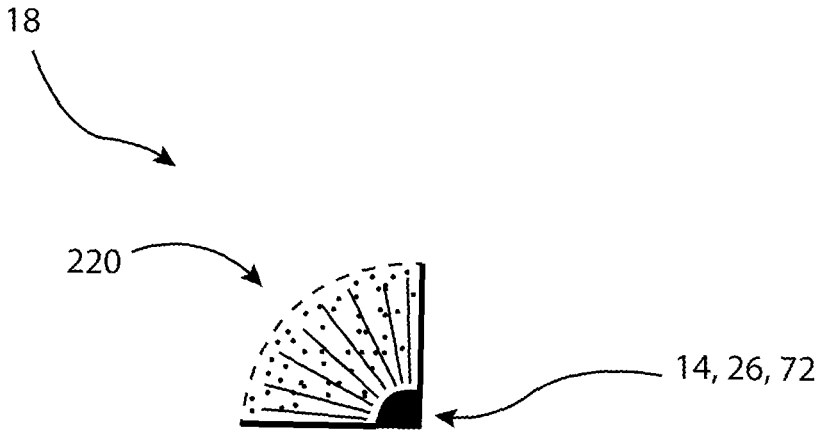
FIG. 48 is a side on sawn off view of the curved face.
Figure 49:
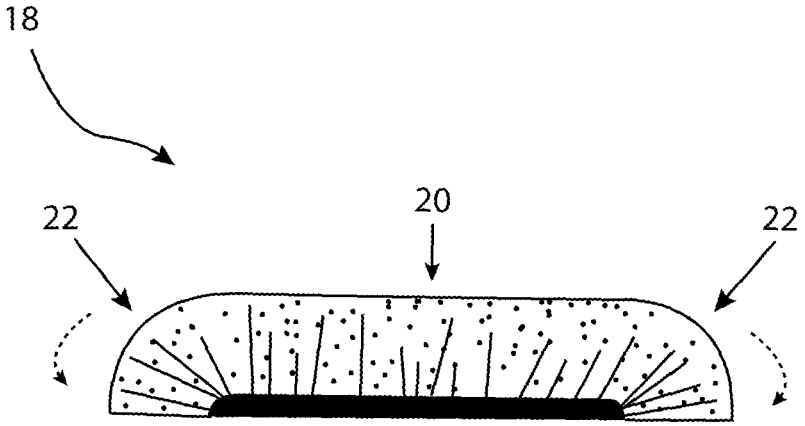
FIG. 49 is a front on view of the curved face.

Thus, with reference to a spheroidal upward and radial cleaning element 18, there is shown in FIGS. 47, 48, 49 an embodiment of the cleaning element 18 (and hence the invention when it incorporates such a cleaning element), where the cleaning element 18, further from simply extending upwardly and radially, now extends forwardly and begins to form a spheroidal shape. The brush element, as aforementioned, may be bristles, hairs, may be sponge type materials, or any other material for brushing a surface.

There is shown in FIG. 47 an angled perspective side view where the radial portions of the cleaning element 18 are sawn off to greater display the forward angulation of the cleaning element 18, which now has a forwardly angled curved face 220. In such an embodiment, the cleaning element 18 may be attached direct to the head 14 of the apparatus, it may have a flexible spine 26 for use as a removably attachable cleaning element 18, or it may be attached and/or attachable to a utility tool base 72.

There is shown in FIG. 48 a side-on sawn off view showing the forwardly angled curved face. There is shown in FIG. 49 a front view of the upward and radial cleaning element 18. Thus it can be seen the cleaning element 18 may retain the familiar fan-shaped effect, extending upward and extending radially, and may also have a forwardly angulated face, thus extending forwardly also. Similarly it may extend backwardly, thus forming a substantially spheroidal shape that resembles a semi-circle. Thus it is seen that an upward and radial cleaning element 18 that comprises a substantially upstanding central portion 20 for upward cleaning, and radially outwardly projecting side portions 22 for radial cleaning, it not limited to extending solely upwardly and radially, and may be multi angulated, taking on spheroidal properties. In certain embodiments, this may lead to engagement with still more surfaces for cleaning, which may be beneficial. It may also serve to better retain shape and form for the cleaning element 18, particularly if the cleaning element 18 employs fine hairs, bristles and the like, the said fine hair, bristles and the like propping each other up due to their spheroidalness, thus retaining shape and form of the cleaning element 18.

As aforementioned, any cleaning element 18 of such a configuration may be attached directly to the head 14 of the apparatus 10, for example non-removably, may have a flexible spine 26 for removably attaching to the head of the apparatus via a hold and curve system as aforedescribed, and may be incorporated onto a removably attachable utility tool, as aforedescribed. If it is attached to a utility tool, the grip of the utility tool may be dimensioned so that it is easily grippable by a user.

In an alternative embodiment, the cleaning element 18 may comprise a brush element 19 and a stabilizing member 130. The stabilizing member 130 may feasibly act as (and therefore be) a flexible spine, with resiliently flexible qualities. It is thus feasible the stabilizing member 130 may be curved to form the upward and radial portions of the cleaning element 18, or it is feasible that the upward and radial portions may be pre-configured via angulated embedding, as shown in FIGS. 30 and 31, which facilitates, if so desired, a flat bottom for the stabilizing member 130. It is also feasible that the bottom of the stabilizing member 130 is adhered to a base plate, which may, for example, be a thin base of plastic, that may be attachable to the head 14 of the apparatus 10, thus forming the present invention 10. The stabilizing member 130, in such an embodiment, may be glued to the base plate, or attached in any other way. A base plate is differentiated from a tool base 72 as it may, for example, be particularly thin, and may therefore not be configured substantially for gripping and separate use as a handheld tool by a user. It may, however, facilitate secure attachment of the cleaning element 18 to the apparatus 10, for example via a clipping mechanism, where it clips on to the apparatus 19, or any other method and/or means of attachment. Thus the cleaning element (including the base plate) may be removably attachable and disposable.

Figure 50:
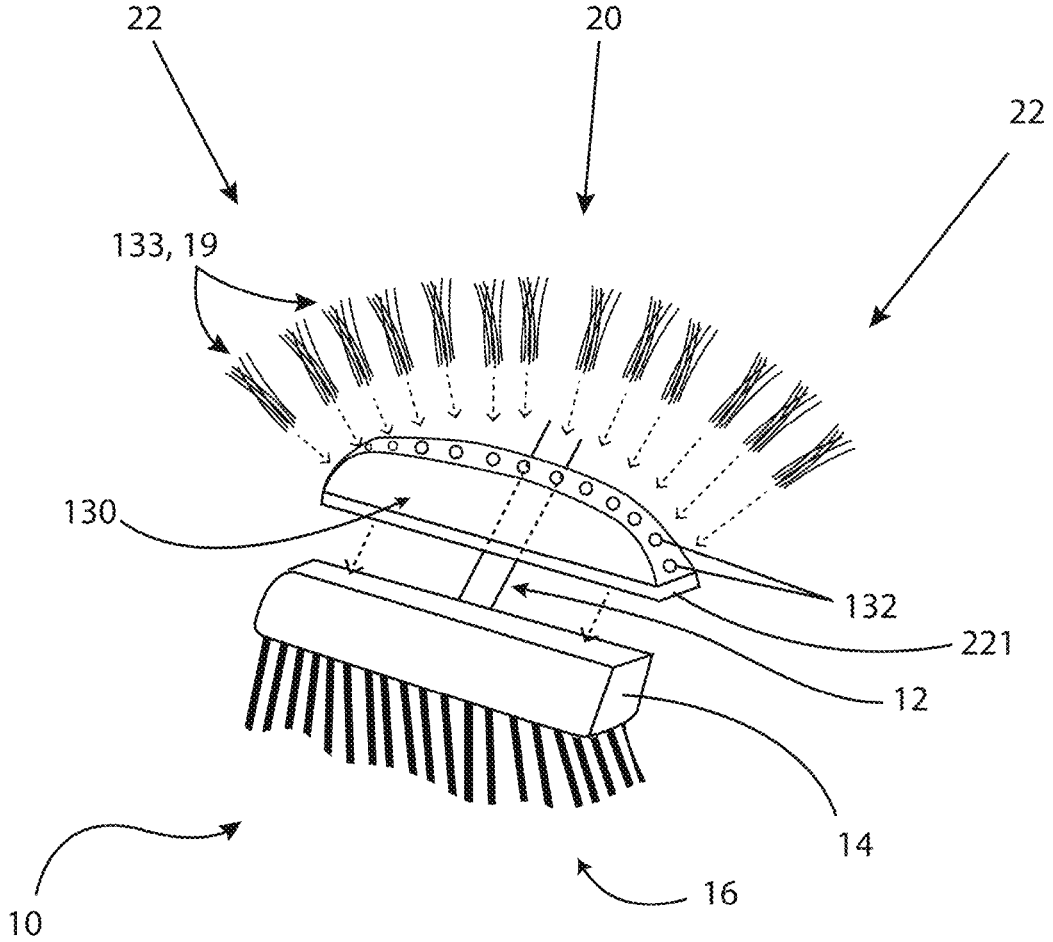
FIG. 50 shows an embodiment of the cleaning element wherein the cleaning element incorporates a base plate, the base plate removably attachable from the cleaning apparatus.

There is shown in FIG. 50 an embodiment of the invention 10, wherein there is provided a removably attachable base plate 221 for at least one of: the central portion of; a whole of, the cleaning element, the base plate 221 being removably attachable from the head 14 of the apparatus 10, there being provided an attachment mechanism for secure attaching of the base plate 221 to the head 14 of the apparatus 10, the at least one of the central portion of; a whole of, the cleaning element 18 attached to the base plate 221, and thus removably attachable from the apparatus. (The attachment mechanism is not shown but may be any attachment means and/or method for attaching the base plate 221 to the head 14 of the apparatus 10, and is preferably a clipping mechanism so that the base plate 221 can be removably attachably clipped to the head 14 of the apparatus).

In the example embodiment, a whole of the cleaning element 18 (both the central portion 20 and the radial portions 22) is attached to the base plate 221. However, in an embodiment of the invention 10 which features a multi-partheid cleaning element, which, for example, has radial whiskers, the central portion 20 of the cleaning element 18 being separately removably attachable from the apparatus 10, it is feasibly solely the central portion 20 is attached to the removably attachable base plate 221.

In the example embodiment as shown, there is further provided a stabilizing member 130, the at least one of the central portion of; a whole of, the cleaning element 18 attached to the base plate 221 via the stabilizing member 130. Preferably the base plate is of substantially thin plastics materials. As aforementioned, the cleaning element may be spheroidal, multi-angulated, etc.

Figure 51:
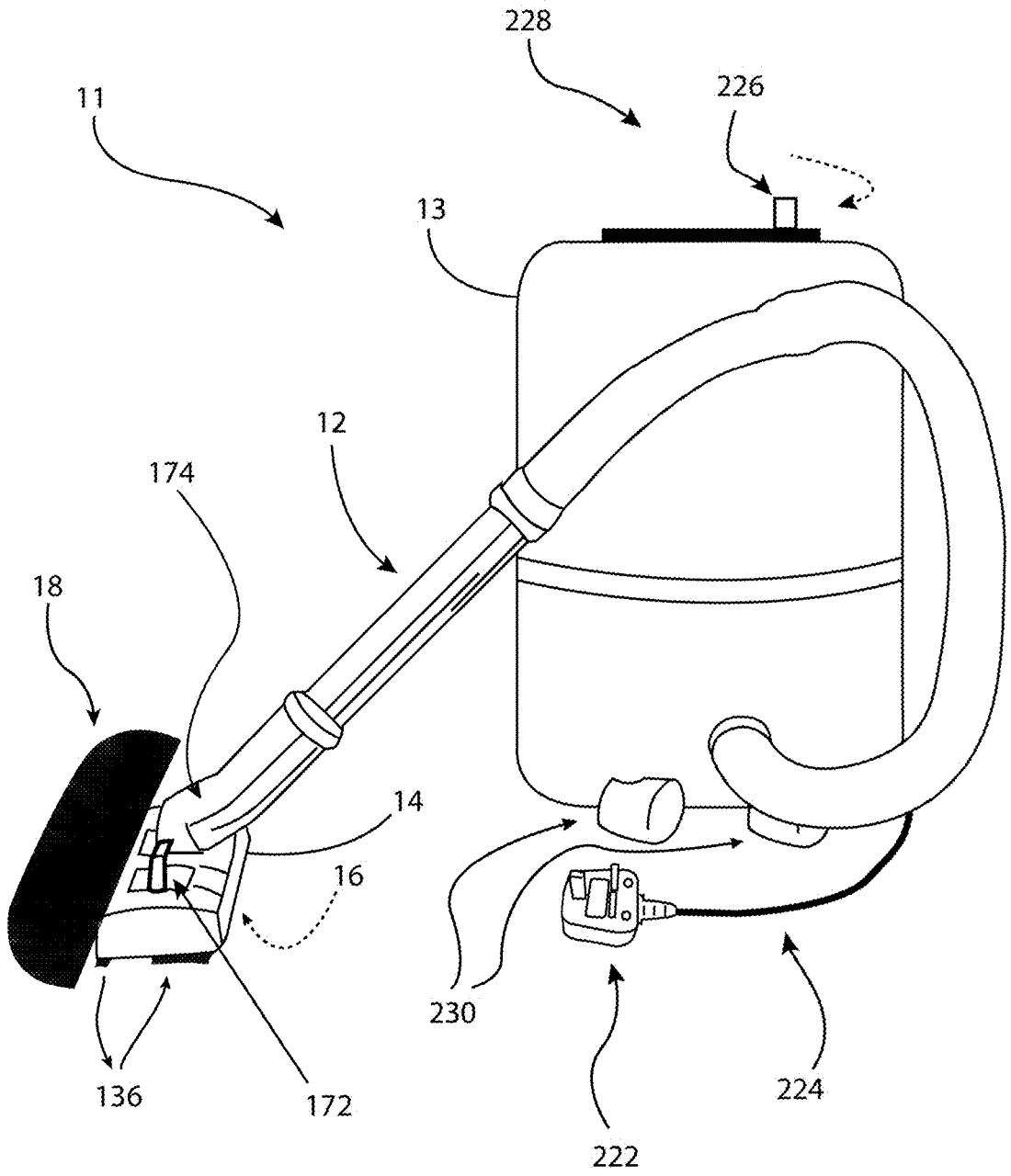
FIG. 51 shows a canister vacuum cleaning apparatus.

As aforementioned, the invention 10 may be particular beneficial when the apparatus 10 is a canister-type vacuum cleaner. Thus there is provided in FIG. 51 a canister vacuum cleaning apparatus 11, comprising a canister 13, a suction system for generating suction, a wand head 14, a wand handle for holding 12, a downward facing suction element 16 on a bottom side of the head 14 for downward suction cleaning of a surface, the head 14 further defined as being non-rotatable about the suction element 16, non-rotatable so that a bottom side of the head 14 and a top side of the head 14 cannot be interchangeably used with the suction element 16, a pivoting mechanism 174 so that the wand head is pivotable, an interchangeably retractable and projectable downward facing brush element 136, retractable and projectable from the bottom side of the wand head 14 for use with the suction element 16, thus optimizing the apparatus 11 for effective suction cleaning on alternate surfacing, a selecting element 172, selectable by a user, for interchangeably retracting and projecting the downward facing brush element 136 from the bottom side of the wand head 14; and an upward and radial cleaning element 18, said upward and radial cleaning element comprising a substantially upstanding central portion 20 for upward cleaning, and radially outwardly projecting side portions 22 for radial cleaning, the upward and radial cleaning element 18 being distinctly separate from the downward facing suction element 16, and comprising dramatically resiliently flexible bristles, said bristles configured for optimal upward and radial cleaning of low lying upward surfaces, and high lying upward surfaces, dramatically flexibly bending on contact with an engaged surface thus not blocking the wand head 14 from accessing areas for cleaning, and resiliently returning to an original position once removed from said engaged surface, the upward and radial cleaning element 18 attached, or attachable, substantially upstandingly to the wand head 14, the cleaning apparatus thus configured for upward and radially extending cleaning of a surface, whilst simultaneously downwardly cleaning via the downward facing suction element 16, in a same movement, the apparatus 11 thus configured for cleaning of a significantly greater amount of surfaces than a standard canister vacuum cleaning apparatus.

The invention 11 is thus differentiated from other art in the field which has upstanding bristles which are used with rotatable wand heads for use, and contact with, the floor.

Preferably the cleaning element 18 is extravagantly colorized, for example in a green color, which may aid attractiveness, provoke more use of the element by a user, and help display (through visibility of dirt) when the cleaning element needs replacing. The apparatus 11 may employ a removably attachable cleaning element 18, may employ a removably attachable utility tool 70, and may have a non-removable cleaning element.

Preferably the apparatus 11 is able to engage and clean extraneous adjacent surfaces as aforedescribed. The cleaning element 18 may be forwardly angled, and may be movable forwardly and backwardly by a user, preferably via a movement selecting element 82.

There is shown a plug 222 and cable 224 and a cable retraction system 228 on the canister 13, whereby a knob 226 can be rotated to retract the cable 224. The canister 13 may have wheels 230 for movement.

It will be obvious to those with skill in the art of such apparatuses that a plurality of wand head attachments are often provided that are selectably interchangeably attachable for different cleaning and/or suction jobs. Thus there may be provided a plurality of wand head attachments, which may also either integrally have, or have means of attachment for, the upward and radial cleaning element 18.

As shown in FIG. 29, the floor cleaning apparatus may have radial whiskers 23 alone (no central portion), providing a head 14; a downward facing cleaning element 16 on the head 14 for cleaning of a ground surface; a first radial whisker 23 on a lateral side of the head 14; and a second radial whisker 23 on an opposing lateral side of the head 14.

Figure 52:
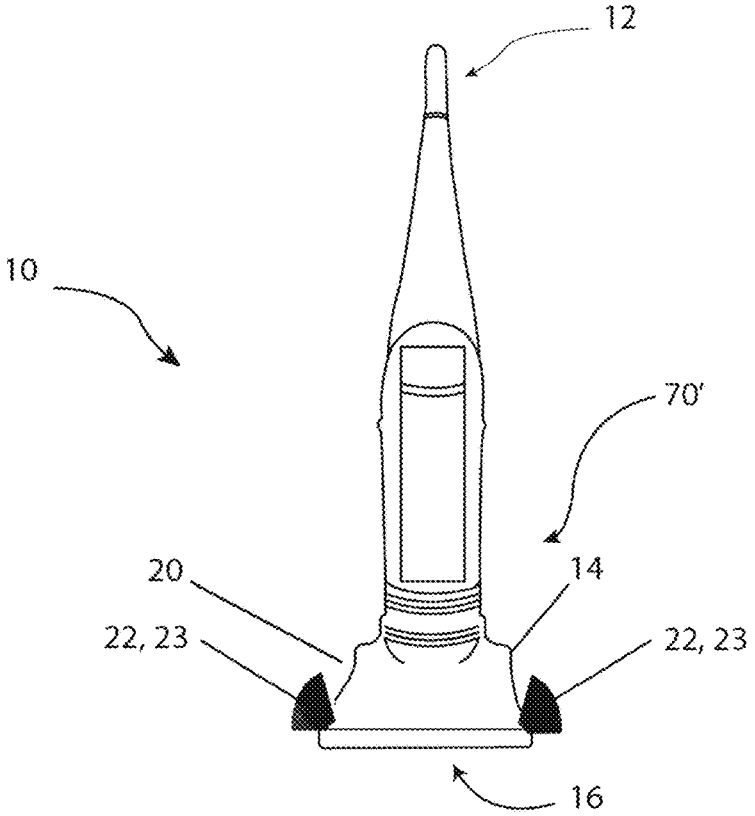
FIG. 52 is a front-on view of a floor cleaning apparatus with radial whiskers.

FIG. 52 shows such an embodiment, with a first left radial whisker 23 protruding from one lateral side of the head 14, protruding upward and outward from the head 14, thus being able to clean outwardly outside a dimension of the head 14, and diagonally upwardly up and outside a dimension of the head 14. There is also provided a similar or identical right radial whisker 23 on an opposing lateral side of the head 14.

Figure 53:
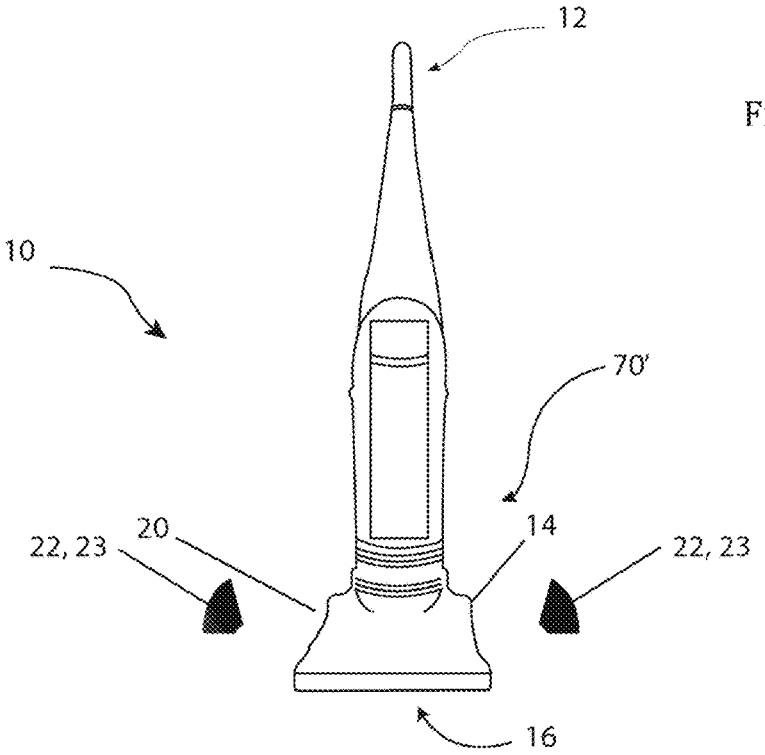
FIG. 53 is a front-on view of a same or similar embodiment to FIG. 52, wherein the radial whiskers are shown to be removably attachable.

The radial whisker(s) 23 may be removably attachable (and thus replaceable) as shown in FIG. 53. (Either or both of the first radial whisker and second radial whisker may be removable from the head).

Figure 54:
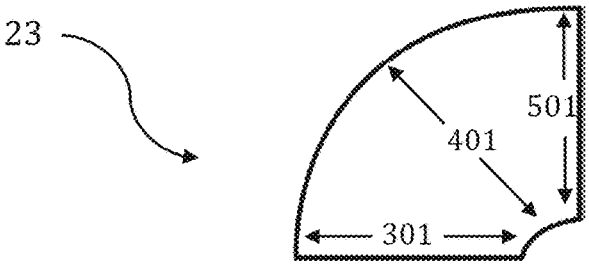
FIG. 54 is a close-up view of a preferred embodiment of a radial whisker.

Preferably the radial whisker 23 extends (and is therefore able to clean) substantially sidewardly to 90 degrees, and extends substantially vertically upwardly from the head 14 (and most preferably substantially at all angles in between). Such a preferred embodiment of the (or a) radial whisker 23 is shown in FIG. 54. The shown radial whisker 23 is configured (and has brush element) so that it can clean outwardly substantially sideways to an angle of substantially 90 degrees (denoted by arrowed line 301), diagonally (upwardly and outwardly) (denoted by arrowed line 401) and substantially vertically upwardly (denoted by arrowed line 501).

Figure 55:
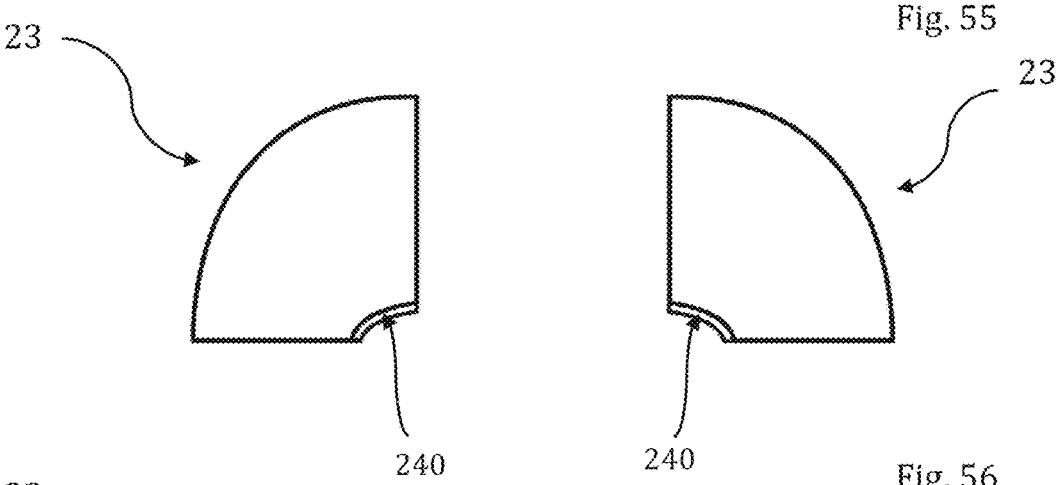
FIG. 55 shows the radial whiskers with spine elements.

As shown in FIG. 55, the radial whisker(s) 23 may have a spine element 240, which may be a flexible spine 26 (in which case the head 14 of the apparatus 10 may include a hold and curve system for receiving, holding, and curving the flexible spine 26, which hold and curve system may, for example, be a receiving channel configured to receive and bend the flexible spine, thus forming the radial curvature of the radial whisker 23 brush element, or, for example, the spine element 240 may be a rigid curved spine 72', in which case there may be provided an attachment mechanism (which may be any suitable attachment means) for attaching and/or clipping the radial whisker 23 onto the head 14 of the apparatus 10 (and most preferably on top a lateral side of the head 14 of the apparatus 10) so that the radial whisker 23 extends outwardly (and preferably also substantially upwardly) from the head 14 of the apparatus 10, thus being able to engage surfaces (and thus clean) substantially upwardly and outwardly from the head 14 of the cleaning apparatus.

The radial whisker(s) may have any spine element 240, such as a base plate, etc, which need not be linear and thin and may be wide and broad, and may be of any shape and dimension. The brush element of the radial whisker 23 may be spheroidal, thus having a greater surface area for engagement (and thus cleaning) of surfaces. The brush element of the radial whisker 23 may comprise any material, for example bristles, hairs, foam. Thus it may comprise any material for brushing.

Figure 56:
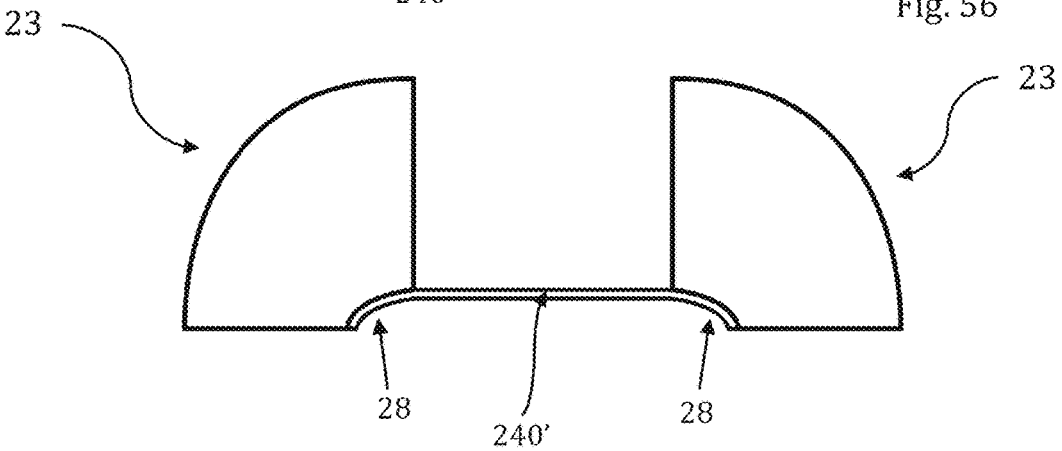
FIG. 56 is a front view of the radial whiskers where there is provided a spine element conjoining the radial whiskers, curved at its lateral ends.

As shown in FIG. 56, there may be provided a spine element 240' conjoining two opposing radial whiskers 23. The spine element 240' may, for example, be a flexible spine 26, in which case the apparatus may comprise a hold and curve system for receiving, holding, and curving the flexible spine at its lateral ends 28, which may, for example, be a receiving channel configured to receive and bend the flexible spine at its lateral ends 28, thus forming the radial curvature of the radial whiskers' 23 brush elements). The spine element 240' may be a rigid curved spine 72', which may, for example, be metallic, or plastic, and curved at its lateral ends 28, thus forming the radial curvature of the radial whiskers' brush elements. In such an embodiment, there may be provided a clipping mechanism 78 (or any attachment mechanism), where the spine element 240' can be clipped into the head 14 of the apparatus 10 (preferably removably attachably), thus holding it. Preferably the spine 240' (and thus the radial whiskers 23) can be unclipped (and thus removed/replaced), allowing for a new set of radial whiskers with a spine element conjoining the two opposing radial whiskers to be attached to the head 14 of the apparatus 10. Thus for this, or any other, embodiment, the radial whiskers 23 may be removably attachable and replaceable.

In such an embodiment where the spine element 240' can be clipped into (or onto) the head of the apparatus, it is feasible there is provided a placement cavity and/or channel in the head 14 that the spine element 240' can clip into, thus holding the spine element 240' (and thus holding the radial whiskers 23). In such an embodiment, the spine element 240' may thus not protrude from the head 14 of the apparatus 10, but may be held within it, which may be preferable to better hold the spine element 240' and prevent the spine element engaging and contacting surfaces for cleaning. Such a placement cavity and/or channel may have clip(s) 78 in or about the cavity and/or channel so that the spine element 240' can be clipped into the cavity and/or channel, thus being held. The clip(s) 78 may, for example, be substantially circular. The clip(s) 78 may be resiliently flexible in order to resiliently open to receive the spine element 240', and resiliently close to hold the spine element 240'. There may be provided an unclipping mechanism on the head 14 of the apparatus 10, which may be a manual unclipping mechanism such as a switch, etc., which may facilitate unclipping of the spine element 240' (and thus removal of the radial whisker(s) 23) from the head 14 of the apparatus 10. Such a system may also be used for an embodiment where the radial whiskers 23 have separate (and shorter) spine element(s), (as shown in FIG. 55), in which case, there may, for example, be provided a placement cavity and/or channel on each lateral end of the head 14 for each radial whisker 23 spine element 240, and a clip 78 at each lateral end of the head 14 for each spine element 240 of the radial whiskers 23. Such an embodiment may have a placement cavity and/or channel for each radial whisker 23, or may have one placement cavity and/or channel along a length of the head 14, with a clip 78 (or other attachment mechanism for attaching the radial whisker 23.

Figure 57:
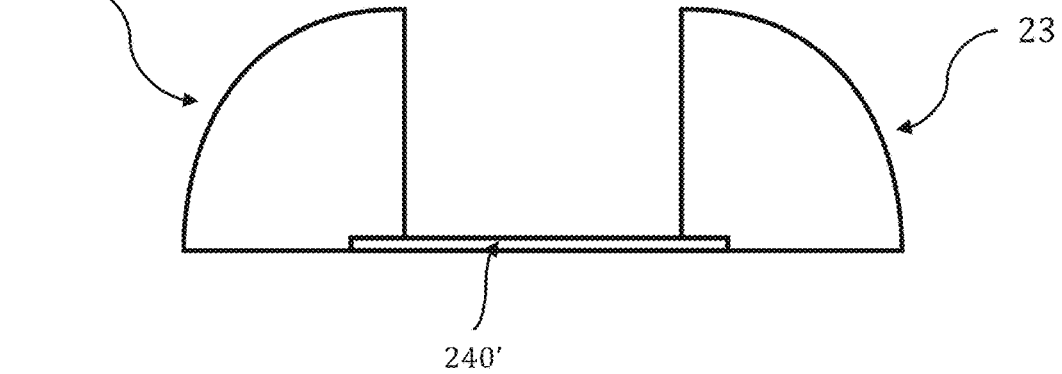
FIG. 57 is a front view of a similar embodiment to FIG. 56, wherein the spine element is straight.

There is shown in FIG. 57, an embodiment where the spine element 240' conjoining two opposing radial whiskers 23 is straight and not curved. This may be a flexible spine, or may be rigid.

It is feasible in such embodiments that the radial whiskers may be used as a separate handheld cleaning tool. There may be provided a base for the radial whiskers 23, similarly as aforementioned, described and stated for an upward and radial cleaning element. Any spine or base for a radial whisker(s) 23 may be of any dimensions, shape, proportions, broadness.

Figure 58:
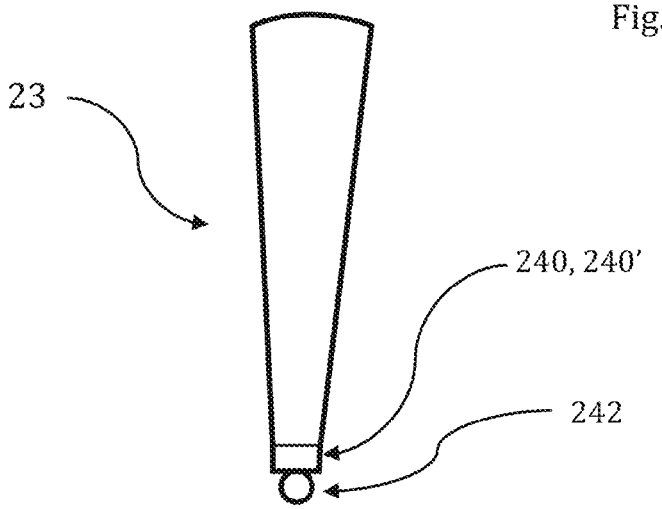
FIG. 58 is a side-on view of a radial whisker where there is provided an attachment aperture to facilitate attachment of the radial whisker to the apparatus.

There is shown in FIG. 58 a side-on view of a feasible embodiment of the radial whisker 23, where there is provided an attachment ringlet 242 for the radial whisker(s) 23. The radial whisker 23, in the shown embodiment, has a flexible spine. Attached to (or part of, or in any way used and/or provided in conjunction with) the flexible spine is an attachment aperture 242 (which is preferably a ringlet and/or a ringlet shape), which may be an aperture 242 that runs along a length of the spine (for example, it may comprise fabric material with an aperture 242 through the fabric material, similar to how curtains that are for fitting on a rod often have an aperture that runs along a length of one end of the curtain—thus allowing the curtain to be threaded onto the rod). In varying embodiments, the aperture 242 may be an aperture 242 in the spine element 240, 240'.

In such an embodiment, there may be provided an attachment rod (preferably within a channel) on a lateral side(s) of the head 14 of the apparatus 10—preferably on each lateral side of the head 14 of the apparatus 10, each lateral side thus having a channel, with an attachment rod in the channel, so that the attachment aperture 242 (which is preferably an attachment ringlet aperture 242) of the (or each) radial whisker(s) 23 can be threaded onto the attachment rod. The attachment rod may be plastic or any material, and is preferably curved at a most lateral end of the head 14 of the apparatus 10, so that the radial whisker spine element 240, in being threaded onto the rod via the attachment aperture 242 (which is preferably an attachment ringlet aperture 242) is curved, thus forming the radial curvature of the radial whisker brush element. Thus the radial whisker 23 may be threaded onto the rod via the attachment aperture 242 (which is preferably an attachment ringlet aperture 242), preferably placed and shaped for substantially sideways and upwards cleaning, as shown for radial whiskers 23 in FIG. 29.

Figure 59:
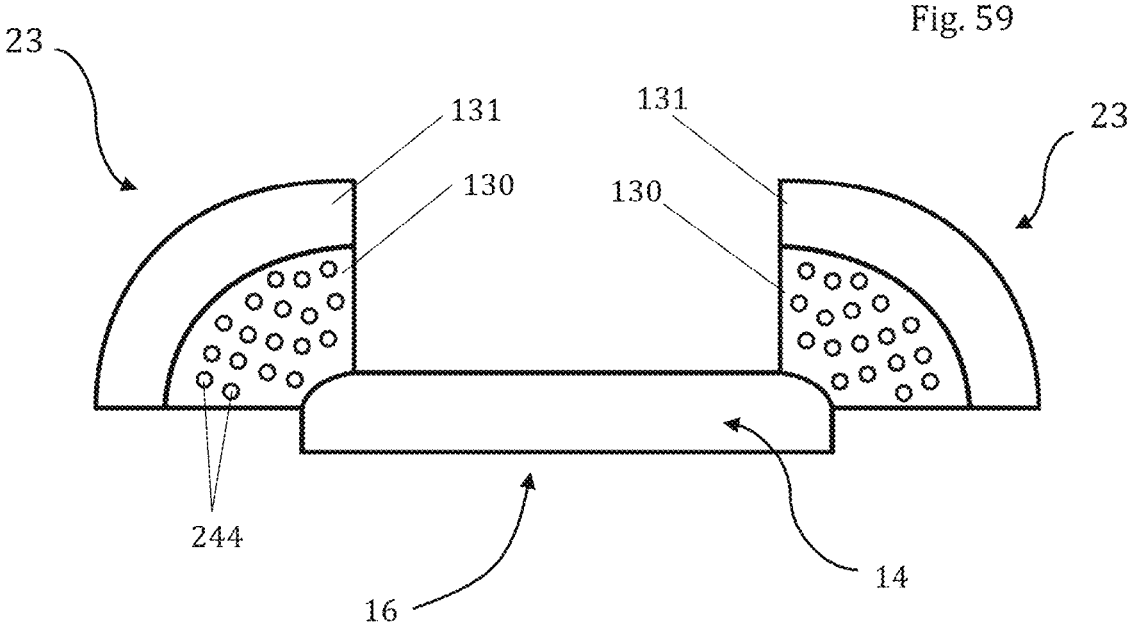
FIG. 59 shows an embodiment where the radial whiskers comprise a stabilizing member.

As shown in FIG. 59, the radial whiskers 23 brush element may incorporate a stabilizing member 130, which may, for example, be foam, sponge-type material and the like (dotted circles 244 shown in the stabilizing member 130 are used to artistically denote that the stabilizing member may be foam, sponge and the like). This may aid stabilization if fine hairs, bristles, etc. are used for the top portion 131 of the radial whisker 23. Foam, sponge, etc. may be useful for use as the stabilizing member due to flexible characteristics of such materials; thus the stabilizing member 130 may be resiliently flexible and/or displaceable so that it does not block the head 14 of the apparatus 10 when it (the stabilizing member 130) engages a surface, but instead is resiliently displaced, allowing the head 14 (and thus the radial whiskers 23) to gain access to further areas for cleaning. Such a configuration may allow for particularly fine hairs, or any particularly fine brush element to be used for the top portion 131 of the radial whisker(s) 23, which may otherwise lose their shape or cleaning effectiveness if a stabilizing member 130 was not provided.

If there is provided a stabilizing member 130 and/or the radial whisker comprises a stabilizing member 130 and a top portion 131 (which may comprise fine hairs, etc.), the top portion 131 may, for example, be embedded into the stabilizing member 130 (e.g. bristles embedded into foam). Alternatively, (or more broadly described), the top portion 131 may be attached and/or attachable to the stabilizing member 130—for example, the top portion 131 may be provided separately (to a user), and may have an adhesive side, for example with a cover to cover the adhesive side (similar to how a band-aid has a cover which can be removed to reveal an adhesive side). The cover may then be removed to reveal the adhesive side, which adhesive side may then be applied to the stabilizing member 130 so that the top portion 131 is adhered and/or attached to the stabilizing member 130. Any attachment mechanism and/or means may be used. For example, a hook and loop (e.g. Velcro) attachment means may be provided to facilitate attachment of the top portion 131 to the stabilizing member 130 in such embodiments. The stabilizing member may be permanently (or substantially permanently) attached to the head of the apparatus, or may be removably attachable.

The radial whisker(s) 23 may be of any size, length, depth, girth, and may be provided for any floor cleaning apparatus, such as robotic cleaning devices, which may be robotic vacuum cleaners.

Figure 60:
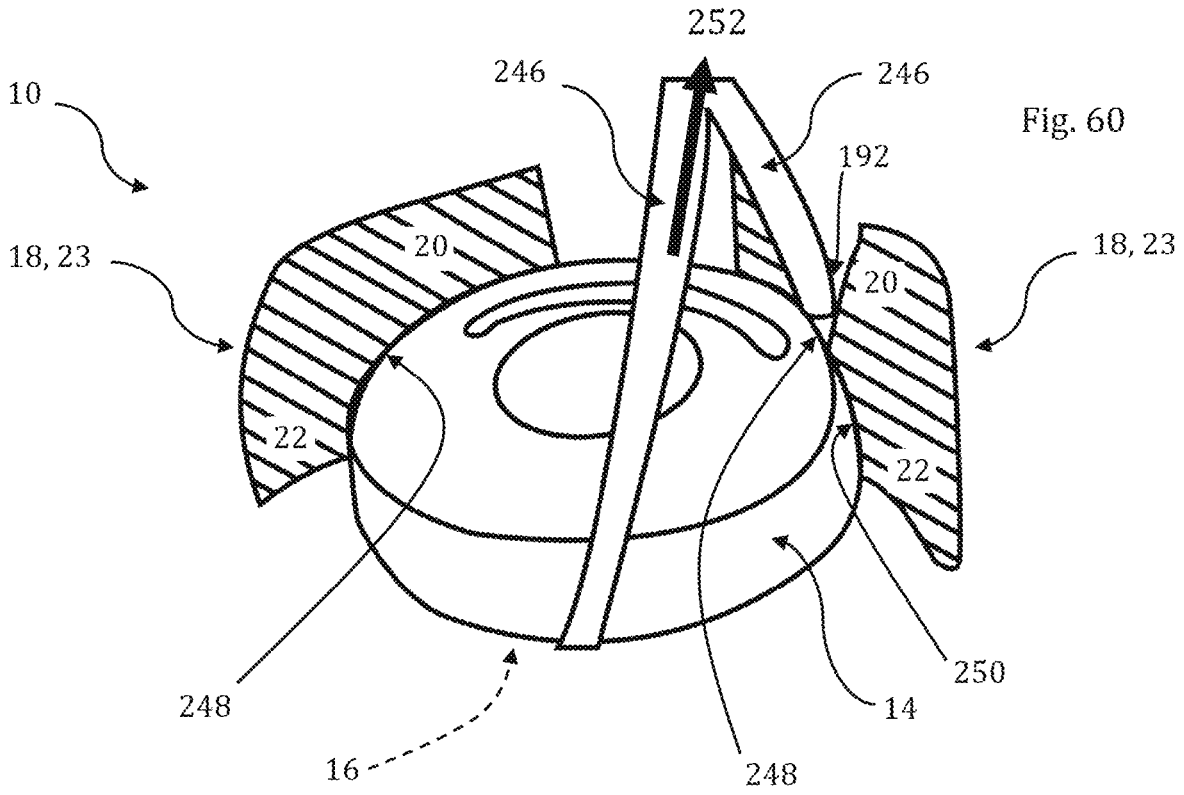
FIG. 60 is a perspective view of a robotic embodiment.

There is shown in FIG. 60 a robotic (for example, automated) floor cleaning apparatus 10, which has a head 14 (which typically holds circuitry, electronics, etc inside), and has a downward facing cleaning element 16, which is preferably a vacuum suction downward facing cleaning element 16 (dashed arrow denotes downward facing cleaning element 16 is not visible from the shown angle). The robotic floor cleaning apparatus 10 has two upward and radial cleaning elements 18, each element 18 having a substantially upstanding central portion 20 (configured primarily for substantially upward cleaning), and a radially outwardly projecting side portion 22 (configured primarily for substantially upward and outward cleaning from the head 14 of the apparatus 10). In the shown embodiment, the shape of the cleaning elements 18 is achieved via a flexible spine 26, the spine 26 secured and held in the head of the robotic floor cleaning apparatus 10 in such a way that the cleaning element 18 extends upwardly (and slightly outwardly) from a circumferential rim 248 of the head 14 of the robotic floor cleaning apparatus. The flexible spine 26 is trapped in the rim 248, and is then curved round downwardly onto a side surface 250 of the head 14, thus forming the radial outwardly projecting side portions 22 of the cleaning elements 18.

Use of a flexible spine 26 is provided by way of example only. There are many ways to achieve such a result as will be obvious to those with skill in the art, such as (substantially) rigid curved spine, base plate, etc, which may be pre-shaped and thus not require, or not significantly require, manipulation.

However, due to the design/shape of the apparatus head 14, each upward and radial cleaning element 18 may also be said to be (and/or defined as) a radial whisker 23, since there is a central gap between the two cleaning elements 18, and the cleaning elements 18 both clean outwardly (thus performing function of a radial whisker 23). Direction the robotic floor cleaning apparatus 10 is travelling is denoted by enlarged arrow and number 252—(such robotic floor cleaning apparatuses typically tend to move in only one direction, and rotate if they need to move in an alternate direction). Thus from a front view and viewed at eye-level, the cleaning elements 18, the cleaning elements may be said to be radial whiskers 23.

As stated, in the shown example, the robotic floor cleaning apparatus 10 is travelling in direction 252, and is located under a chair, which has shown chair legs 246. Right cleaning element 18 of the floor cleaning apparatus 10 has engaged a chair leg 246, resultant in a portion of the cleaning element 18 being displaced, creating a bowed portion 192 (which may also be described as a 'displaced portion' 192).

Nevertheless, the cleaning element 18 in the shown example is resiliently displaceable and has a capacity to resiliently return to an original position once engagement ceases.

Figure 61:
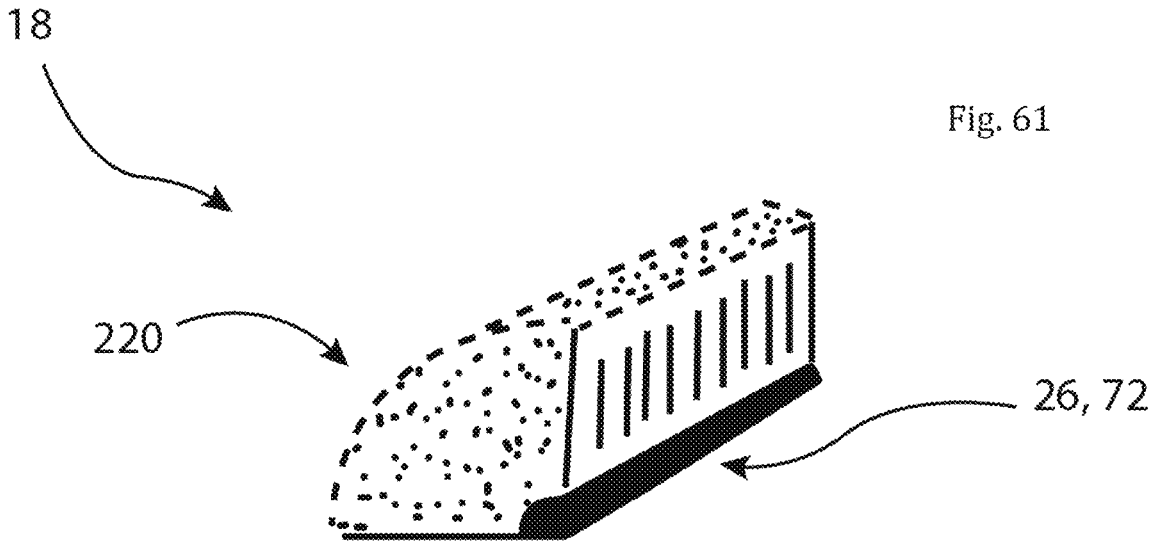
FIG. 61 is a side-on perspective view of a spheroidal cleaning element.

There is shown in FIG. 61 a cleaning element having a forwardly angled curved face 220, thus being substantially spheroidal. There is provided a spine element, which may be a flexible spine 26, a base 72, a base plate, or any other spine element, and for the present example (shown by way of example only) may be a flexible spine 26 made of foam.

Figure 62:
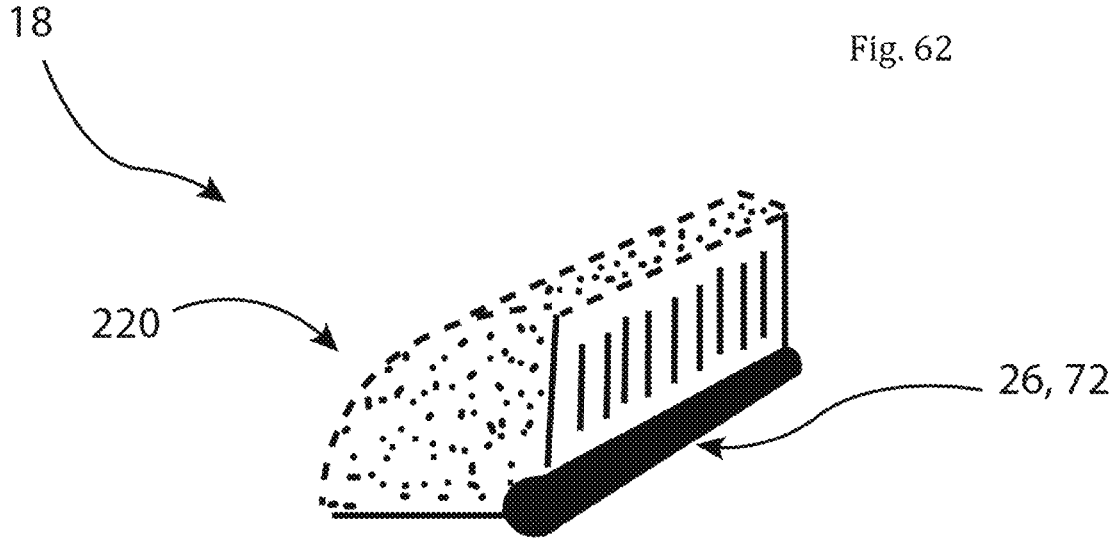
FIG. 62 is a side-on perspective view of the same cleaning element of FIG. 61, wherein the spine element of the cleaning element is rounded.
Figure 63:
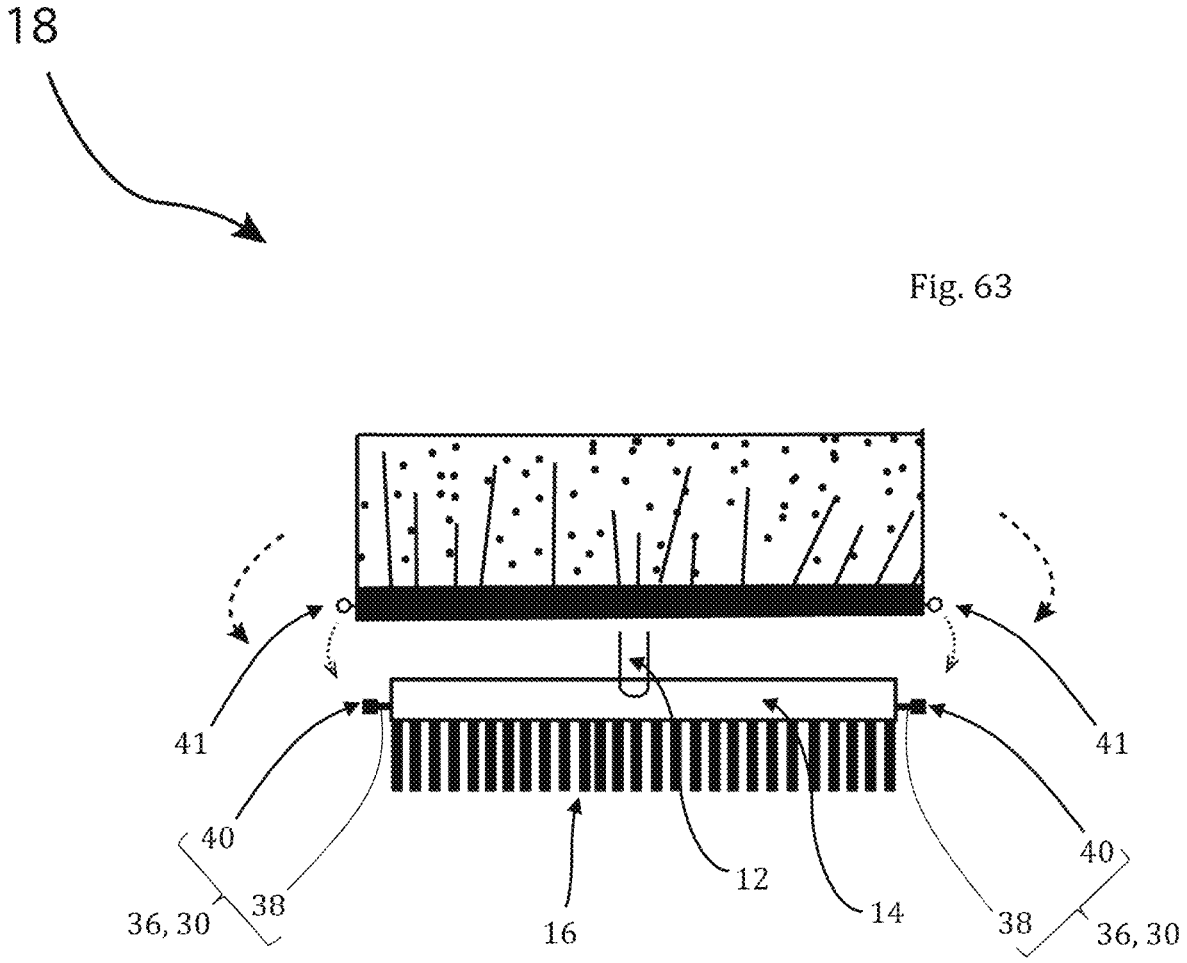
FIG. 63 is a front view of an attachment mechanism and/or means for attaching the cleaning element of FIGS. 61 and 62 to the head of the apparatus.

A similar such cleaning element 18 is shown in FIG. 62, where the spine is rotunded (rounded). The same cleaning element 18 is shown in FIG. 63 from a back view. There are provided ringlets 41 at lateral ends 28 of the flexible spine 26 (which in the shown example may be a flexible foam spine). At each lateral end of the head 14 of the floor cleaning apparatus 10 are provided attaching barbs 36, which in the shown example comprise a protruding shaft 38 and a shaped head 40. Intent is for the ringlets 41 to be secured over the attaching barbs 36, attaching barbs thus being provided as constraining elements 30 for the flexible spine 26.

The attachment means shown is shown by way of example only, and any attachment mechanism and/or means under the sun may be used, such as, for example, hook and loop (Velcro-type) solutions, etc, or any other method.

As will be shown, intent is to wrap the flexible spine 26 around the head 14 of the apparatus 10 from a front position, thus creating a substantially upstanding central portion 20 and radial outward portions 22.

Figure 64:
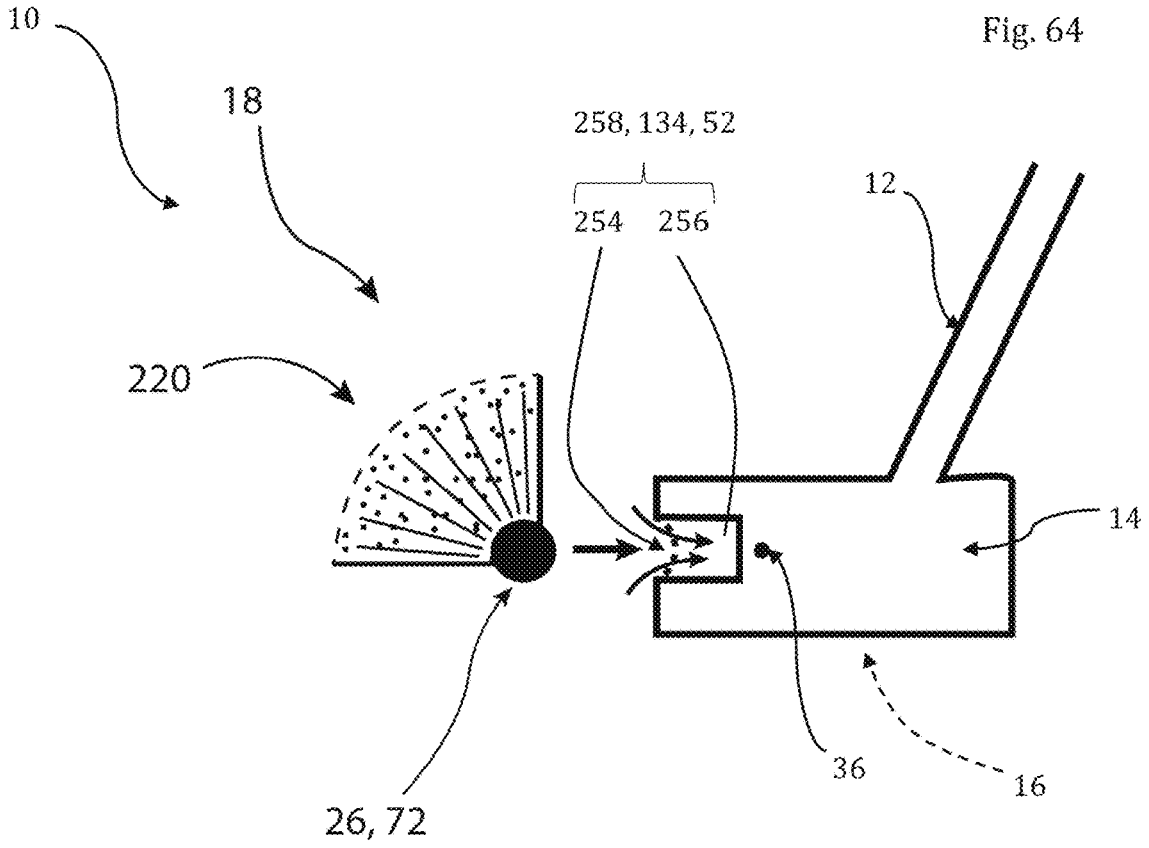
FIG. 64 is a side-on view of the attachment mechanism and/or means of FIG. 63.

Thus there is shown in FIG. 64 the same cleaning element 18 prior to being applied/attached to the head 14 of the floor cleaning apparatus 10. An arrow from the flexible spine 26 denotes that the, preferably foam, flexible spine is intended for application into a guide cavity 258 (which could also be defined as a placement cavity 134 or a channel, receiving channel 52). The guide cavity is slightly rotunded (rounded) thus shaped to receive the rotunded flexible spine 26 of the cleaning element, although the guide cavity 258 and spine 26 of the cleaning element may be of any shape, size, dimension, etc. The cleaning element may be removably attachable and thus replaceable.

The guide cavity 258 has a front receiving portion 254 and a side receiving portion 256. In the shown example, there is provided an attaching barb 36 to constrain the flexible spine 26 in place. Intent is that the spine 26 of the cleaning element 18 is constrained, the ringlets 41 looping over and held on the attaching barb 36, the guide cavity 258 helping guarantee correct positioning and holding of the cleaning element. The attachment mechanism is shown by way of example only, and any attachment means under the sun may be provided. The apparatus 10 is shown in the example with use for a wand head for a vacuum canister cleaner, however, the apparatus may be any floor cleaning apparatus, for example a robotic apparatus, etc.

Because the guide cavity 258 has a front receiving portion 254, and a side receiving portion 256, when attached to the head 14 of the apparatus 10, the example cleaning element 18 cleans forwardly, upwardly, and outwardly from the head of the apparatus 10.

Figure 65:
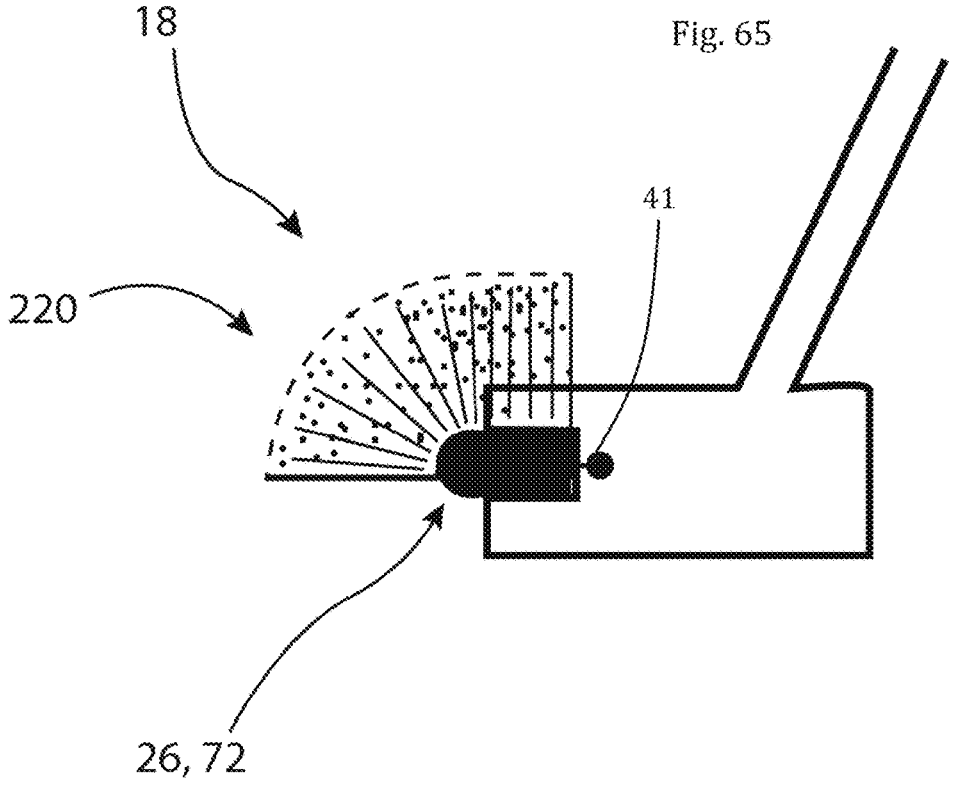
FIG. 65 shows the embodiment of FIG. 64 with the cleaning element attached.

There is shown in FIG. 65 (from a same side view as FIG. 64) the cleaning element 18 attached to the head of the apparatus 10 via the attaching barb 36. The ringlet 41 has been hooked over the attaching barb 36. The flexible spine 26 has been wrapped around the head 14 of the apparatus, and thus the cleaning element now extends forwardly and upwardly from a front of the head of the apparatus (ie from the front receiving portion 254 of the guide cavity 258), and extends outwardly and upwardly from a side of the head 14 (ie from the side receiving portion 256 of the guide cavity 258), and also extends in a plurality of angles in between. It is feasible, rather than being received into a cavity/channel, that the cleaning element is clipped or attached about or outside of the head of the apparatus. This may be achieved, for example, via a clipping mechanism, or any other attachment means.

Figure 66:
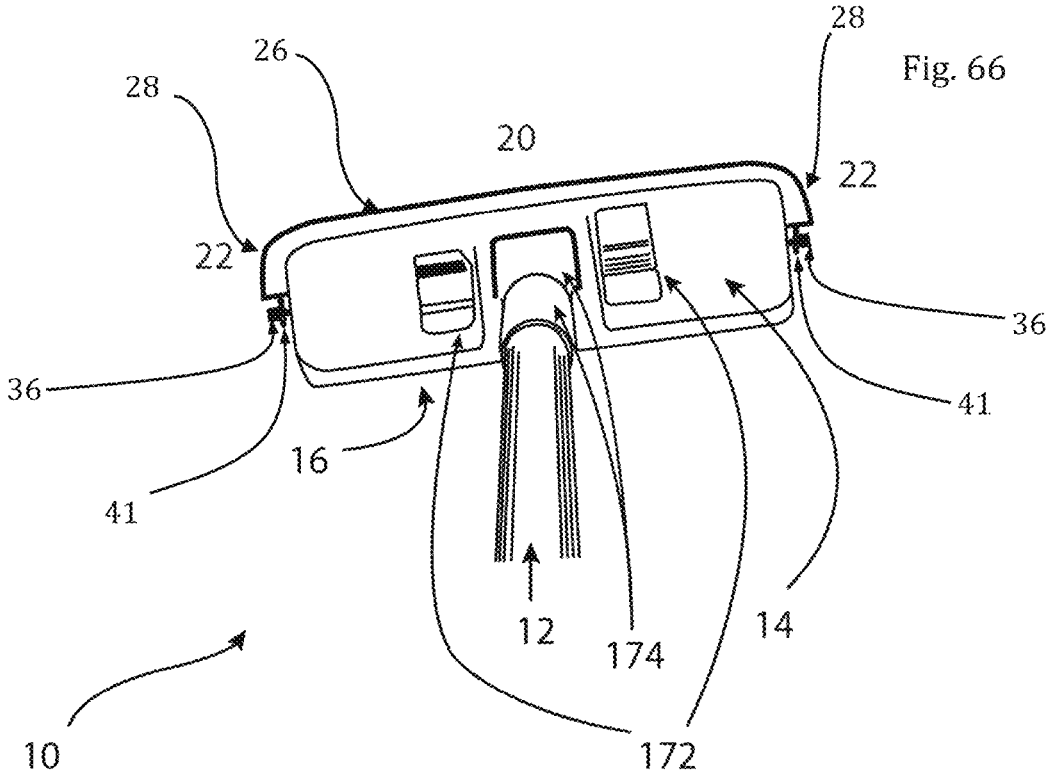
FIG. 66 shows the embodiment of FIG. 65 from a top perspective view, with particular reference to curvature of a flexible spine.

Result of this method for achieving upward and radial cleaning for a floor cleaning apparatus is best shown in FIG. 66. The brush element of the cleaning element is not shown for clarity of the positioning of the flexible spine 26. However, substantially upstanding central portion 20 and radial side portions 22 of the cleaning element 18 are still denoted despite absence of the brush element in the drawing.

The flexible spine 26 is shown held substantially straightly to a front of the head 14 of the apparatus 10, and having curved lateral ends 28 as it is curved round the head 14 of the apparatus 10, constrained by the attaching barbs 36 at each lateral end of the head, over which is looped the ringlets 41. Thus radially outwardly projecting side portions 22 are formed. A benefit of the shown example embodiment is that the head of the apparatus is fully visible to a user. In varying embodiments, the cleaning element may not have a spine, may be embedded directly (or substantially directly) into the head 14 of the apparatus 10, may be provided with a base, may comprise a stabilizing element (such as foam, sponge), etc. Preferably the cleaning element 18 is removably attachable, and thus replaceable. The cleaning element may simply comprise two radial side portions without a central portion, similar or the same to the embodiment as shown in FIG. 56.

Figure 67:
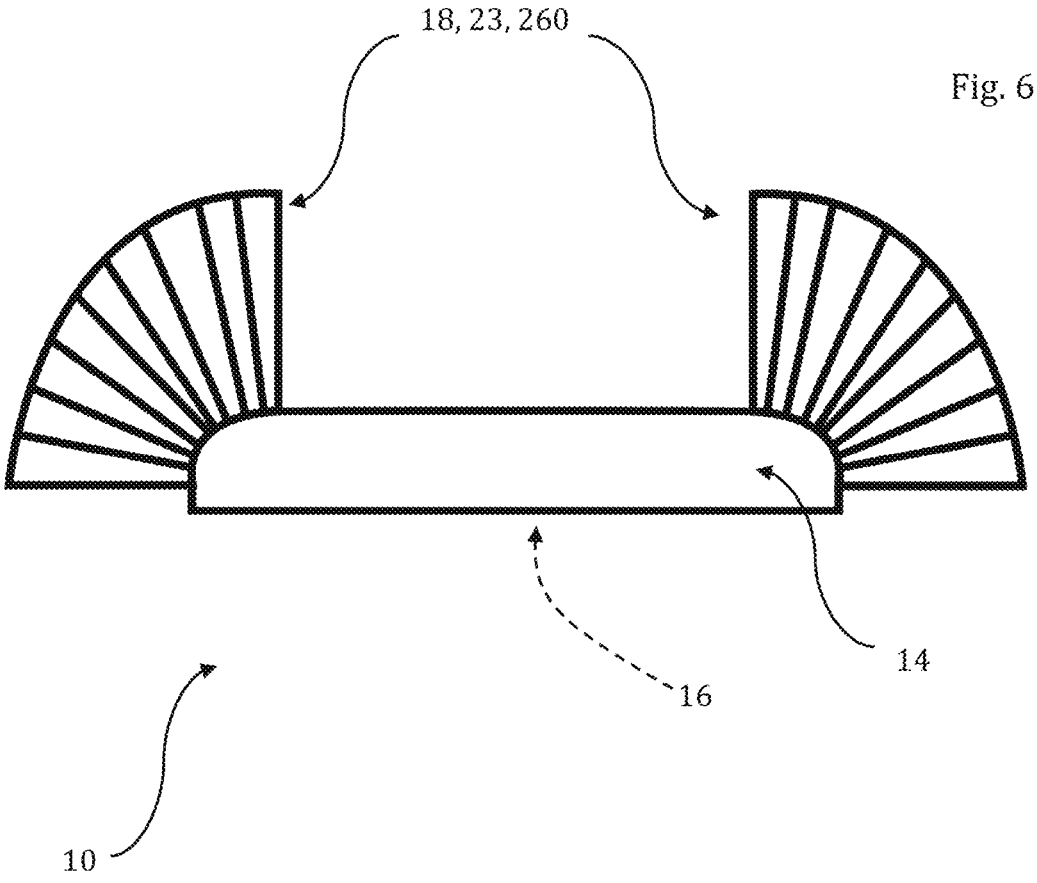
FIG. 67 is a front, eye-level view of a robotic embodiment.

There is shown in FIG. 67 a front on view of an embodiment of a robotic floor cleaning apparatus 10 where there are provided two longitudinal circumferential radial wing cleaning elements 260. (The radial wings 260 may also feasibly be defined as radial whiskers 23). The same embodiment is shown in a birds-eye view in FIG. 68, where the longitudinal length of the circumferential radial wings 260 is shown. (Direction of movement of the robotic apparatus is denoted by enlarged arrow 262).

Such embodiments may employ non-removable cleaning elements 18, or removably attachable cleaning elements 18. The circumferential radial cleaning wings 260 may be spheroidal, as shown in FIG. 67, having a rounded curved face, or may not be spheroidal. Such embodiments may utilize curvature of the head of the apparatus to achieve curvature of the cleaning element 18 (as shown, for example, (and in no way limiting how to use curvature of the head of the apparatus to achieve curvature of the cleaning element 18), in FIG. 66. The cleaning elements may feasibly have a floppy base and may be attachable by hook and loop type securing elements, such as, but not limited to, Velcro, or any other attachment means and/or method.

The radial wing cleaning elements 18, 260 in varying embodiments may be embedded into the head of the apparatus, may comprise a spine, may comprise a base plate, may comprise a stabilizing member, etc. This circumferential method for providing the cleaning elements 18 is not limited to use for robotic floor cleaning apparatuses and may be provided for any floor cleaning apparatus. The radial wings 260 may comprise a flexible spine to aid application and/or attachment of the radial wing to the apparatus, and/or to aid shaping of the radial wing 260. The radial wing 260 may have a base, spine, etc, which may, for example, be rigid and pre-shaped for application to the head 14 of the apparatus.

There is shown in FIG. 69 from a birds-eye view an embodiment of a robotic floor cleaning apparatus 10 where there is provided a front circumferential radial wing 260. (Direction of movement of the robotic apparatus is denoted by enlarged arrow 264).

(Cleaning elements are shaded for added emphasis, and not necessarily to denote directions on bristles etc. of the cleaning element, although if the cleaning element comprises bristles, the bristles may radiate outwardly. The cleaning element need not have bristles and may employ any material, as aforestated).

Thus there is provided in the shown embodiment of FIG. 69 solely one circumferential radial wing, which, being positioned at a front of the head of the apparatus (with reference to directional movement of the apparatus) may carry out upward and radial cleaning. Alternatively, a brush element as described in prior embodiments may extend over a top surface and lateral edges of the head of the robotic cleaning apparatus. The cleaning element may be spheroidal, or may not be—for example, the cleaning element 18 may, in a substantially narrow manner, extend from a circumferential rim 248 of the head of the apparatus (preferably extending upwardly and slightly forwardly). The example embodiment is shown with reference to a robotic floor cleaning apparatus 10, but may similarly be provided for any floor cleaning apparatus.

In the shown example embodiment (or any other embodiment of the invention), the cleaning element 18 may comprise a stabilizing member 130. A top portion 131 of the cleaning element 18 may be (removably) attachable to the stabilizing member 130, via any means. For example fine hairs (or any brush element for brushing—for example, fur (filaments), hair, etc) may be attachable to the stabilizing member via, for example, a hook and loop (eg Velcro-type) element(s).

Figure 70:
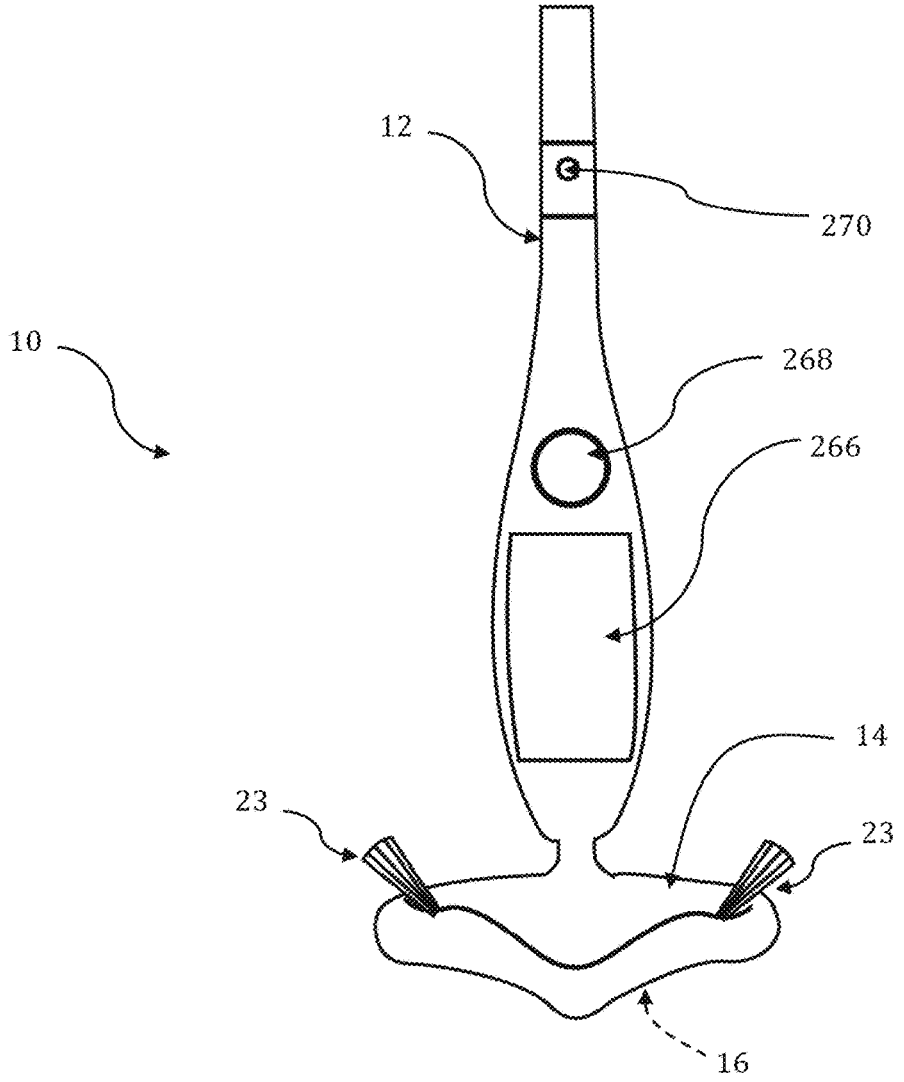
FIG. 70 is a front-on view of the invention, wherein the floor cleaning apparatus is a steaming device.

There is shown in FIG. 70 an embodiment of the invention where there is provided a floor cleaning apparatus 10 that is a floor steamer, the floor cleaning apparatus comprising a head, a downward facing cleaning element for cleaning of a ground surface, a first radial whisker 23 on a lateral side of the head 14, and a second radial whisker 23 on an opposing lateral side of the head 14. There is shown in the example embodiment a water reservoir chamber 266, a settings dial 268, and a manual switch 270, which may be used for releasing part of the handle 12 from the apparatus, or to aid use of the steamer when separated from the head of the apparatus. For the shown example, the radial whisker 23 is not spheroidal (or substantially not spheroidal). Nevertheless, it cleans diagonally (upwardly and outwardly). Such radial whiskers 23 may be employed on any floor cleaning apparatus. The radial whiskers may be non-removable (for example embedded permanently (or substantially permanently) into (or about) the head 14 of the floor cleaning apparatus 10; the radial whiskers may be removably attachable, and thus replaceable. A plurality of radial whiskers may be provided for replacement reasons. Differing types, colors, sizes, shapes, and constitution (ie differing materials, etc) of radial whiskers may be provided for cleaning of different surfaces, locations, etc.

Figure 71:
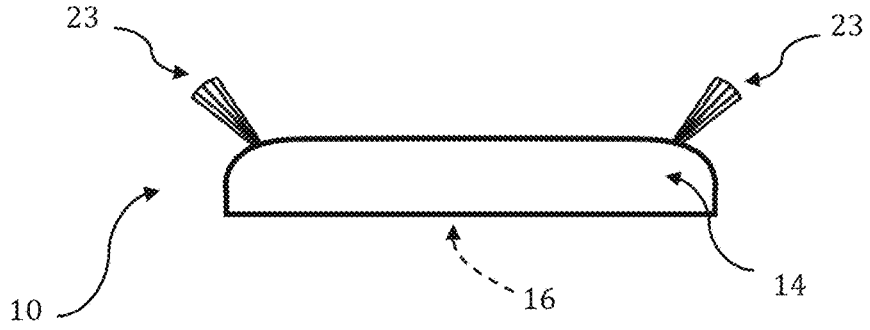
FIG. 71 is an eye-level front on view of a robotic embodiment, where the radial whiskers clean upwardly and outwardly outside a circumference of the head of the apparatus.

There is shown in FIG. 71 an example of a robotic floor cleaning apparatus 10 with radial whiskers similar or the same to those shown in FIG. 70, where the radial whiskers clean upwardly and outwardly outside a circumference of the head of the apparatus.

Figure 72:
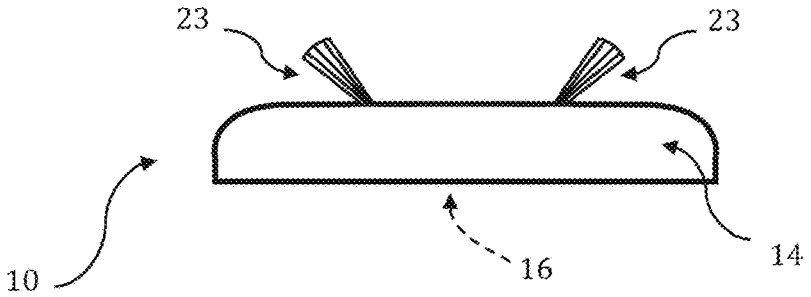
FIG. 72 is an eye-level front on view of a similar embodiment to FIG. 71, where the radial whiskers 23 are positioned inside a circumference of the head of the apparatus, brush element of the radial whiskers not extending outside a circumference of the head of the apparatus.

There is shown in FIG. 72 an example of a robotic floor cleaning apparatus 10 with radial whiskers similar or the same to those shown in FIG. 70, where the radial whiskers 23 are positioned inside a circumference of the head of the apparatus, brush element of the radial whiskers not extending outside a circumference of the head of the apparatus.

The example embodiments shown in FIG. 71 and FIG. 72 are not limited to use with a robotic floor cleaning apparatus and may be employed and/or provided for any floor cleaning apparatus.

It has been stated earlier that a plurality of cleaning elements may be provided, and that they may be differently coloured. To explain further, it is feasible, for example, that there are differently coloured cleaning elements, eg for regular cleaning around the house, for use in the bathroom, (and possibly even for use in the kitchen). For example, when using the apparatus in the bathroom, (where there may be dirt/germs which the user may not want to spread around any other part of the house), the cleaning element may be coloured red (partially or wholly), for example. (It is thought a differently coloured cleaning element for bathroom use may be particularly useful, for the reasons as mentioned above). For use around the rest of the house, a cleaning element may, for example, be coloured green (partially or wholly), for example. It is even possible a cleaning element may be provided, for kitchen use, that is differently coloured, (eg coloured blue, (partially or wholly), for example). (The colouring examples given are provided by way of example only). It is even possible wording may be provided on the cleaning element. For example, there may be a cleaning element with the word 'bathroom' (or the like) on the cleaning element. For example, there may be a cleaning element with the word 'kitchen' (or the like) on the cleaning element, for example. Thus a plurality of cleaning elements may be provided, for use in different places/locations.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

The invention claimed is:

1. A robotic vacuum cleaning apparatus, comprising:

a head, capable of robotic movement over a ground surface;

a suction element to facilitate suction cleaning of the ground surface via the head; and a cleaning element that comprises a brushing portion that, at its highest point, is higher than half height of the head of the robotic vacuum cleaning apparatus;

wherein the head comprises a suction system that generates suction, to facilitate suction cleaning of the ground surface, the suction system being a source of suction power.

2. A robotic vacuum cleaning apparatus as claimed in claim 1, wherein the brushing portion, at its highest point, is higher than a whole of the head of the robotic vacuum cleaning apparatus.

3. A robotic vacuum cleaning apparatus as claimed in claim 2, wherein the cleaning element is removably attachable to the head.

4. A robotic vacuum cleaning apparatus as claimed in claim 3, wherein the robotic vacuum cleaning apparatus comprises another removably attachable cleaning element that comprises a brushing portion that, at its highest point, is higher than the whole of the head of the robotic vacuum cleaning apparatus, the cleaning elements being separately removably attachable to the head.

5. A robotic vacuum cleaning apparatus as claimed in claim 2, wherein the robotic vacuum cleaning apparatus comprises another cleaning element that comprises a brushing portion that, at its highest point, is higher than the whole of the head of the robotic vacuum cleaning apparatus.

6. A robotic vacuum cleaning apparatus as claimed in claim 2, wherein a portion or a whole of the brushing portion, from a top view, is outside a perimeter of the head of the robotic vacuum cleaning apparatus, and wherein the brushing portion, at its highest point outside the perimeter of the head of the robotic vacuum cleaning apparatus, is higher than the whole of the head of the robotic vacuum cleaning apparatus.

7. A robotic vacuum cleaning apparatus as claimed in claim 6, wherein the cleaning element is removably attachable to the head.

8. A robotic vacuum cleaning apparatus as claimed in claim 7, wherein the robotic vacuum cleaning apparatus comprises another removably attachable cleaning element that comprises a brushing portion, wherein a portion or a whole of the brushing portion of the other removably attachable cleaning element, from a top view, is outside the perimeter of the head of the robotic vacuum cleaning apparatus, and wherein the brushing portion of the other removably attachable cleaning element, at its highest point outside the perimeter of the head of the robotic vacuum cleaning apparatus, is higher than the whole of the head of the robotic vacuum cleaning apparatus, the cleaning elements being separately removably attachable to the head.

9. A robotic vacuum cleaning apparatus as claimed in claim 6, wherein the robotic vacuum cleaning apparatus comprises another cleaning element that comprises a brushing portion, wherein a portion or a whole of the brushing portion of the other cleaning element, from a top view, is outside the perimeter of the head of the robotic vacuum cleaning apparatus, and wherein the brushing portion of the other cleaning element, at its highest point outside the perimeter of the head of the robotic vacuum cleaning apparatus, is higher than the whole of the head of the robotic vacuum cleaning apparatus.

10. A robotic vacuum cleaning apparatus as claimed in claim 6, wherein the brushing portion, at its lowest point outside the perimeter of the head, is lower than a highest point of the head.

11. A robotic vacuum cleaning apparatus as claimed in claim 10, wherein the cleaning element is removably attachable to the head.

12. A robotic vacuum cleaning apparatus as claimed in claim 6, wherein the brushing portion, at its lowest point outside the perimeter of the head, is lower than half height of the head.

13. A robotic vacuum cleaning apparatus as claimed in claim 12, wherein the cleaning element is removably attachable to the head.

14. A robotic vacuum cleaning apparatus as claimed in claim 2, wherein a portion or a whole of the brushing portion, from a top view, is inside a perimeter of the head of the robotic vacuum cleaning apparatus, and wherein, the brushing portion, at its highest point inside the perimeter of the head of the robotic vacuum cleaning apparatus, is higher than the whole of the head of the robotic vacuum cleaning apparatus.

15. A robotic vacuum cleaning apparatus as claimed in claim 14, wherein the cleaning element is removably attachable to the head.

16. A robotic vacuum cleaning apparatus as claimed in claim 15, wherein the robotic vacuum cleaning apparatus comprises another removably attachable cleaning element that comprises a brushing portion, wherein a portion or a whole of the brushing portion of the other removably attachable cleaning element, from a top view, is inside the perimeter of the head of the robotic vacuum cleaning apparatus, and wherein the brushing portion of the other removably attachable cleaning element, at its highest point inside the perimeter of the head of the robotic vacuum cleaning apparatus, is higher than the whole of the head of the robotic vacuum cleaning apparatus, the cleaning elements being separately removably attachable to the head.

17. A robotic vacuum cleaning apparatus as claimed in claim 14, wherein the robotic vacuum cleaning apparatus comprises another cleaning element that comprises a brushing portion, wherein a portion or a whole of the brushing portion of the other cleaning element, from a top view, is inside the perimeter of the head of the robotic vacuum cleaning apparatus, and wherein the brushing portion of the other cleaning element, at its highest point inside the perimeter of the head of the robotic vacuum cleaning apparatus, is higher than the whole of the head of the robotic vacuum cleaning apparatus.

18. A robotic vacuum cleaning apparatus as claimed in claim 2, wherein the brushing portion extends left further than a left side of the head, and wherein the brushing portion, at its highest point further left than the left side of the head, is higher than the whole of the head; and wherein the robotic vacuum cleaning apparatus comprises another cleaning element, wherein the other cleaning element comprises a brushing portion that extends right further than a right side of the head, wherein the brushing portion that extends right further than the right side of the head, at its highest point further right than the right side of the head, is higher than the whole of the head.

19. A robotic vacuum cleaning apparatus as claimed in claim 18, wherein the cleaning elements are separately removably attachable to the head.

20. A robotic vacuum cleaning apparatus as claimed in claim 18, wherein the brushing portion that extends left further than the left side of the head, at its lowest point further left than the left side of the head, is lower than a highest point of the head; and the brushing portion that extends right further than the right side of the head, at its lowest point further right than the right side of the head, is lower than a highest point of the head.

21. A robotic vacuum cleaning apparatus as claimed in claim 20, wherein the cleaning elements are separately removably attachable to the head.

22. A robotic vacuum cleaning apparatus as claimed in claim 18, wherein the brushing portion that extends left further than the left side of the head, at its lowest point further left than the left side of the head, is lower than half height of the head; and the brushing portion that extends right further than the right side of the head, at its lowest point further right than the right side of the head, is lower than half height of the head.

23. A robotic vacuum cleaning apparatus as claimed in claim 22, wherein the cleaning elements are separately removably attachable to the head.

24. A robotic vacuum cleaning apparatus as claimed in claim 2, wherein the cleaning element is removably attachable to the head, and wherein, having defined in claim 2 that the cleaning element comprises a brushing portion that, at its highest point, is higher than a whole of the head, it is now more particularly defined that the cleaning element comprises:

a left brushing portion that extends left further than a left side of the head, wherein the left brushing portion, at its highest point further left than the left side of the head, is higher than the whole of the head; and a right brushing portion that extends right further than a right side of the head, wherein the right brushing portion, at its highest point further right than the right side of the head, is higher than the whole of the head.

25. A robotic vacuum cleaning apparatus as claimed in claim 24, wherein the brushing portion that extends left further than the left side of the head, at its lowest point further left than the left side of the head, is lower than a highest point of the head; and the brushing portion that extends right further than the right side of the head, at its lowest point further right than the right side of the head, is lower than a highest point of the head.

26. A robotic vacuum cleaning apparatus as claimed in claim 24, wherein the brushing portion that extends left further than the left side of the head, at its lowest point further left than the left side of the head, is lower than half height of the head; and the brushing portion that extends right further than the right side of the head, at its lowest point further right than the right side of the head, is lower than half height of the head.

27. A robotic vacuum cleaning apparatus as claimed in claim 2, wherein the brushing portion extends forward further than a front of the head of the apparatus, in front of a central third of the head, and wherein the brushing portion, at its highest point in front of the central third of the head, further forward than the front of the head, is higher than the whole of the head of the robotic vacuum cleaning apparatus.

28. A robotic vacuum cleaning apparatus as claimed in claim 27, wherein the cleaning element is removably attachable to the head.

29. A robotic vacuum cleaning apparatus as claimed in claim 1, wherein the cleaning element is removably attachable to the head.

30. A robotic vacuum cleaning apparatus as claimed in claim 29, wherein the robotic vacuum cleaning apparatus comprises another removably attachable cleaning element that comprises a brushing portion that, at its highest point, is higher than half height of the head of the robotic vacuum cleaning apparatus, the cleaning elements being separately removably attachable to the head.

31. A robotic vacuum cleaning apparatus as claimed in claim 1, wherein the robotic vacuum cleaning apparatus comprises another cleaning element that comprises a brushing portion that, at its highest point, is higher than half height of the head of the robotic vacuum cleaning apparatus.

32. A robotic vacuum cleaning apparatus as claimed in claim 1, wherein a portion or a whole of the brushing portion, from a top view, is outside a perimeter of the head of the robotic vacuum cleaning apparatus, and wherein the brushing portion, at its highest point outside the perimeter of the head of the robotic vacuum cleaning apparatus, is higher than half height of the head of the robotic vacuum cleaning apparatus.

33. A robotic vacuum cleaning apparatus as claimed in claim 32, wherein the cleaning element is removably attachable to the head.

34. A robotic vacuum cleaning apparatus as claimed in claim 33, wherein the robotic vacuum cleaning apparatus comprises another removably attachable cleaning element that comprises a brushing portion, wherein a portion or a whole of the brushing portion of the other removably attachable cleaning element, from a top view, is outside the perimeter of the head of the robotic vacuum cleaning apparatus, and wherein the brushing portion of the other removably attachable cleaning element, at its highest point outside the perimeter of the head of the robotic vacuum cleaning apparatus, is higher than half height of the head of the robotic vacuum cleaning apparatus, the cleaning elements being separately removably attachable to the head.

35. A robotic vacuum cleaning apparatus as claimed in claim 32, wherein the robotic vacuum cleaning apparatus comprises another cleaning element that comprises a brushing portion, wherein a portion or a whole of the brushing portion of the other cleaning element, from a top view, is outside the perimeter of the head of the robotic vacuum cleaning apparatus, and wherein the brushing portion of the other cleaning element, at its highest point outside the perimeter of the head of the robotic vacuum cleaning apparatus, is higher than half height of the head of the robotic vacuum cleaning apparatus.

36. A robotic vacuum cleaning apparatus as claimed in claim 32, wherein the brushing portion, at its lowest point outside the perimeter of the head, is lower than half height of the head.

37. A robotic vacuum cleaning apparatus as claimed in claim 36, wherein the cleaning element is removably attachable to the head.

38. A robotic vacuum cleaning apparatus as claimed in claim 1, wherein the brushing portion extends left further than a left side of the head, and wherein the brushing portion, at its highest point further left than the left side of the head, is higher than half height of the head; and wherein the robotic vacuum cleaning apparatus comprises another cleaning element, wherein the other cleaning element-comprises a brushing portion that extends right further than a right side of the head, wherein the brushing portion that extends right further than the right side of the head, at its highest point further right than the right side of the head, is higher than half height of the head.

39. A robotic vacuum cleaning apparatus as claimed in claim 38, wherein the cleaning elements are separately removably attachable to the head.

40. A robotic vacuum cleaning apparatus as claimed in claim 38, wherein the brushing portion that extends left further than the left side of the head, at its lowest point further left than the left side of the head, is lower than half height of the head; and the brushing portion that extends right further than the right side of the head, at its lowest point further right than the right side of the head, is lower than half height of the head.

41. A robotic vacuum cleaning apparatus as claimed in claim 40, wherein the cleaning elements are separately removably attachable to the head.

42. A robotic vacuum cleaning apparatus as claimed in claim 1, wherein the cleaning element is removably attachable to the head, and wherein, having defined in claim 1 that the cleaning element comprises a brushing portion that, at its highest point, is higher than half height of the head, it is now more particularly defined that the cleaning element comprises:

a left brushing portion that extends left further than a left side of the head, wherein the left brushing portion, at its highest point further left than the left side of the head, is higher than half height of the head; and a right brushing portion that extends right further than a right side of the head, wherein the right brushing portion, at its highest point further right than the right side of the head, is higher than half height of the head.

43. A robotic vacuum cleaning apparatus as claimed in claim 42, wherein the brushing portion that extends left further than the left side of the head, at its lowest point further left than the left side of the head, is lower than half height of the head; and the brushing portion that extends right further than the right side of the head, at its lowest point further right than the right side of the head, is lower than half height of the head.

44. A robotic vacuum cleaning apparatus as claimed in claim 1, wherein the brushing portion extends forward further than a front of the head of the apparatus, in front of a central third of the head, and wherein the brushing portion, at its highest point in front of the central third of the head, further forward than the front of the head, is higher than half height of the head of the robotic vacuum cleaning apparatus.

45. A robotic vacuum cleaning apparatus as claimed in claim 44, wherein the cleaning element is removably attachable to the head.

46. A robotic vacuum cleaning apparatus, comprising:

a head, capable of robotic movement over a ground surface via electronics that the head comprises;

a suction element to facilitate suction cleaning of the ground surface via the head; and a cleaning element that comprises a brushing portion that, at its highest point, is higher than half height of the head of the robotic vacuum cleaning apparatus.

47. A robotic vacuum cleaning apparatus as claimed in claim 46, wherein the brushing portion, at its highest point, is higher than a whole of the head of the robotic vacuum cleaning apparatus.

48. A robotic vacuum cleaning apparatus as claimed in claim 47, wherein the cleaning element is removably attachable to the head.

49. A robotic vacuum cleaning apparatus as claimed in claim 48, wherein the robotic vacuum cleaning apparatus comprises another removably attachable cleaning element that comprises a brushing portion that, at its highest point, is higher than the whole of the head of the robotic vacuum cleaning apparatus, the cleaning elements being separately removably attachable to the head.

50. A robotic vacuum cleaning apparatus as claimed in claim 47, wherein the robotic vacuum cleaning apparatus comprises another cleaning element that comprises a brushing portion that, at its highest point, is higher than the whole of the head of the robotic vacuum cleaning apparatus.

51. A robotic vacuum cleaning apparatus as claimed in claim 47, wherein a portion or a whole of the brushing portion, from a top view, is outside a perimeter of the head of the robotic vacuum cleaning apparatus, and wherein the brushing portion, at its highest point outside the perimeter of the head of the robotic vacuum cleaning apparatus, is higher than the whole of the head of the robotic vacuum cleaning apparatus.

52. A robotic vacuum cleaning apparatus as claimed in claim 51, wherein the cleaning element is removably attachable to the head.

53. A robotic vacuum cleaning apparatus as claimed in claim 52, wherein the robotic vacuum cleaning apparatus comprises another removably attachable cleaning element that comprises a brushing portion, wherein a portion or a whole of the brushing portion of the other removably attachable cleaning element, from a top view, is outside the perimeter of the head of the robotic vacuum cleaning apparatus, and wherein the brushing portion of the other removably attachable cleaning element, at its highest point outside the perimeter of the head of the robotic vacuum cleaning apparatus, is higher than the whole of the head of the robotic vacuum cleaning apparatus, the cleaning elements being separately removably attachable to the head.

54. A robotic vacuum cleaning apparatus as claimed in claim 51, wherein the robotic vacuum cleaning apparatus comprises another cleaning element that comprises a brushing portion, wherein a portion or a whole of the brushing portion of the other cleaning element, from a top view, is outside the perimeter of the head of the robotic vacuum cleaning apparatus, and wherein the brushing portion of the other cleaning element, at its highest point outside the perimeter of the head of the robotic vacuum cleaning apparatus, is higher than the whole of the head of the robotic vacuum cleaning apparatus.

55. A robotic vacuum cleaning apparatus as claimed in claim 47, wherein a portion or a whole of the brushing portion, from a top view, is inside a perimeter of the head of the robotic vacuum cleaning apparatus, and wherein, the brushing portion, at its highest point inside the perimeter of the head of the robotic vacuum cleaning apparatus, is higher than the whole of the head of the robotic vacuum cleaning apparatus.

56. A robotic vacuum cleaning apparatus as claimed in claim 55, wherein the cleaning element is removably attachable to the head.

57. A robotic vacuum cleaning apparatus as claimed in claim 56, wherein the robotic vacuum cleaning apparatus comprises another removably attachable cleaning element that comprises a brushing portion, wherein a portion or a whole of the brushing portion of the other removably attachable cleaning element, from a top view, is inside the perimeter of the head of the robotic vacuum cleaning apparatus, and wherein the brushing portion of the other removably attachable cleaning element, at its highest point inside the perimeter of the head of the robotic vacuum cleaning apparatus, is higher than the whole of the head of the robotic vacuum cleaning apparatus, the cleaning elements being separately removably attachable to the head.

58. A robotic vacuum cleaning apparatus as claimed in claim 55, wherein the robotic vacuum cleaning apparatus comprises another cleaning element that comprises a brushing portion, wherein a portion or a whole of the brushing portion of the other cleaning element, from a top view, is inside the perimeter of the head of the robotic vacuum cleaning apparatus, and wherein the brushing portion of the other cleaning element, at its highest point inside the perimeter of the head of the robotic vacuum cleaning apparatus, is higher than the whole of the head of the robotic vacuum cleaning apparatus.

59. A robotic vacuum cleaning apparatus as claimed in claim 47, wherein the brushing portion extends left further than a left side of the head, and wherein the brushing portion, at its highest point further left than the left side of the head, is higher than the whole of the head; and wherein the robotic vacuum cleaning apparatus comprises another cleaning element, wherein the other cleaning element comprises a brushing portion that extends right further than a right side of the head, wherein the brushing portion that extends right further than the right side of the head, at its highest point further right than the right side of the head, is higher than the whole of the head.

60. A robotic vacuum cleaning apparatus as claimed in claim 59, wherein the cleaning elements are separately removably attachable to the head.

61. A robotic vacuum cleaning apparatus as claimed in claim 59, wherein the brushing portion that extends left further than the left side of the head, at its lowest point further left than the left side of the head, is lower than a highest point of the head; and the brushing portion that extends right further than the right side of the head, at its lowest point further right than the right side of the head, is lower than a highest point of the head.

62. A robotic vacuum cleaning apparatus as claimed in claim 61, wherein the cleaning elements are separately removably attachable to the head.

63. A robotic vacuum cleaning apparatus as claimed in claim 59, wherein the brushing portion that extends left further than the left side of the head, at its lowest point further left than the left side of the head, is lower than half height of the head; and the brushing portion that extends right further than the right side of the head, at its lowest point further right than the right side of the head, is lower than half height of the head.

64. A robotic vacuum cleaning apparatus as claimed in claim 63, wherein the cleaning elements are separately removably attachable to the head.

65. A robotic vacuum cleaning apparatus as claimed in claim 47, wherein the cleaning element is removably attachable to the head, and wherein, having defined in claim 47 that the cleaning element comprises a brushing portion that, at its highest point, is higher than a whole of the head, it is now more particularly defined that the cleaning element comprises:

a left brushing portion that extends left further than a left side of the head, wherein the left brushing portion, at its highest point further left than the left side of the head, is higher than the whole of the head; and a right brushing portion that extends right further than a right side of the head, wherein the right brushing portion, at its highest point further right than the right side of the head, is higher than the whole of the head.

66. A robotic vacuum cleaning apparatus as claimed in claim 65, wherein the brushing portion that extends left further than the left side of the head, at its lowest point further left than the left side of the head, is lower than a highest point of the head; and the brushing portion that extends right further than the right side of the head, at its lowest point further right than the right side of the head, is lower than a highest point of the head.

67. A robotic vacuum cleaning apparatus as claimed in claim 65, wherein the brushing portion that extends left further than the left side of the head, at its lowest point further left than the left side of the head, is lower than half height of the head; and the brushing portion that extends right further than the right side of the head, at its lowest point further right than the right side of the head, is lower than half height of the head.

68. A robotic vacuum cleaning apparatus as claimed in claim 47, wherein the brushing portion extends forward further than a front of the head of the apparatus, in front of a central third of the head, and wherein the brushing portion, at its highest point in front of the central third of the head, further forward than the front of the head, is higher than the whole of the head of the robotic vacuum cleaning apparatus.

69. A robotic vacuum cleaning apparatus as claimed in claim 68, wherein the cleaning element is removably attachable to the head.

70. A robotic vacuum cleaning apparatus as claimed in claim 47, wherein the brushing portion, at its lowest point outside the perimeter of the head, is lower than a highest point of the head.

71. A robotic vacuum cleaning apparatus as claimed in claim 70, wherein the cleaning element is removably attachable to the head.

72. A robotic vacuum cleaning apparatus as claimed in claim 47, wherein the brushing portion, at its lowest point outside the perimeter of the head, is lower than half height of the head.

73. A robotic vacuum cleaning apparatus as claimed in claim 72, wherein the cleaning element is removably attachable to the head.

74. A robotic vacuum cleaning apparatus as claimed in claim 46, wherein the cleaning element is removably attachable to the head.

75. A robotic vacuum cleaning apparatus as claimed in claim 74, wherein the robotic vacuum cleaning apparatus comprises another removably attachable cleaning element that comprises a brushing portion that, at its highest point, is higher than half height of the head of the robotic vacuum cleaning apparatus, the cleaning elements being separately removably attachable to the head.

76. A robotic vacuum cleaning apparatus as claimed in claim 46, wherein the robotic vacuum cleaning apparatus comprises another cleaning element that comprises a brushing portion that, at its highest point, is higher than half height of the head of the robotic vacuum cleaning apparatus.

77. A robotic vacuum cleaning apparatus as claimed in claim 46, wherein a portion or a whole of the brushing portion, from a top view, is outside a perimeter of the head of the robotic vacuum cleaning apparatus, and wherein the brushing portion, at its highest point outside the perimeter of the head of the robotic vacuum cleaning apparatus, is higher than half height of the head of the robotic vacuum cleaning apparatus.

78. A robotic vacuum cleaning apparatus as claimed in claim 77, wherein the cleaning element is removably attachable to the head.

79. A robotic vacuum cleaning apparatus as claimed in claim 78, wherein the robotic vacuum cleaning apparatus comprises another removably attachable cleaning element that comprises a brushing portion, wherein a portion or a whole of the brushing portion of the other removably attachable cleaning element, from a top view, is outside the perimeter of the head of the robotic vacuum cleaning apparatus, and wherein the brushing portion of the other removably attachable cleaning element, at its highest point outside the perimeter of the head of the robotic vacuum cleaning apparatus, is higher than half height of the head of the robotic vacuum cleaning apparatus, the cleaning elements being separately removably attachable to the head.

80. A robotic vacuum cleaning apparatus as claimed in claim 77, wherein the robotic vacuum cleaning apparatus comprises another cleaning element that comprises a brushing portion, wherein a portion or a whole of the brushing portion of the other cleaning element, from a top view, is outside the perimeter of the head of the robotic vacuum cleaning apparatus, and wherein the brushing portion of the other cleaning element, at its highest point outside the perimeter of the head of the robotic vacuum cleaning apparatus, is higher than half height of the head of the robotic vacuum cleaning apparatus.

81. A robotic vacuum cleaning apparatus as claimed in claim 46, wherein the brushing portion extends left further than a left side of the head, and wherein the brushing portion, at its highest point further left than the left side of the head, is higher than half height of the head; and wherein the robotic vacuum cleaning apparatus comprises another cleaning element, wherein the other cleaning element-comprises a brushing portion that extends right further than a right side of the head, wherein the brushing portion that extends right further than the right side of the head, at its highest point further right than the right side of the head, is higher than half height of the head.

82. A robotic vacuum cleaning apparatus as claimed in claim 81, wherein the cleaning elements are separately removably attachable to the head.

83. A robotic vacuum cleaning apparatus as claimed in claim 81, wherein the brushing portion that extends left further than the left side of the head, at its lowest point further left than the left side of the head, is lower than half height of the head; and the brushing portion that extends right further than the right side of the head, at its lowest point further right than the right side of the head, is lower than half height of the head.

84. A robotic vacuum cleaning apparatus as claimed in claim 83, wherein the cleaning elements are separately removably attachable to the head.

85. A robotic vacuum cleaning apparatus as claimed in claim 46, wherein the cleaning element is removably attachable to the head, and wherein, having defined in claim 46 that the cleaning element comprises a brushing portion that, at its highest point, is higher than half height of the head, it is now more particularly defined that the cleaning element comprises:

a left brushing portion that extends left further than a left side of the head, wherein the left brushing portion, at its highest point further left than the left side of the head, is higher than half height of the head; and a right brushing portion that extends right further than a right side of the head, wherein the right brushing portion, at its highest point further right than the right side of the head, is higher than half height of the head.

86. A robotic vacuum cleaning apparatus as claimed in claim 85, wherein the brushing portion that extends left further than the left side of the head, at its lowest point further left than the left side of the head, is lower than half height of the head; and the brushing portion that extends right further than the right side of the head, at its lowest point further right than the right side of the head, is lower than half height of the head.

87. A robotic vacuum cleaning apparatus as claimed in claim 46, wherein the brushing portion extends forward further than a front of the head of the apparatus, in front of a central third of the head, and wherein the brushing portion, at its highest point in front of the central third of the head, further forward than the front of the head, is higher than half height of the head of the robotic vacuum cleaning apparatus.

88. A robotic vacuum cleaning apparatus as claimed in claim 87, wherein the cleaning element is removably attachable to the head.

89. A robotic vacuum cleaning apparatus as claimed in claim 46, wherein the brushing portion, at its lowest point outside the perimeter of the head, is lower than half height of the head.

90. A robotic vacuum cleaning apparatus as claimed in claim 89, wherein the cleaning element is removably attachable to the head.

91. A robotic vacuum cleaning apparatus, comprising:

a head, capable of robotic movement over a ground surface via electronics that the head comprises;

a suction element to facilitate suction cleaning of the ground surface via the head; and a cleaning element that comprises a brushing portion that, at its highest point, is higher than half height of the head of the robotic vacuum cleaning apparatus;

wherein the head comprises a suction system that generates suction, to facilitate suction cleaning of the ground surface, the suction system being a source of suction power.

* * * * *